US007219449B1

(12) United States Patent
Hoffberg et al.

(10) Patent No.: US 7,219,449 B1
(45) Date of Patent: May 22, 2007

(54) ADAPTIVELY CONTROLLED FOOTWEAR

(75) Inventors: Steven M. Hoffberg, West Harrison, NY (US); Ronald Fisher, New Haven, CT (US)

(73) Assignee: ProMDX Technology, Inc., New Haven, CT (US)

( * ) Notice: Subject to any disclaimer, the term of this patent is extended or adjusted under 35 U.S.C. 154(b) by 334 days.

(21) Appl. No.: 10/870,194

(22) Filed: Jun. 17, 2004

Related U.S. Application Data

(63) Continuation-in-part of application No. 09/853,097, filed on May 10, 2001, now Pat. No. 6,865,825, which is a continuation of application No. 09/303,585, filed on May 3, 1999, now Pat. No. 6,230,501.

(51) Int. Cl.
*A43B 7/14* (2006.01)

(52) U.S. Cl. ..... 36/88; 36/29

(58) Field of Classification Search ..... 36/2.6, 36/3 R, 3 B, 3 A, 28, 29, 1
See application file for complete search history.

(56) References Cited

U.S. PATENT DOCUMENTS

| | | | |
|---|---|---|---|
| 0,413,693 | A | 10/1889 | Walker |
| 0,507,490 | A | 10/1893 | Gambino |
| 0,968,020 | A | 8/1910 | Yandoli |
| 2,051,100 | A | 8/1936 | Nelson |
| 2,234,066 | A | 3/1941 | Winkel et al. |
| 2,387,334 | A | 10/1945 | Lemke |
| 2,399,543 | A | 4/1946 | Dack |
| 2,414,445 | A | 1/1947 | Cahill |
| 2,441,039 | A | 5/1948 | Smith et al. |
| 2,454,951 | A | 11/1948 | Smith |
| 2,463,516 | A | 3/1949 | Burkhardt |
| 2,529,092 | A | 11/1950 | Lodes |
| 2,550,840 | A | 5/1951 | Martin et al. |
| 2,641,579 | A | 6/1953 | Benning et al. |
| 2,669,038 | A | 2/1954 | DeWerth |
| 2,696,395 | A | 12/1954 | Ellis |
| 2,710,460 | A | 6/1955 | Stasinos |
| 2,757,964 | A | 8/1956 | Both et al. |
| 2,835,534 | A | 5/1958 | Galeazzi |
| 2,985,971 | A | 5/1961 | Murawski |
| 2,987,438 | A | 6/1961 | Ashkenaz et al. |
| 2,998,661 | A | 9/1961 | Israel |
| 3,000,190 | A | 9/1961 | Stark |
| 3,153,413 | A | 10/1964 | Gottfried |
| 3,171,410 | A | 3/1965 | Towle et al. |
| 3,186,404 | A | 6/1965 | Gardner |
| 3,273,610 | A | 9/1966 | Frost |
| 3,314,587 | A | 4/1967 | Johnson |
| 3,548,819 | A | 12/1970 | Davis et al. |
| 3,561,435 | A | 2/1971 | Nicholson et al. |
| 3,623,537 | A | 11/1971 | Hilton et al. |

(Continued)

*Primary Examiner*—Marie Patterson
(74) *Attorney, Agent, or Firm*—Milde & Hoffberg LLP

(57) ABSTRACT

A method for controlling footwear, comprising cushioning a transient force during use of the footwear at a first period of a gait cycle, storing energy from said cushioning, and releasing the stored energy during use of the footwear at a second period of the gait cycle, and after said transient force has subsided. The control can be electronic, mechanical or hydraulic, and is preferably dependent on a sensed gait cycle phase. The control may be adaptive to the user or the use of the footwear. The stored energy can be used to assist in locomotion, to generate electrical energy, to drive a heat pump, or simply dissipated.

34 Claims, 17 Drawing Sheets

U.S. PATENT DOCUMENTS

| | | | | |
|---|---|---|---|---|
| 3,683,902 | A | | 8/1972 | Artemenko et al. |
| 3,733,273 | A | | 5/1973 | Munro et al. |
| 3,758,964 | A | | 9/1973 | Nishimura |
| 3,791,375 | A | | 2/1974 | Pfeiffer |
| 3,812,040 | A | | 5/1974 | Borchardt |
| 3,822,490 | A | | 7/1974 | Murawski |
| 3,862,548 | A | | 1/1975 | Ladany |
| 3,871,117 | A | * | 3/1975 | Richmond et al. ..... 36/43 |
| 3,871,381 | A | | 3/1975 | Roslonski |
| 3,875,688 | A | | 4/1975 | McNaughton |
| 3,879,776 | A | | 4/1975 | Solen |
| 3,881,321 | A | | 5/1975 | Riley |
| 3,886,674 | A | | 6/1975 | Pavia |
| 3,901,817 | A | | 8/1975 | Murphy |
| 3,919,856 | A | | 11/1975 | Beck |
| 3,935,856 | A | | 2/1976 | Loftin |
| 3,940,342 | A | | 2/1976 | Hutchinson |
| 3,973,336 | A | | 8/1976 | Ah |
| 3,974,491 | A | | 8/1976 | Sipe |
| 3,974,844 | A | | 8/1976 | Pimentel |
| 3,976,110 | A | | 8/1976 | White |
| 3,987,643 | A | | 10/1976 | Willis |
| 3,996,677 | A | | 12/1976 | Reina |
| 4,005,531 | A | | 2/1977 | Weintraub et al. |
| 4,008,530 | A | | 2/1977 | Gager |
| 4,016,662 | A | | 4/1977 | Thompson |
| 4,054,036 | A | | 10/1977 | Murphy et al. |
| 4,054,037 | A | | 10/1977 | Yoder |
| 4,054,540 | A | | 10/1977 | Michalchik |
| 4,055,049 | A | | 10/1977 | Murphy et al. |
| 4,055,054 | A | | 10/1977 | Murphy et al. |
| 4,057,973 | A | | 11/1977 | Murphy et al. |
| 4,057,974 | A | | 11/1977 | Murphy et al. |
| 4,078,321 | A | | 3/1978 | Famolare |
| 4,092,257 | A | | 5/1978 | Fozzard |
| 4,101,436 | A | | 7/1978 | Murphy et al. |
| 4,103,704 | A | | 8/1978 | Richards |
| 4,108,146 | A | | 8/1978 | Golden |
| 4,114,620 | A | | 9/1978 | Moore et al. |
| 4,129,951 | A | | 12/1978 | Petrosky |
| 4,130,951 | A | | 12/1978 | Powell |
| 4,135,503 | A | | 1/1979 | Romano |
| 4,149,541 | A | | 4/1979 | Gammons et al. |
| 4,152,304 | A | | 5/1979 | Tadewald |
| 4,155,865 | A | | 5/1979 | Ostrozynski et al. |
| 4,157,976 | A | | 6/1979 | Ostrozynski et al. |
| 4,169,807 | A | | 10/1979 | Zuber |
| 4,170,998 | A | | 10/1979 | Sauder |
| 4,175,297 | A | | 11/1979 | Robbins et al. |
| 4,183,156 | A | | 1/1980 | Rudy |
| 4,184,537 | A | | 1/1980 | Sauder |
| 4,187,620 | A | | 2/1980 | Selner |
| 4,219,945 | A | | 9/1980 | Rudy |
| 4,223,457 | A | | 9/1980 | Borgeas |
| 4,229,889 | A | | 10/1980 | Petrosky |
| 4,237,625 | A | | 12/1980 | Cole et al. |
| 4,262,433 | A | | 4/1981 | Hagg et al. |
| 4,267,648 | A | | 5/1981 | Weisz |
| 4,280,330 | A | | 7/1981 | Harris et al. |
| D260,196 | S | | 8/1981 | Plagenhoef |
| 4,281,775 | A | | 8/1981 | Turner |
| 4,286,622 | A | | 9/1981 | Ninomiya et al. |
| 4,296,557 | A | | 10/1981 | Pajevic |
| 4,300,542 | A | | 11/1981 | Baron |
| 4,302,891 | A | | 12/1981 | Gulli |
| 4,305,212 | A | | 12/1981 | Coomer |
| 4,314,413 | A | | 2/1982 | Dassler |
| 4,319,412 | A | | 3/1982 | Muller et al. |
| 4,319,464 | A | | 3/1982 | Dodd |
| 4,322,892 | A | | 4/1982 | Inohara |
| 4,322,893 | A | | 4/1982 | Halvorsen |
| 4,331,133 | A | | 5/1982 | Arkans |
| 4,335,716 | A | | 6/1982 | Stephen et al. |
| 4,338,944 | A | | 7/1982 | Arkans |
| 4,342,158 | A | | 8/1982 | McMahon et al. |
| 4,354,318 | A | | 10/1982 | Frederick et al. |
| 4,360,978 | A | | 11/1982 | Simpkins |
| 4,364,186 | A | | 12/1982 | Fukuoka |
| 4,364,188 | A | | 12/1982 | Turner et al. |
| 4,373,275 | A | | 2/1983 | Lydiard |
| 4,374,518 | A | | 2/1983 | Villanueva |
| 4,391,048 | A | | 7/1983 | Lutz |
| 4,393,867 | A | | 7/1983 | Baron |
| 4,402,146 | A | | 9/1983 | Parracho et al. |
| 4,414,760 | A | | 11/1983 | Faiella |
| 4,416,072 | A | | 11/1983 | Sarkissian |
| 4,417,408 | A | | 11/1983 | Metro |
| 4,426,884 | A | | 1/1984 | Polchaninoff |
| 4,429,793 | A | | 2/1984 | Ehmann |
| 4,434,158 | A | | 2/1984 | Meister et al. |
| 4,437,138 | A | | 3/1984 | Nicol |
| 4,438,573 | A | | 3/1984 | McBarron |
| 4,442,834 | A | | 4/1984 | Tucker et al. |
| 4,446,634 | A | | 5/1984 | Johnson et al. |
| 4,457,084 | A | | 7/1984 | Horibata et al. |
| 4,458,430 | A | | 7/1984 | Peterson |
| 4,467,252 | A | | 8/1984 | Takeda et al. |
| 4,470,263 | A | | 9/1984 | Lehovec et al. |
| 4,484,397 | A | | 11/1984 | Curley |
| 4,489,302 | A | | 12/1984 | Eventoff |
| 4,490,928 | A | | 1/1985 | Kawashima |
| 4,491,207 | A | | 1/1985 | Boonchanta et al. |
| 4,492,046 | A | | 1/1985 | Kosova |
| 4,495,776 | A | | 1/1985 | Nikolsky et al. |
| 4,499,672 | A | | 2/1985 | Kim |
| 4,502,470 | A | | 3/1985 | Kiser et al. |
| 4,503,705 | A | | 3/1985 | Polchaninoff |
| 4,506,460 | A | | 3/1985 | Rudy |
| 4,510,064 | A | | 4/1985 | Ermak |
| 4,521,979 | A | | 6/1985 | Blaser |
| 4,533,536 | A | | 8/1985 | Bichara et al. |
| 4,534,124 | A | | 8/1985 | Schnell |
| 4,535,553 | A | | 8/1985 | Derderian et al. |
| 4,536,097 | A | | 8/1985 | Nilsson |
| 4,542,547 | A | | 9/1985 | Sato |
| 4,551,974 | A | | 11/1985 | Yaeger et al. |
| 4,553,393 | A | | 11/1985 | Ruoff |
| 4,554,930 | A | | 11/1985 | Kress |
| 4,566,206 | A | | 1/1986 | Weber |
| 4,573,279 | A | | 3/1986 | Feurer-Zogel et al. |
| 4,575,097 | A | | 3/1986 | Brannigan et al. |
| 4,578,769 | A | | 3/1986 | Frederick |
| 4,584,484 | A | | 4/1986 | Hutchin |
| 4,584,847 | A | | 4/1986 | Martello et al. |
| 4,592,153 | A | | 6/1986 | Jacinto |
| 4,597,271 | A | | 7/1986 | Nof |
| 4,602,441 | A | | 7/1986 | ElSakkaf |
| 4,603,002 | A | | 7/1986 | Nikolsky et al. |
| 4,604,807 | A | | 8/1986 | Bock et al. |
| 4,610,099 | A | | 9/1986 | Signori |
| 4,614,046 | A | | 9/1986 | Dassler |
| 4,616,431 | A | | 10/1986 | Dassler |
| 4,622,957 | A | | 11/1986 | Curlee |
| 4,628,703 | A | | 12/1986 | Kim |
| 4,637,222 | A | | 1/1987 | Fujiwara et al. |
| 4,640,101 | A | | 2/1987 | Johnson |
| 4,640,102 | A | | 2/1987 | Tenenbaum et al. |
| 4,644,801 | A | | 2/1987 | Kustanovich |
| 4,649,552 | A | | 3/1987 | Yukawa |
| 4,649,918 | A | | 3/1987 | Pegg et al. |
| 4,651,446 | A | | 3/1987 | Yukawa et al. |
| 4,656,838 | A | | 4/1987 | Shen |
| 4,660,299 | A | | 4/1987 | Omilusik |
| 4,662,087 | A | | 5/1987 | Beuch |

4,668,395 A 5/1987 Clark
4,669,273 A 6/1987 Fischer et al.
4,670,995 A 6/1987 Huang
4,670,996 A 6/1987 Dill
4,671,070 A 6/1987 Rudick
4,679,335 A 7/1987 Berlese
4,679,407 A 7/1987 Kim et al.
4,702,022 A 10/1987 Porcher
4,703,445 A 10/1987 Dassler
4,706,658 A 11/1987 Cronin
4,716,731 A 1/1988 Sakai et al.
4,730,403 A 3/1988 Walkhoff
4,733,758 A 3/1988 Duclos et al.
4,736,530 A 4/1988 Lakic et al.
4,736,587 A 4/1988 Suzuki
4,745,301 A 5/1988 Michalchik
4,745,930 A 5/1988 Confer
4,747,219 A 5/1988 Ammendolea
4,756,096 A 7/1988 Meyer
4,757,620 A 7/1988 Titola
4,763,426 A 8/1988 Polus et al.
4,766,681 A 8/1988 O'Rourke et al.
4,771,394 A 9/1988 Cavanagh
4,772,131 A 9/1988 Varela et al.
4,774,774 A 10/1988 Allen
4,776,110 A 10/1988 Shiang
4,782,602 A 11/1988 Lakic
4,797,962 A 1/1989 Goode
4,798,009 A 1/1989 Colonel et al.
4,800,867 A 1/1989 Owens
4,813,160 A 3/1989 Kuznetz
4,814,661 A 3/1989 Ratzlaff et al.
4,817,304 A 4/1989 Parker et al.
4,817,305 A 4/1989 Wetzel
4,823,482 A 4/1989 Lakic
4,827,763 A 5/1989 Bourland et al.
4,833,614 A 5/1989 Saitoh et al.
4,836,342 A 6/1989 Wolfe
4,838,392 A 6/1989 Miller et al.
4,844,072 A 7/1989 French et al.
4,845,863 A 7/1989 Yung-Mao
4,852,443 A 8/1989 Duncan et al.
4,858,621 A 8/1989 Franks
4,860,463 A 8/1989 Pin
4,862,743 A 9/1989 Seitz
4,864,824 A 9/1989 Gabriel et al.
4,881,172 A 11/1989 Miller
4,887,699 A 12/1989 Ivers et al.
4,888,887 A 12/1989 Solow
4,894,932 A 1/1990 Harada et al.
4,896,754 A 1/1990 Carlson et al.
4,898,264 A 2/1990 Miller
4,906,502 A 3/1990 Rudy
4,907,680 A 3/1990 Wolfe et al.
4,910,884 A 3/1990 Lindh et al.
4,918,838 A 4/1990 Chang
D307,608 S 5/1990 Shure
4,921,272 A 5/1990 Ivers
4,923,057 A 5/1990 Carlson et al.
4,925,470 A 5/1990 Chou
4,932,210 A 6/1990 Julien et al.
4,934,072 A 6/1990 Fredericksen et al.
4,936,030 A 6/1990 Rennex
4,936,425 A 6/1990 Boone et al.
4,938,742 A 7/1990 Smits
4,944,554 A 7/1990 Gross et al.
4,949,412 A 8/1990 Goode
4,949,573 A 8/1990 Wolfe et al.
4,953,089 A 8/1990 Wolfe
4,953,309 A 9/1990 Kaiser
4,956,628 A 9/1990 Furlong
4,956,927 A 9/1990 Misevich et al.
4,958,501 A 9/1990 Nakano et al.
4,965,545 A 10/1990 Johnson
4,971,716 A 11/1990 Batt et al.
4,974,342 A 12/1990 Nakamura
4,989,350 A 2/1991 Bunch et al.
4,991,317 A 2/1991 Lakic
4,993,523 A 2/1991 Schwemmer et al.
4,994,202 A 2/1991 Merchant
4,995,173 A 2/1991 Spier
4,996,511 A 2/1991 Ohkawa et al.
4,998,415 A 3/1991 Larsen
4,999,932 A 3/1991 Grim
5,004,079 A 4/1991 Ivers et al.
5,007,248 A 4/1991 Maier et al.
5,007,513 A 4/1991 Carlson
5,010,772 A 4/1991 Bourland et al.
5,014,449 A 5/1991 Richard et al.
5,018,786 A 5/1991 Goldstein et al.
5,022,385 A 6/1991 Harza
5,025,573 A 6/1991 Giese et al.
5,025,575 A 6/1991 Lakic
5,029,823 A 7/1991 Hodgson et al.
5,032,307 A 7/1991 Carlson
5,033,291 A 7/1991 Podoloff et al.
5,042,504 A 8/1991 Huberti
5,046,267 A 9/1991 Kilgore et al.
5,052,130 A 10/1991 Barry et al.
5,054,522 A 10/1991 Kowanz et al.
5,060,174 A 10/1991 Gross
5,060,401 A 10/1991 Whatley
5,061,914 A 10/1991 Busch et al.
5,062,222 A 11/1991 Billet et al.
5,068,981 A 12/1991 Jung
5,069,419 A 12/1991 Jerman
5,074,765 A 12/1991 Pekar
5,075,983 A 12/1991 Mabboux et al.
5,079,949 A 1/1992 Tamori
5,082,242 A 1/1992 Bonne et al.
5,083,361 A 1/1992 Rudy
5,086,573 A 2/1992 Mabboux et al.
5,086,574 A 2/1992 Bacchiocchi
5,090,138 A 2/1992 Borden
5,091,104 A 2/1992 Van Der Puy
5,092,901 A 3/1992 Hunter et al.
5,107,854 A 4/1992 Knotts et al.
5,113,599 A 5/1992 Cohen et al.
5,125,171 A 6/1992 Stewart
5,127,228 A 7/1992 Swenson
5,129,704 A 7/1992 Kishi et al.
5,129,997 A 7/1992 Schottle et al.
5,142,781 A 9/1992 Mettner et al.
5,146,988 A 9/1992 Paul
5,161,774 A 11/1992 Engelsdorf et al.
5,167,082 A 12/1992 Chen
5,167,227 A 12/1992 Meserlian
5,170,364 A 12/1992 Gross et al.
5,170,783 A 12/1992 Smith
5,172,551 A 12/1992 Nakajima et al.
5,172,689 A 12/1992 Wright
5,174,424 A 12/1992 Eriksson
5,178,190 A 1/1993 Mettner
5,179,792 A * 1/1993 Brantingham ..... 36/29
5,180,623 A 1/1993 Ohnstein
5,181,555 A 1/1993 Chruniak
5,182,910 A 2/1993 Benecke
5,189,890 A 3/1993 Kitayama
5,197,206 A 3/1993 Shorten
5,197,207 A 3/1993 Shorten
5,199,191 A 4/1993 Moumdjian
5,201,125 A 4/1993 Shorten
5,201,183 A 4/1993 Ramos
5,201,193 A 4/1993 Sundhar et al.
5,203,833 A 4/1993 Howell
5,207,774 A 5/1993 Wolfe et al.

5,211,371 A 5/1993 Coffee
5,214,929 A 6/1993 Goble
5,214,933 A 6/1993 Aitchison et al.
5,216,273 A 6/1993 Doering et al.
5,222,312 A 6/1993 Doyle
5,224,277 A 7/1993 Sang Do
5,224,278 A 7/1993 Jeon
5,226,619 A 7/1993 Alger
5,230,249 A 7/1993 Sasaki et al.
5,230,335 A 7/1993 Johnson et al.
5,235,761 A 8/1993 Chang
5,237,838 A 8/1993 Merritt-Munson
5,238,223 A 8/1993 Mettner et al.
5,240,308 A 8/1993 Goldstein et al.
5,244,537 A 9/1993 Ohnstein
5,245,766 A 9/1993 Warren
5,247,742 A 9/1993 Kilgore et al.
5,247,798 A 9/1993 Collard
5,253,654 A 10/1993 Thomas et al.
5,253,656 A 10/1993 Rincoe et al.
D341,478 S 11/1993 Forland et al.
5,257,470 A 11/1993 Auger et al.
5,269,081 A 12/1993 Gray
5,271,431 A 12/1993 Mettner et al.
5,276,622 A 1/1994 Miller et al.
5,276,623 A 1/1994 Wolfe
5,277,281 A 1/1994 Carlson et al.
5,279,051 A 1/1994 Whatley
D344,174 S 2/1994 Kilgore
D344,398 S 2/1994 Kilgore
D344,399 S 2/1994 Kilgore
D344,400 S 2/1994 Kilgore
D344,401 S 2/1994 Kilgore
5,282,325 A 2/1994 Beyl
5,283,735 A 2/1994 Gross et al.
5,284,330 A 2/1994 Carlson et al.
5,287,707 A 2/1994 Kitayama
D344,622 S 3/1994 Kilgore
5,294,360 A 3/1994 Carlson et al.
5,295,313 A 3/1994 Lee
5,296,837 A 3/1994 Yaniger
5,302,936 A 4/1994 Yaniger
5,303,397 A 4/1994 Aoki
5,306,438 A 4/1994 Carlson et al.
5,309,717 A 5/1994 Minch
5,310,111 A 5/1994 Linck
5,313,717 A 5/1994 Allen et al.
5,313,809 A 5/1994 Isaacson et al.
5,314,455 A 5/1994 Johnson et al.
5,315,769 A 5/1994 Barry et al.
5,323,650 A 6/1994 Fullen et al.
5,323,999 A 6/1994 Bonne et al.
5,324,318 A 6/1994 Smith
5,325,614 A 7/1994 Rosen
5,325,680 A 7/1994 Baroso-Lujan et al.
5,325,880 A 7/1994 Johnson et al.
D350,018 S 8/1994 Kilgore
D350,019 S 8/1994 Kilgore
D350,020 S 8/1994 Kilgore
5,333,831 A 8/1994 Barth et al.
5,335,498 A 8/1994 Komatsu et al.
5,337,579 A 8/1994 Saia et al.
5,341,581 A 8/1994 Huang
D350,225 S 9/1994 Kilgore
D350,226 S 9/1994 Kilgore
D350,227 S 9/1994 Kilgore
D350,433 S 9/1994 Kilgore
5,343,636 A 9/1994 Sabol
5,343,638 A 9/1994 Legassie et al.
5,343,639 A 9/1994 Kilgore et al.
5,344,117 A 9/1994 Trah et al.
5,345,968 A 9/1994 Day
D351,057 S 10/1994 Kilgore
D351,720 S 10/1994 Kilgore
5,353,523 A 10/1994 Kilgore et al.
5,353,525 A 10/1994 Grim
5,353,600 A 10/1994 Merritt et al.
5,357,696 A 10/1994 Gray et al.
D351,936 S 11/1994 Kilgore
D352,159 S 11/1994 Kilgore
D352,160 S 11/1994 Kilgore
5,361,133 A 11/1994 Brown et al.
5,362,213 A 11/1994 Komatsu et al.
5,367,788 A 11/1994 Chen
5,375,430 A 12/1994 Siegel
D354,617 S 1/1995 Kilgore
5,381,608 A 1/1995 Claveria
5,382,373 A 1/1995 Carlson et al.
5,384,977 A 1/1995 Chee
D355,755 S 2/1995 Kilgore
5,390,121 A 2/1995 Wolfe
5,396,973 A 3/1995 Schwemmer et al.
5,398,917 A 3/1995 Carlson et al.
5,400,526 A 3/1995 Sessa
5,400,824 A 3/1995 Gschwendtner et al.
5,406,719 A * 4/1995 Potter ..... 36/28
5,408,760 A 4/1995 Tse et al.
5,408,873 A 4/1995 Schmidt et al.
5,410,290 A 4/1995 Cho
5,416,988 A 5/1995 Potter et al.
5,417,235 A 5/1995 Wise et al.
5,417,874 A 5/1995 Carlson et al.
5,419,060 A 5/1995 Choi
5,419,061 A 5/1995 Barrocas
5,429,713 A 7/1995 Stevenson et al.
5,430,961 A 7/1995 Faulconer et al.
5,435,079 A 7/1995 Gallegos
5,437,289 A 8/1995 Liverance et al.
5,441,597 A 8/1995 Bonne et al.
5,445,185 A 8/1995 Watanabe et al.
5,449,002 A 9/1995 Goldman
5,449,379 A 9/1995 Hadtke
5,456,027 A 10/1995 Tecchio et al.
5,460,012 A 10/1995 Kwok
5,461,800 A 10/1995 Luthi et al.
5,469,639 A 11/1995 Sessa
5,471,405 A 11/1995 Marsh
5,471,768 A 12/1995 Pryor
D365,999 S 1/1996 Seitz
5,480,287 A 1/1996 Pozzebon et al.
5,488,786 A 2/1996 Ratay
5,492,312 A 2/1996 Carlson
5,494,601 A 2/1996 Flynn et al.
5,497,625 A 3/1996 Manz et al.
5,500,635 A 3/1996 Mott
5,502,901 A 4/1996 Brown
5,505,010 A 4/1996 Fukuoka
5,511,561 A 4/1996 Wanderman et al.
5,515,622 A 5/1996 Lee
5,537,762 A 7/1996 Walters
5,541,570 A 7/1996 McDowell
5,544,276 A 8/1996 Loux et al.
5,547,049 A 8/1996 Weiss et al.
5,558,398 A 9/1996 Santos
5,564,202 A 10/1996 Hoppenstein
5,566,479 A 10/1996 Gray et al.
5,566,703 A 10/1996 Watanabe et al.
5,572,804 A 11/1996 Skaja et al.
5,575,088 A 11/1996 Allen et al.
5,578,238 A 11/1996 Weiss et al.
5,586,067 A 12/1996 Gross et al.
5,586,557 A 12/1996 Nelson et al.
5,587,933 A 12/1996 Gross
5,588,227 A 12/1996 Goldston et al.
5,593,134 A 1/1997 Steber et al.
5,598,645 A 2/1997 Kaiser 5,599,474 A 2/1997 Weiss et al.
5,608,599 A 3/1997 Goldman
5,617,651 A 4/1997 Prahl
5,619,177 A 4/1997 Johnson et al.
5,619,186 A 4/1997 Schmidt et al.
5,621,984 A 4/1997 Hsieh
5,640,995 A 6/1997 Packard et al.
5,642,096 A 6/1997 Leyerer et al.
5,645,752 A 7/1997 Weiss et al.
5,647,574 A 7/1997 Mettner et al.
5,649,373 A 7/1997 Winter et al.
5,652,704 A 7/1997 Catanzarite
5,655,314 A 8/1997 Petracci
5,655,316 A 8/1997 Huang
5,658,050 A 8/1997 Lorbiecki
5,658,324 A 8/1997 Bailey et al.
5,659,171 A 8/1997 Young et al.
5,659,395 A 8/1997 Brown et al.
5,662,123 A 9/1997 Goldman
5,670,077 A 9/1997 Carlson et al.
5,671,905 A 9/1997 Hopkins
5,673,498 A * 10/1997 Amir et al. ..... 36/29
5,673,500 A 10/1997 Huang
5,678,327 A 10/1997 Halberstadt
5,678,448 A 10/1997 Fullen et al.
5,681,024 A 10/1997 Lisec et al.
5,682,690 A 11/1997 Chang
5,683,615 A 11/1997 Munoz
5,687,099 A 11/1997 Gross et al.
5,693,004 A 12/1997 Carlson et al.
5,697,170 A 12/1997 Murrell et al.
5,697,171 A 12/1997 Phillips
5,701,685 A 12/1997 Pezza
5,701,686 A 12/1997 Herr et al.
5,701,687 A 12/1997 Schmidt et al.
5,704,137 A 1/1998 Dean et al.
5,711,746 A 1/1998 Carlson
5,712,783 A 1/1998 Catanzarite
5,713,631 A 2/1998 O'Neill et al.
5,720,200 A 2/1998 Anderson et al.
5,722,185 A 3/1998 Vigneron
5,745,937 A 5/1998 Weismiller et al.
5,752,329 A 5/1998 Horibata
5,756,298 A 5/1998 Burczak et al.
5,767,877 A 6/1998 Mei et al.
5,767,878 A 6/1998 Murphy
5,771,606 A 6/1998 Litchfield et al.
5,775,332 A 7/1998 Goldman
5,782,014 A 7/1998 Peterson
5,787,610 A 8/1998 Brooks
5,791,637 A 8/1998 Reichelt et al.
D397,543 S 9/1998 Silvers
5,813,142 A * 9/1998 Demon ..... 36/29
5,813,412 A 9/1998 Okumoto
5,816,372 A 10/1998 Carlson et al.
5,842,547 A 12/1998 Carlson et al.
5,845,419 A 12/1998 Begg
5,853,844 A 12/1998 Wen
5,878,851 A 3/1999 Carlson et al.
5,894,686 A 4/1999 Parker et al.
5,900,184 A 5/1999 Weiss et al.
5,906,767 A 5/1999 Karol et al.
5,918,384 A 7/1999 Meschan
5,918,502 A 7/1999 Bishop
5,947,238 A 9/1999 Jolly et al.
5,964,455 A 10/1999 Catanzarite et al.
5,976,451 A 11/1999 Skaja et al.
5,993,358 A 11/1999 Gureghian et al.
6,006,449 A 12/1999 Orlowski et al.
6,027,633 A 2/2000 Whitmore
6,027,664 A 2/2000 Weiss et al.
6,029,962 A 2/2000 Shorten et al.
6,061,929 A 5/2000 Ritter
6,070,681 A 6/2000 Catanzarite et al.
D429,877 S 8/2000 Lozano et al.
6,095,486 A 8/2000 Ivers et al.
6,098,313 A 8/2000 Skaja
6,108,943 A 8/2000 Hudson et al.
6,115,943 A 9/2000 Gyr
6,117,093 A 9/2000 Carlson
D431,898 S 10/2000 Clegg et al.
D432,293 S 10/2000 Clegg et al.
6,131,709 A 10/2000 Jolly et al.
6,132,633 A 10/2000 Carlson
D433,216 S 11/2000 Avar et al.
6,151,930 A 11/2000 Carlson
D434,548 S 12/2000 Gallegos
6,158,470 A 12/2000 Ivers et al.
6,158,910 A 12/2000 Jolly et al.
6,186,290 B1 2/2001 Carlson
6,202,806 B1 3/2001 Sandrin et al.
6,203,717 B1 3/2001 Munoz et al.
6,234,060 B1 5/2001 Jolly
6,283,859 B1 9/2001 Carlson et al.
6,296,088 B1 10/2001 Carlson
6,302,249 B1 10/2001 Jolly et al.
6,308,813 B1 10/2001 Carlson
6,311,110 B1 10/2001 Ivers et al.
6,339,419 B1 1/2002 Jolly et al.
6,340,080 B1 1/2002 Carlson
6,373,465 B2 4/2002 Jolly et al.
6,378,671 B1 4/2002 Carlson
6,382,604 B2 5/2002 St. Clair
6,394,239 B1 5/2002 Carlson
6,395,193 B1 5/2002 Kintz et al.
6,427,813 B1 8/2002 Carlson
6,457,261 B1 10/2002 Crary
6,475,404 B1 11/2002 Carlson
D473,950 S 4/2003 Carlson
6,547,986 B1 4/2003 Kintz et al.
6,611,185 B2 8/2003 Carlson et al.
6,695,105 B2 2/2004 Toiyama

* cited by examiner

ADAPTIVELY CONTROLLED FOOTWEAR

CONTINUING DATA

This application is a continuation-in-part of U.S. patent application Ser. No. 09/853,097, filed May 10, 2001 now U.S. Pat. No. 6,865,825, which is a continuation of U.S. patent application Ser. No. 09/303,585, filed May 3, 1999, now U.S. Pat. No. 6,230,501, issued May 15, 2001, all of which are expressly incorporated herein in their entirety. This application is related to, but does not claim priority from, U.S. patent application Ser. No. 08/911,261, filed Aug. 14, 1997, U.S. patent application Ser. No. 08/349,509, filed Dec. 2, 1994, U.S. patent application Ser. No. 08/227,634, filed Apr. 14, 1994, now U.S. Pat. No. 5,658,324, issued Aug. 19, 1997, all of which are expressly incorporated herein in their entirety.

FIELD OF THE INVENTION

The present invention relates to the field of adaptively controlled footwear, and more particularly to athletic performance-enhancing technologies for integration within footwear that adaptively adjust or control the characteristics of the footwear.

BACKGROUND OF THE INVENTION

Athletic or performance footwear is typically designed for low weight, comfort and functionality. Fashion and style may also be significant considerations. Embedding significant control systems within footwear must therefore justify the cost, complexity, weight and size, especially in view of the adequate functioning of existing available footwear designs.

Bladder Fit Control

In various types of athletic footwear, it is recognized that the comfort and fit of the footwear can affect the athletic performance. In order to increase both the comfort and fit of footwear, manufacturers have incorporated inflatable bladders of various designs into the construction of the footwear.

The demands for comfort and snugness of fit in other athletic events has resulted in the use of the inflatable bladders in various types of athletic footwear, including athletic shoes used for basketball and other sports. There are presently available athletic shoes incorporating an air pump, such as depicted within U.S. Pat. No. 5,074,765, to inflate air bladders located within the sole of the shoe, or alternatively, bladders located in portions of the upper or the tongue of the athletic shoe. The advantages of these types of shoes is manifested primarily by their increased comfort and the secure positioning or fit of the foot within the shoe. Another benefit derived from the use of air bladders is the potential for reduction of forces transmitted through the shoe to the foot and ankle of the wearer during performance of the athletic endeavor. Thus, current athletic shoes having incorporated air bladders provide enhanced comfort and fit, while also reducing the occurrence of various types of injuries.

Air bladder fit control systems for footwear are therefore well known and accepted. These systems generally have good performance, are low mass and size, acceptable cost and a simple user interface. See, U.S. Pat. Nos. 5,756,298; 5,480,287; 5,430,961; 5,416,988; 5,343,638; 5,257,470; 5,230,249; 5,146,988; 5,113,599; 4,999,932; 4,995,173; 4,823,482; 4,730,403; 4,662,087; 4,502,470; and 4,374,518, each of which is expressly incorporated herein by reference, showing designs and construction methods for adjustable footwear upper and methods and means for adjustment thereof.

For typical athletic shoes currently commercially available which incorporate both the inflatable air bladders and inflation pump, the comfort and fit of the article of footwear is adjusted by inflating the air bladder by use of the pump after securing the footwear about the foot. The wearer simply inflates the air bladder until a particular pressure level, or fit, is felt by the foot. However, due to the rigors of various athletic events, and because the human foot tends to swell and contract with varying levels of activity, it is very difficult for the individual to obtain a consistent fit from one use to the next, or to recognize the difference in their performance, based upon a pressure setting for the air bladders that is merely sensed by the foot. Therefore, designs have been proposed which include a pressure sensor, for example, see U.S. Pat. No. 5,588,227, expressly incorporated herein by reference.

The development, incorporation, and use of inflatable air bladders within athletic footwear has been applied to ski boots used for downhill skiing. Thus, a number of patents relate to the field of ski boots which incorporate inflatable air bladders, for example, German Patent No. DE 2,162,619, and U.S. Pat. No. 4,662,087. While the original designs for ski boots having air bladders incorporated the use of an external pressurizing device such as a hand pump, more recent designs incorporate the design of the pump into the article of footwear, such as for example the ski boot of U.S. Pat. No. 4,702,022. Various footwear designs also provide a compressor which is actuated by user activity, providing a supply of compressed air while the footwear is in vigorous use.

Shoe Sensors

It is well known to provide instrumentation to monitor various aspects of footwear, both internally and externally. This instrumentation includes, for example, sensors for determining time-pressure profiles around the foot.

The advantages and general design of intelligent adaptive surfaces are well known, as are various methods for implementation in particular articles, such as seating surfaces, mattresses, and the like. It is also known to provide various controls for modifying footwear during use. For example, Gross et al., U.S. Pat. No. 5,687,099, Gross et al. U.S. Pat. No. 5,586,067, and Gross U.S. Pat. No. 5,587,933, each of which is expressly incorporated herein by reference, proposes footwear systems which seek adaptive fit. That is, as the wearer moves, the footwear senses the pressure distribution profile of the user's foot within the footwear, and adjusts a set of bladders to achieve a desired state.

The theory of intelligent adaptive surfaces provides that too high a pressure applied to an area of skin may cause discomfort or produce medical problems. By adjusting the pressure applied to an area of skin, a more ergonomic support is provided. See, U.S. Pat. Nos. 5,745,937; 5,713,631; 5,658,050; 5,558,398; 5,129,704; 4,949,412; 4,833,614; 4,467,252; 4,542,547; 3,879,776, expressly incorporated herein by reference. Using a first approximation, the goal of an intelligent support surface is to equalize the pressure applied to the skin along the entirety of the contact area, and to increase the contact area. See, U.S. Pat. No. 4,797,962, incorporated herein by reference. Using sensors, the pressure applied to the skin is measured. Actuators, provided under the surface, deform the surface to adjust the applied pressure and potentially increase the contact patch. See, U.S. Pat. Nos. 5,687,099; 5,587,933; 5,586,557; 5,586, 067; 5,283,735, 5,240,308; 5,170,364; 5,060,174; 5,018,786; and 4,944,554, expressly incorporated herein by reference. See also U.S. Pat. Nos. 5,174,424; 5,022,385; A more sophisticated system models the anatomical portion being supported and provides a force distribution map, thereby selectively applying forces over the contact surface. Thus, more sensitive areas are subject to less pressure than less sensitive areas. An even more sophisticated algorithm takes into consideration the time of pressure application, and will adjust the contact force dynamically to, for example, promote circulation.

Foot and shoe sensor arrangements are disclosed in U.S. Pat. Nos. D365,999; 5,775,332; 5,720,200; 5,678,448; 5,673,500; 5,662,123; 5,659,395; 5,655,316; 5,642,096; 5,619,186; 5,608,599; 5,566,479; 5,541,570; 5,511,561; 5,500,635; 5,471,405; 5,456,027; 5,449,002; 5,437,289; 5,408,873; 5,361,133; 5,357,696; 5,323,650; 5,302,936; 5,296,837; 5,269,081; 5,253,656; 5,253,654; 5,107,854; 5,079,949; 5,042,504; 5,033,291; 5,010,772; 4,996,511; 4,956,628; 4,862,743; 4,858,621; 4,852,443; 4,827,763; 4,814,661; 4,771,394; 4,745,930; 4,745,301; 4,703,445; 4,651,446; 4,649,918; 4,649,552; 4,644,801; 4,604,807; 4,578,769; 4,554,930; 4,503,705; 4,489,302; 4,437,138; 4,426,884; 4,152,304; 4,054,540; 3,974,491; and 3,791,375, all of which are expressly incorporated herein by reference, which may be suitable in various embodiments of the invention, and also disclose various electronic interfaces which may also be applicable to the present invention.

Demon, U.S. Pat. No. 5,813,412, expressly incorporated herein by reference, proposes a system which seeks to modify the transient pressure peak within the sole by selectively bleeding a gas or liquid chamber within the sole, based on a pressure sensor, to limit peak forces and control cushioning.

Footwear Cushioning

Crary, U.S. Pat. No. 6,457,261, expressly incorporated herein by reference, discloses an energy absorption system for a footwear heel in which only a portion of the absorbed energy is recovered. See also U.S. Patent references cited therein, each of which is also expressly incorporated by reference: U.S. Pat. No. 4,136,93, October, 1889, Walker; 507,490, October, 1893, Gambino; 968,020, August, 1910, Yandoli; U.S. Pat. No. 2,234,066, March, 1941, Winkel et al; U.S. Pat. No. 2,387,334, October, 1945, Lemke; U.S. Pat. No. 2,399,543, April, 1946, Dack; U.S. Pat. No. 2,414,445, January, 1947, Cahill; U.S. Pat. No. 2,441,039, May, 1948, Smith et al; U.S. Pat. No. 2,454,951, November, 1948, Smith; U.S. Pat. No. 2,669,038, February, 1954, DeWerth; U.S. Pat. No. 2,710,460, June, 1955, Stasinos; U.S. Pat. No. 2,985,971, May, 1961, Murawski; U.S. Pat. No. 2,998,661, September, 1961, Israel; U.S. Pat. No. 3,822,490, July, 1974, Murawski; U.S. Pat. No. 3,875,688, April, 1975, McNaughton; U.S. Pat. No. 3,886,674, June, 1975, Pavia; U.S. Pat. No. 3,996,677, December, 1976, Reina; U.S. Pat. No. 4,130,951, December, 1978, Powell; U.S. Pat. No. 4,183,156, January, 1980, Rudy; U.S. Pat. No. 4,187,620, February, 1980, Selner; U.S. Pat. No. 4,219,945, September, 1980, Rudy; U.S. Pat. No. 4,223,457, September, 1980, Borgeas; U.S. Pat. No. 4,237,625, December, 1980, Cole et al; U.S. Pat. No. 4,262,433, April, 1981, Hagg et al; U.S. Pat. No. 4,267,648, May, 1981, Weisz; D260,196, August, 1981, Plagenhoef; U.S. Pat. No. 4,296,557, October, 1981, Pajevic; U.S. Pat. No. 4,302,891, December, 1981, Gulli; U.S. Pat. No. 4,314,413, February, 1982, Dassler; U.S. Pat. No. 4,322,892, April, 1982, Inohara; U.S. Pat. No. 4,322,893, April, 1982, Halvorsen; U.S. Pat. No. 4,342,158, August, 1982, McMahon et al; U.S. Pat. No. 4,354,318, October, 1982, Frederick et al; U.S. Pat. No. 4,360,978, November, 1982, Simpkins; U.S. Pat. No. 4,364,188, December, 1982, Turner et al; U.S. Pat. No. 4,391,048, July, 1983, Lutz; U.S. Pat. No. 4,402,146, September, 1983, Parracho et al; U.S. Pat. No. 4,416,072, November, 1983, Sarkissian; U.S. Pat. No. 4,417,408, November, 1983, Metro; U.S. Pat. No. 4,457,084, July, 1984, Horibata et al; U.S. Pat. No. 4,484,397, November, 1984, Curley, Jr; U.S. Pat. No. 4,490,928, January, 1985, Kawashima; U.S. Pat. No. 4,492,046, January, 1985, Kosova; U.S. Pat. No. 4,506,460, March, 1985, Rudy; U.S. Pat. No. 4,521,979, June, 1985, Blaser; U.S. Pat. No. 4,534,124, August, 1985, Schnell; U.S. Pat. No. 4,535,553, August, 1985, Derderian et al; U.S. Pat. No. 4,566,206, January, 1986, Weber; U.S. Pat. No. 4,573,279, March, 1986, Feurer-Zogel et al; U.S. Pat. No. 4,592,153, June, 1986, Jacinto; U.S. Pat. No. 4,614,046, September, 1986, Dassler; U.S. Pat. No. 4,616,431, October, 1986, Dassler; U.S. Pat. No. 4,660,299, April, 1987, Omilusik; U.S. Pat. No. 4,670,996, June, 1987, Dill; 4,747,219, May, 1988, Ammendolea; U.S. Pat. No. 4,757,620, July, 1988, Titola; U.S. Pat. No. 4,766,681, August, 1988, O'Rourke et al; U.S. Pat. No. 4,774,774, October, 1988, Allen, Jr; U.S. Pat. No. 4,798,009, January, 1989, Colonel et al; U.S. Pat. No. 4,817,304, April, 1989, Parker et al; U.S. Pat. No. 4,817,305, April, 1989, Wetzel; U.S. Pat. No. 4,906,502, March, 1990, Rudy; U.S. Pat. No. 4,910,884, March, 1990, Lindh et al; U.S. Pat. No. 4,918,838, April, 1990, Chang; D307,608, May, 1990, Shure; U.S. Pat. No. 4,956,927, September, 1990, Misevich et al; U.S. Pat. No. 4,989,350, February, 1991, Bunch et al; U.S. Pat. No. 5,014,449, May, 1991, Richard et al; U.S. Pat. No. 5,025,573, June, 1991, Giese et al; U.S. Pat. No. 5,046,267, September, 1991, Kilgore et al; U.S. Pat. No. 5,052,130, October, 1991, Barry et al; U.S. Pat. No. 5,060,401, October, 1991, Whatley; U.S. Pat. No. 5,083,361, January, 1992, Rudy; U.S. Pat. No. 5,090,138, February, 1992, Borden; U.S. Pat. No. 5,125,171, June, 1992, Stewart; U.S. Pat. No. 5,197,206, March, 1993, Shorten; U.S. Pat. No. 5,197,207, March, 1993, Shorten; U.S. Pat. No. 5,201,125, April, 1993, Shorten; U.S. Pat. No. 5,235,761, August, 1993, Chang; U.S. Pat. No. 5,245,766, September, 1993, Warren; U.S. Pat. No. 5,247,742, September, 1993, Kilgore et al; D341,478, November, 1993, Forland et al; U.S. Pat. No. 5,279,051, January, 1994, Whatley; D344,174, February, 1994, Kilgore; D344,398, February, 1994, Kilgore; D344,399, February, 1994, Kilgore; D344,400, February, 1994, Kilgore; D344,401, February, 1994, Kilgore; U.S. Pat. No. 5,282,325, February, 1994, Beyl; D344,622, March, 1994, Kilgore; U.S. Pat. No. 5,315,769, May, 1994, Barry et al; D350,018, August, 1994, Kilgore; D350,019, August, 1994, Kilgore; D350,020, August, 1994, Kilgore; D350,225, September, 1994, Kilgore; D350,226, September, 1994, Kilgore; D350,227, September, 1994, Kilgore; D350,433, September, 1994, Kilgore; U.S. Pat. No. 5,343,636, September, 1994, Sabol; U.S. Pat. No. 5,343,639, September, 1994, Kilgore et al; D351,057, October, 1994, Kilgore; D351,720, October, 1994, Kilgore; U.S. Pat. No. 5,353,523, October, 1994, Kilgore et al; D351,936, November, 1994, Kilgore; D352,159, November, 1994, Kilgore; D352,160, November, 1994, Kilgore; D354,617, January, 1995, Kilgore; U.S. Pat. No. 5,381,608, January, 1995, Clayeria; D355,755, February, 1995, Kilgore; U.S. Pat. No. 5,419,060, May, 1995, Choi; U.S. Pat. No. 5,419,061, May, 1995, Barrocas; U.S. Pat. No. 5,435,079, July, 1995, Gallegos; U.S. Pat. No. 5,461,800, October, 1995, Luthi et al; U.S. Pat. No. 5,469,639, November, 1995, Sessa; U.S. Pat. No. 5,488,786, February, 1996, Ratay; U.S. Pat. No. 5,502,901, April, 1996, Brown; U.S. Pat. No. 5,564,202, October, 1996, Hoppenstein; U.S. Pat. No. 5,572,804, November, 1996, Skaja et al; U.S. Pat. No. 5,617,651, April, 1997, Prahl; U.S. Pat. No. 5,621,984, April, 1997, Hsieh; U.S. Pat. No. 5,649,373, July, 1997, Winter et al; U.S. Pat. No. 5,678,327, October, 1997, Halberstadt; U.S. Pat. No. 5,682,690, November, 1997, Chang; U.S. Pat. No. 5,701,685, December, 1997, Pezza; U.S. Pat. No. 5,701,686, December, 1997, Herr et al; U.S. Pat. No. 5,752,329, May, 1998, Horibata; U.S. Pat. No. 5,782,014, July, 1998, Peterson; U.S. Pat. No. 5,787,610, August, 1998, Brooks; U.S. Pat. No. 5,791,637, August, 1998, Reichelt et al; D397,543, September, 1998, Silvers; U.S. Pat. No. 5,845,419, December, 1998, Begg; U.S. Pat. No. 5,853,844, December, 1998, Wen; U.S. Pat. No. 5,894,686, April, 1999, Parker et al; U.S. Pat. No. 5,918,384, July, 1999, Meschan; U.S. Pat. No. 5,918,502, July, 1999, Bishop; U.S. Pat. No. 5,976,451, November, 1999, Skaja et al; U.S. Pat. No. 6,006,449, December, 1999, Orlowski et al; U.S. Pat. No. 6,029,962, February, 2000, Shorten et al; U.S. Pat. No. 6,061,929, May, 2000, Ritter; D429,877, August, 2000, Lozano et al; U.S. Pat. No. 6,098,313, August, 2000, Skaja; U.S. Pat. No. 6,108,943, August, 2000, Hudson et al; U.S. Pat. No. 6,115,943, September, 2000, Gyr; D431,898, October, 2000, Clegg et al; D432,293, October, 2000, Clegg et al; D433,216, November, 2000, Avar et al; and D434,548, December, 2000, Gallegos.

A number of technologies are known for improving the function and comfort of footwear soles. These include adjustments for size and foot shape, as well as cushioning, energy recovery, pumps and compressors for providing a source of compressed air, and improved stability. See, U.S. Pat. Nos. 5,771,606; 5,704,137; 5,701,687; 5,598,645; 5,575,088; 5,537,762; 5,384,977; 5,353,525; 5,325,614; 5,313,717; 5,224,278; 5,224,277; 5,222,312; 5,199,191; 5,179,792; 5,086,574; 5,046,267; 5,025,575; 4,999,932; 4,991,317; 4,936,030; 4,934,072; 4,894,932; 4,888,887; 4,845,863; 4,772,131; 4,763,426; 4,756,096; 4,670,995; 4,610,099; 4,458,430; 4,446,634; 4,414,760; 4,319,412; 4,305,212; 4,229,889; 4,187,620; 4,129,951, 4,016,662; 4,008,530; and 3,758,964, expressly incorporated herein by reference.

Footwear Cooling and Cryotherapy

A number of known footwear designs seek to generate a flow of air through the footwear to promote evaporation of perspiration and cool the foot. See, U.S. Pat. Nos. 5,697,171; 5,697,170; 5,655,314; 5,515,622; 5,505,010; 5,408,760; 5,400,526; 5,341,581; 5,303,397; 5,295,313; 5,068,981; 4,974,342; 4,888,887; 4,860,463; 4,813,160; 4,776,110; 4,679,335; 4,602,441; 4,499,672; 4,438,573; 4,373,275; 4,364,186; 4,078,321; and 3,973,336, expressly incorporated herein by reference, for their disclosure of designs and methods for cooling footwear, the implementation of locomotion actuated air compressors, and integration within footwear designs.

Cryotherapy and personal cooling systems are also known, which facilitate comfort under normal conditions, and promote healing and reduce inflammation accompanying injury. For example, the therapeutic use of a combination of cryotherapy to about 4 degrees C. and controlled external pressure of about 0.4–0.8 psi has been used to speed healing after physical injuries, especially of the extremities.

Heat transfer systems are desirable under many circumstances. Heating is generally easily accomplished, by dissipating power. Cooling, however, generally requires coupling an endothermic mechanism with an exothermic mechanism of equal or greater magnitude, although in a different environment, to create a heat pump. Thus, heat may be transferred without violating the laws of thermodynamics. Many different types of cooling systems are known. However, efficient active miniature (<300 W thermal transfer capacity) cooling systems pose many design compromises, and few optimal designs are available. For subminiature designs (<10 W thermal transfer capacity), Peltier designs are typically used. However, such systems require a significant electrical current.

Cooling is generally provided in a number of ways. First, heat in an object to be cooled may be lost by transferring heat energy from a hotter mass to a cooler mass, which may be an active, facilitated or conduction process. Second, an artificial gradient may be created to allow heat to be moved effectively from a hotter to a colder mass. This process includes, e.g., compressing a gas to increase its temperature, then shedding the heat resulting from the compression to the environment, followed by decompressing the cooled gas in a different location to a net colder state than prior to compression. Various phase change, e.g., vaporization, solidification, adsorption, dissolution, etc., and irreversible processes may also be used to provide cooling. Thermoelectric junctions may also be used to cool, although their power efficiency is relatively low.

"Cryotherapy" is defined as the treatment of injury using the benefits derived by application of cold, optionally with external applied pressure. Such therapy has been shown to be particularly effective in treating musculoskeletal trauma resulting from an injury or by the application of a wrenching force to the body, e.g., lacerations, sprains, strains, fractures, contusions or fractures. This type of injury may be accompanied by a tearing of tendons, ligaments or other tissue, and triggers the body's own natural healing process. See Sloan et al., "Effects of Cold and Compression on Edema", The Physician and Sports Medicine, 16(8) (1988); Bailey, "Cryotherapy", Emergency, 40–43 (August, 1984); Cryomed Brochures. U.S. Pat. No. 3,871,381 to Roslonski teaches a cryotherapy device which applies both cold and pressure to an extremity which involves the introduction of a pressurized volatile refrigerant liquid, e.g., Freon® (a chlorofluorocarbon or "CFC"), through a controlled flow rate valve, which cools a maze passage in a flexible device. A pressure relief valve maintains a back-pressure in the system. It is also known to circulate a cooled fluid through a conduit in a bandage.

Chlorofluorocarbon refrigerants are known to be available and to be used alone or in mixtures. In a Roslonski-type system, the lowest boiling component of such a refrigerant mixture acts to propel the refrigerant from the canister and precool the remaining refrigerant liquid as it enters the cooling matrix. The mid temperature boiling refrigerant acts to cool the tissue by boiling in the cooling matrix at a temperature approximately the same as the desired tissue temperature. Lastly, the highest boiling component acts as a heat transfer agent to improve the effectiveness of the device, by stabilizing the operation over a range of environmental conditions and helping to distribute the vaporizing refrigerant. The highest boiling component generally vaporizes before it reaches the end of the cooling matrix.

While refrigeration systems may operate in a single phase, i.e., expansion of a compressed gas, high efficiency at environmental temperatures may often be advantageously obtained using a phase change material, such as when a fluid boils or evaporates, carrying the heat of vaporization with the gas phase from the site of cooling, or the melting of a solid, which absorbs heat. Thus, the area in proximity to the phase change will be cooled, and, in a gaseous system, the gas is expelled to the atmosphere or to a recycling (reliquification) system. This phase change generally allows substantial heat energy transfer with comparatively lower temperature gradients than single phase systems, i.e., gas expansion systems. These smaller temperature gradients allow temperature buffering around a desired temperature range, thus allowing a degree of self regulation. The fluid also typically withdraws more heat per mass and volume unit than a gas. Thus, a system employing a liquid phase may also allow a more compact system, due to the higher heat energy capacity of liquids than gasses.

The following patents relate to known refrigerant systems: Lodes, U.S. Pat. No. 2,529,092; Senning, U.S. Pat. No. 2,641,579; Ashkenaz, U.S. Pat. No. 2,987,438; Munro, U.S. Pat. No. 3,733,273; Borchardt, U.S. Pat. No. 3,812,040; Hutchinson, U.S. Pat. No. 3,940,342; Murphy, U.S. Pat. No. 4,055,054; Orfeo, U.S. Pat. No. 4,533,536; Nikolsky, U.S. Pat. No. 4,495,776; Ermack, U.S. Pat. No. 4,510,064; and Nikolsky U.S. Pat. No. 4,603,002. Brown, U.S. Pat. No. 2,696,395 relates to a pneumatic pressure garment for application of therapeutic pressure. Gottfried, U.S. Pat. No. 3,153,413 relates to a pressurized bandage with splint functions. Towle, et al., U.S. Pat. No. 3,171,410 relates to a pneumatic wound dressing. Gardner, U.S. Pat. No. 3,186,404 relates to a pressure device for therapeutic treatment of body extremities. Romano, U.S. Pat. No. 4,135,503 relates to an orthopedic device having a pressurized bladder for spinal treatment. Curlee, U.S. Pat. No. 4,622,957 relates to a therapeutic corset for applying pressure to a portion of the back. Cronin, U.S. Pat. No. 4,706,658 relates to a gloved splint, providing a shock absorbing treatment and possible heat removal from the hand. Johnson, Jr. et al., U.S. Pat. No. 5,230,335, and Johnson Jr. et al., U.S. Pat. No. 5,314,455, both relate to a leg treatment system having a cold thermal fluid and having means for applying pressure. Smith, U.S. Pat. No. 5,324,318, relates to a cryotherapy apparatus having a cold compress and a gravity fed cold liquid. Smith, U.S. Pat. No. 5,170,783, relates to a cryotherapy procedure employing a gravity pressurized cold liquid. French et al., U.S. Pat. No. 4,844,072, relates to a heated or cooled liquid thermal therapy system. Wright, U.S. Pat. No. 5,172,689, relates to a cryotherapy sleeve for therapeutic compression. Meserlian, U.S. Pat. No. 5,167,227, relates to an apparatus for massaging or supporting the legs of a horse. Gammons et al., U.S. Pat. No. 4,149,541, relates to a flexible circulating pad which ensures fluid flow to all areas. Sauder, U.S. Pat. No. 4,170,998, and Sauder, U.S. Pat. No. 4,184,537, both relate to a limb refrigeration device for cryotherapy. Kolstedt, U.S. Pat. No. 4,335,716, relates to a device for circulating pressurized cold fluid in a sleeve for cryotherapy. Arkans, U.S. Pat. No. 4,338,944, relates to a cooled liquid cryotherapy device. Larsen, U.S. Pat. No. 4,998,415, relates to a body cooling apparatus including a compressor and a condenser. Tucker, et al., U.S. Pat. No. 4,442,834, relates to a pneumatic splint device. Robbins et al., U.S. Pat. No. 4,175,297 relates to an inflatable pillow support having automated cycling inflation and deflation of various portions thereof. Artemenko et al., U.S. Pat. No. 3,683,902 relates to a medical splint apparatus, having an inflatable splint body and a circulated cooling agent, cooled by solid carbonic acid (CO2). Davis et al., U.S. Pat. No. 3,548,819 relates to a pressurized splint adapted to apply a thermal treatment to a human extremity. Nicholson, U.S. Pat. No. 3,561,435 relates to on inflatable splint having a coolant chamber to apply pressure and cool to a human extremity. Berndt et al., U.S. Pat. No. 3,623,537 relates to a self-retaining cold wrap which treats an injury with cold and pressure. Baron, U.S. Pat. No. 4,300,542 and Baron, U.S. Pat. No. 4,393,867 both relate to a self-inflating compression device for use as a splint. Golden, U.S. Pat. No. 4,108,146 relates to a cooling thermal pack with circulating fluid which conforms to body surfaces to apply a cooling treatment. Moore et al., U.S. Pat. No. 4,114,620 and Gammons et al., U.S. Pat. No. 4,149,541 relate to treatment pads with circulating fluid for providing a hot or cold treatment to a patient. Brannigan et al., U.S. Pat. No. 4,575,097 relates to a thermally capacitive compress for applying hot or cold treatments to the body. Arkans., U.S. Pat. No. 4,331,133 relates to a pressure measurement apparatus for measuring the pressure applied by a pressure cuff to a human extremity. Kiser et al., U.S. Pat. No. 4,502,470 relates to a device for assisting in pumping tissue fluids from a foot and ankle up the leg. Stark, U.S. Pat. No. 3,000,190 relates to an apparatus providing body refrigeration, for use in high ambient temperature environments by workers. FR 2,133.680 relates to a system for cooling objects, including beverage cans, using fluorocarbons, e.g. Freon®. Nelson, U.S. Pat. No. 2,051,100, Burkhardt, U.S. Pat. No. 2,463,516 and Richards, U.S. Pat. No. 4,103,704 relate to pressure relief valves. Ninomiya et al., U.S. Pat. No. 4,286,622 relates to a check valve assembly. Martin et al., U.S. Pat. No. 2,550,840, Both et al., U.S. Pat. No. 2,757,964, Galeazzi et al., U.S. Pat. No. 2,835,534, Mura, U.S. Pat. No. 3,314,587, White, U.S. Pat. No. 3,976,110 and Turner, U.S. Pat. No. 4,281,775 relate to pressurized container dispensing valves and systems containing same. Frost, U.S. Pat. No. 3,273,610 relates to a pressurized container valve and detachable dispensing attachment device. Nakano, et al., U.S. Pat. No. 4,958,501, relates to a refrigerant charging apparatus for charging a refrigerant, including a refrigerant can, an upper can-opening part, a conduit having two inner passages for indication and charging, respectively, a lower can-opening part, and a level indicator communicating with the refrigerant can via both can-opening parts, for indicating a remaining quantity of the refrigerant in the can. Chruniak, U.S. Pat. No. 5,181,555, relates to a climate controlled food and beverage container which operates off an automotive climate control system. Howell, U.S. Pat. No. 5,203,833, also relates to a food storage container operating off an automotive air conditioning system. Fujiwara, et al., U.S. Pat. No. 4,637,222, relates to an automobile refrigerator detachably connected to the air conditioner of a vehicle. Maier, et al., U.S. Pat. No. 5,007,248, relates to an automobile air conditioner driven beverage cooling system. Kitayama, U.S. Pat. No. 5,189,890, relates to a portable chiller for chilling an ophthalmic solution, cosmetic preparation, beverage or the like. This portable chiller consists generally of a cylinder filled with a liquefied refrigerant gas and a chiller case. Ramos, U.S. Pat. No. 5,201,183, relates to a cooling device for beverage cans which cools by releasing liquid nitrogen or liquid air from a containment "bubble". Sundlhar, et al., U.S. Pat. No. 5,201,193, relates to a cooling device for beverages which cool by releasing liquid carbon dioxide. Saia, et al., U.S. Pat. No. 5,337,579, also relates to a liquid carbon dioxide cooling system. Fischler, et al., U.S. Pat. No. 4,669,273, relates to a coiled tube insert releasing a liquid refrigerant for cooling a beverage. Aitchison, et al., U.S. Pat. No. 5,214,933, relates to a liquid pressurized refrigerant system for cooling a fluid container. Beck, U.S. Pat. No. 3,919,856, relates to a liquid refrigerant beverage cooling device. Willis, U.S. Pat. No. 3,987,643, relates to a beverage cooling system employing compressed gas or liquid refrigerant with an improved heat exchanger system. Barnett, U.S. Pat. No. 4,584,484, relates to a liquid refrigerant system for cooling a can. Johnson, U.S. Pat. No. 4,640,101, relates to a liquid refrigerant beverage chilling mechanism. Tenebaum, et al., U.S. Pat. No. 4,640,102, also relates to a liquid refrigerant beverage cooling mechanism. Dodd, U.S. Pat. No. 4,319,464, relates to a container which is cooled by the release of a pressurized refrigerant. Kim, U.S. Pat. No. 4,628,703, and Kim, et al., U.S. Pat. No. 4,679,407, both relate to a refrigerant cooled can mechanism. Shen, U.S. Pat. No. 4,656,838, relates to a pressurized coolant for a beverage can. Chou, U.S. Pat. No. 4,925,470, relates to a self cooling can having a pressurized refrigerant. Ladany, U.S. Pat. No. 3,862,548, relates to a beverage cooling device which employs compressed gas. Nof, U.S. Pat. No. 4,597,271, relates to a pressurized gas method for cooling a container and liquid contained therein. Riley, U.S. Pat. No. 3,881,321, also relates to a beverage cooling device which preferably carbonates the beverage on release of the gas. Rhyne Jr., et al., U.S. Pat. No. 4,054,037, relates to a beverage cooler for sequentially cooling a plurality of beverage containers. Holcomb, U.S. Pat. No. 4,668,395, relates to a food container cooling system having a pressurized refrigerant fluid which is released into an expansion chamber. Campbell, U.S. Pat. No. 4,434,158, relates to an insulin cooling device including a refrigerating agent. Ehmann, U.S. Pat. No. 4,429,793, also relates to an insulating container with a refrigerant. Manz, et al., U.S. Pat. No. 5,497,625, relates to a Thermoelectric refrigerant handling system. Merritt-Munson, et al., U.S. Pat. No. 5,237,838, relates to a refrigerant cooled cosmetic bag. Martello, et al., U.S. Pat. No. 4,584,847, relates to a liquid refrigerant system for cosmetics. Merritt, et al., U.S. Pat. No. 5,353,600, relates to a solar powered thermoelectric cooler for a cosmetic bag which seeks to employ heat produced by the thermoelectric cooling element to recharge a rechargeable power source. Collard, U.S. Pat. No. 5,247,798, relates to a thermoelectric refrigeration device. Rudick, U.S. Pat. No. 4,671,070, relates to a thermoelectric beverage can cooler. Harris, et al., U.S. Pat. No. 4,280,330, relates to a thermoelectric vehicle cooling system. Kitayama, U.S. Pat. No. 5,287,707, relates to a portable vaporizing liquid refrigerant chiller device. Isaacson, et al., U.S. Pat. No. 5,313,809, relates to an insulating wrap having a eutectic solution in a film barrier container. Baroso-Lujan, et al., U.S. Pat. No. 5,325,680, relates to a Freon-22® cooled beverage container which flashes liquid Freon into an evacuated space. Each of the above references is hereby expressly incorporated herein by reference.

Goble, U.S. Pat. No. 5,214,929, relates to a non-CFC substitute refrigerant for R-12, including 2–20% isobutane (R-600a), 41–71% chlorodifluoromethane (R-22) and 21–51% chlorodifluoroethane (R-142b). Murphy, U.S. Pat. No. 3,901,817, relates to a low boiling azeotropic or essentially azeotropic mixtures containing monochlorotrifluoromethane and methyl fluoride. Murphy, et al., U.S. Pat. No. 4,054,036, relates to constant boiling mixtures of 1,1,2 trichorotrifluoroethane and cis-1,1,2,2-tetrafluorocyclobutane. Murphy, et al., U.S. Pat. No. 4,055,049, relates to constant boiling mixtures of 1,2 difluoroethane and 1,1,2-tricloro-1,2,2-trifluoroethane. Murphy, et al., U.S. Pat. No. 4,055,054, relates to constant boiling mixtures of dichloromonofluoromethane and 1-chloro-2,2,2-trifluoroethane. Murphy, et al., U.S. Pat. No. 4,057,973, relates to constant boiling mixtures of 1-chloro-2,2,2-trifluoroethane and 2-chloroheptafluoropropane. Murphy, et al., U.S. Pat. No. 4,057,974, relates to constant boiling mixtures of 1-chloro-2,2,2-trifluoroethane and octafluorocyclobutane. Murphy, et al., U.S. Pat. No. 4,101,436, relates to constant boiling mixtures of 1-chloro-2,2,2-trifluoroethane and hydrocarbons. Ostrozynski, et al., U.S. Pat. No. 4,155,865, relates to constant boiling mixtures of 1,1,2,2-tetrafluoroethane and 1,1,1,2-tetrafluorochloroethane. Ostrozynski, et al., U.S. Pat. No. 4,157,976, relates to constant boiling mixtures of 1,1,1,2-tetrafluorochloroethane and chlorofluoromethane. Zuber, U.S. Pat. No. 4,169,807 describes an azeotropic composition containing water, isopropanol, and either perfluoro-2-butyltetrahydrofuran or perfluoro-1,4-dimethylcyclohexane. The inventor states that the composition is useful as a vapor phase drying agent. Van der Puy, U.S. Pat. No. 5,091,104, describes an "azeotropic-like" composition containing t-butyl-2,2,2-trifluoroethyl ether and perfluoromethylcyclohexane. The inventor states that the composition is useful for cleaning and degreasing applications. Fozzard, U.S. Pat. No. 4,092,257 describes an azeotrope containing perfluoro-n-heptane and toluene. Batt et al., U.S. Pat. No. 4,971,716 describes an "azeotrope-like" composition containing perfluorocyclobutane and ethylene oxide. The inventor states that the composition is useful as a sterilizing gas. Shottle et al., U.S. Pat. No. 5,129,997 describes an azeotrope containing perfluorocyclobutane and chlorotetrafluorethane. Merchant, U.S. Pat. No. 4,994,202 describes an azeotrope containing perfluoro-1,2-dimethylcyclobutane and either 1,1-dichloro-1-fluoroethane or dichlorotrifluoroethane. The inventor states that the azeotrope is useful in solvent cleaning applications and as blowing agents. The inventor also notes that "as is recognized in the art, it is not possible to predict the formation of azeotropes. This fact obviously complicates the search for new azeotrope compositions" (col. 3, lines 9–13). Azeotropes including perfluorohexane and hexane, perfluoropentane and pentane, and perfluoroheptane and heptane are also known. Flynn et al., U.S. Pat. No. 5,494,601, provides an azeotropic composition, including a non-cyclic perfluorinated alkane and a hydrochlorofluorocarbon (HCFC) solvent, for example, perfluoropentane and perfluorohexane, and 1,1,1-trifluoro-2,2-dichloroethaiie and 1,1-dichloro-1-fluoroethane. A hydrofluorocarbon composition, R-236fa, having a boiling point of −1 degrees C. is known. Another known composition is c-$(CF_2)_4O$, also having a boiling point of about −1 degrees C. Each of the above references is hereby expressly incorporated herein by reference.

Magnetorheological Fluids and Valves

Magnetorheological fluids are known for a number of purposes. See, U.S. Pat. No. 4,491,207, Jan. 1, 1985, Fluid Control Means for Vehicle Suspension System; U.S. Pat. No. 4,733,758, Mar. 29, 1988, Tunable Electrorheological Fluid Mount; U.S. Pat. No. 4,772,407, Sep. 20, 1988, Electrorheological Fluids, U.S. Pat. No. 4,836,342, Jun. 6, 1989, Controllable Fluid Damper Assembly; U.S. Pat. No. 4,838,392, Jun. 13, 1989, Semi-Active Damper for Vehicles and the Like; U.S. Pat. No. 4,881,172, Nov. 14, 1989, Observer Control Means for Suspension Systems or the Like; U.S. Pat. No. 4,887,699, Dec. 19, 1989, Vibration Attenuating Method Utilizing Continuously Variable Semi-Active Damper; U.S. Pat. No. 4,896,754, Jan. 30, 1990, Electrorheological Fluid Force Transmission and Conversion Device; U.S. Pat. No. 4,898,264, Feb. 6, 1990, Semi-active Damper with Motion Responsive Valve Means; U.S. Pat. No. 4,907,680, Mar. 13, 1990, Semiactive Damper Piston Valve Assembly; U.S. Pat. No. 4,921,272, May 1, 1990, Semi-Active Damper Valve Means with Electromagnetically Movable Discs in the Piston; U.S. Pat. No. 4,923,057, May 8, 1990, Electrorheological Fluid Composite Structures; U.S. Pat. No. 4,936,425, Jun. 26, 1990, Method of Operating a Vibration Attenuating System Having Semi-Active Damper Means; U.S. Pat. No. 4,949,573, Aug. 21, 1990, Velocity Transducer for Vehicle Suspension System; U.S. Pat. No. 4,953,089, Aug. 28, 1990, Hybrid Analog Digital Control Method and Apparatus for Estimation of Absolute Velocity in Active Suspension Systems; U.S. Pat. No. 4,993,523, Feb. 19, 1991, Fluid Circuit for Semi-Active Damper Means; U.S. Pat. No. 5,004,079, Apr. 2, 1991, Semi-Active Damper Valve Means and Method; U.S. Pat. No. 5,007,513, Apr. 16, 1991, Electroactive Fluid Torque Transmission Apparatus with Ferrofluid Seal; U.S. Pat. No. 5,029,823, Jul. 9, 1991, Vibration Isolator with Electrorheological Fluid Controlled Dynamic Stiffness; U.S. Pat. No. 5,032,307, Jul. 16, 1991, Surfactant-Based Electrorheological Materials; U.S. Pat. No. 5,207,774, May 4, 1993, Valving for a Controllable Shock Absorber; U.S. Pat. No. 5,276,622, Jan. 4, 1994, System for Reducing Suspension End-Stop Collisions; U.S. Pat. No. 5,276,623, Jan. 4, 1994, System for Controlling Suspension Deflection; U.S. Pat. No. 5,277,281, Jun. 11, 1994, Magnetorheological Fluid Dampers; U.S. Pat. No. 5,284,330, Feb. 8, 1994, Magnetorheological Fluid Devices; U.S. Pat. No. 5,294,360, Mar. 15, 1994, Atomically Polarizable Electrorheological Material; U.S. Pat. No. 5,306,438, Apr. 26, 1994, Ionic Dye-Based Electrorheological Materials; U.S. Pat. No. 5,382,373, Jan. 17, 1995, Magnetorheological Materials Based on Alloy Particles; U.S. Pat. No. 5,390,121, Feb. 14, 1995, Banded On-Off Control Method for Semi-Active Dampers; U.S. Pat. No. 5,396,973, Mar. 14, 1995, Variable Shock Absorber with Integrated Controller, Actuator and Sensors; U.S. Pat. No. 5,398,917, Mar. 21, 1995, Magnetorheological Fluid Devices; U.S. Pat. No. 5,417,874, May 23, 1995, Method for Activating Atomically Polarizable Electrorheological Materials; U.S. Pat. No. 5,492,312, Feb. 20, 1996, Multi-Degree of Freedom Magnetorheological Devices and System for Using Same; U.S. Pat. No. 5,547,049, May 31, 1994, Magnetorheological Fluid Composite Structures; U.S. Pat. No. 5,578,238, Nov. 26, 1996, Magnetorheological Materials Utilizing Surface-Modified Particles; U.S. Pat. No. 5,599,474, Feb. 4, 1997, Temperature Independent Magnetorheological Materials; U.S. Pat. No. 5,645,752, Jul. 8, 1997, Thixotropic Magnetorheological Materials; U.S. Pat. No. 5,652,704, Jul. 29, 1997, Controllable Seat Damper System and Control Method Thereof; U.S. Pat. No. 5,670,077, Sep. 23, 1997, Aqueous Magnetorheological Materials; U.S. Pat. No. 5,683,615, Nov. 4, 1997, Magnetorheological Fluid; U.S. Pat. No. 5,693,004, Dec. 2, 1997, Controllable Fluid Rehabilitation Device Including a Reservoir of Fluid; U.S. Pat. No. 5,711,746, Jan. 6, 1998, Organomolybdenum-Containing Magnetorheological Fluid; U.S. Pat. No. 5,711,746, Jan. 27, 1998, Portable Controllable Fluid Rehabilitation Devices; U.S. Pat. No. 5,712,783, Jan. 27, 1998, Control Method for Semi-Active Damper; U.S. Pat. No. 5,816,372, Oct. 6, 1998, Magnetorheological Fluid Devices and Process of Controlling Force in Exercise Equipment Utilizing Same; U.S. Pat. No. 5,842,547, Dec. 1, 1998, Controllable Brake; U.S. Pat. No. 5,878,851, Mar. 9, 1999, Controllable Vibration Apparatus; U.S. Pat. No. 5,900,184, May 4, 1999, Method and Magnetorheological Fluid Formulations for Increasing the Output of a Magnetorheological Fluid Device; U.S. Pat. No. 5,906,767, May 25, 1999, Magnetorheological Fluid; U.S. Pat. No. 5,947,238, Sep. 7, 1999, Passive Magnetorheological Fluid Device with Excursion Dependent Characteristic; U.S. Pat. No. 5,964,455, Oct. 12, 1999, Method for Auto Calibration of a Controllable Damper Suspension System; U.S. Pat. No. 5,993,358, Jun. 30, 1999, Controllable Platform Suspension System for Treadmill Decks and the Like and Devices Thereof; U.S. Pat. No. 6,027,633, Oct. 17, 2000, Aqueous Magnetorheological Fluid with High Stability and Redispersion Capability; U.S. Pat. No. 6,027,664, Feb. 22, 2000, Method and Magnetorheological Fluid Formulations for Increasing the Output of a Magnetorheological Fluid; U.S. Pat. No. 6,070,681, Jun. 6, 2000, Controllable Cab Suspension; U.S. Pat. No. 6,095,486, Aug. 1, 2000, Two-Way Magnetorheological Fluid Valve Assembly and Devices Utilizing Same; U.S. Pat. No. 6,117,093, Sep. 12, 2000, MR Portable Hand and Wrist Rehabilitation Device; U.S. Pat. No. 6,131,709, Oct. 17, 2000, MR Adjustable Valve and Vibration Damper Utilizing Same; U.S. Pat. No. 6,132,633, Oct. 17, 2000, Aqueous Magnetorheological Material; U.S. Pat. No. 6,151,930, Nov. 28, 2000, Washing Machine Having a Controllable Field Responsive Damper; U.S. Pat. No. 6,158,470, Dec. 12, 2000, Two-Way Magnetorheological Fluid Valve Assembly and Devices Utilizing Same; U.S. Pat. No. 6,158,910, Dec. 12, 2000, Magnetorheological Grip for Handheld Implements; U.S. Pat. No. 6,186,290, Feb. 13, 2001, Magnetorheological Fluid Brake with Integrated Flywheel; U.S. Pat. No. 6,202,806, Mar. 20, 2001, Controllable Device Having a Matrix Medium Retaining Structure; U.S. Pat. No. 6,203,717, Mar. 20, 2001, Stable Magnetorheological Fluids; U.S. Pat. No. 6,234,060, May 22, 2001, Low Cost Servo-Positioning Systems Using MR Fluid Devices; U.S. Pat. No. 6,283,859, Sep. 4, 2001, Magnetically-Controllable, Active Haptic Interface System and Apparatus; U.S. Pat. No. 6,296,088, Oct. 2, 2001, Magnetorheological Fluid Seismic Damper; U.S. Pat. No. 6,302,249, Oct. 16, 2001, Linear-Acting Controllable Pneumatic Actuator And Motion Control Apparatus Including a Field Responsive Medium and Control Method Thereof; U.S. Pat. No. 6,308,813, Oct. 30, 2001, MR Fluid Controlled Interlock Mechanism; U.S. Pat. No. 6,311,110, Oct. 30, 2001, Adaptive Off-State Control Method; U.S. Pat. No. 6,339,419, Jan. 15, 2002, Magnetically-Controllable, Semi-Active Haptic Interface System and Apparatus; U.S. Pat. No. 6,340,080, Jan. 22, 2002, Apparatus Including a Matrix Structure and Transmission; U.S. Pat. No. 6,373,465, Apr. 16, 2002, Magnetically-Controllable, Semi-Active Haptic Interface System and Apparatus; U.S. Pat. No. 6,378,671, Apr. 30, 2002, Magnetically Controlled Friction Damper and Use Thereof; U.S. Pat. No. 6,382,604, May 7, 2002, Method for Adjusting the Gain Applied to a Seat Suspension Control Signal; U.S. Pat. No. 6,394,239, May 28, 2002, Controllable medium device and apparatus utilizing same; U.S. Pat. No. 6,395,193, May 28, 2002, Magnetorheological compositions; U.S. Pat. No. 6,427,813, Aug. 6, 2002, Magnetorheological fluid devices exhibiting settling stability; U.S. Pat. No. 6,475,404, Nov. 5, 2002, Instant magnetorheological fluid mix; U.S. Pat. No. 6,547,986, Apr. 15, 2003, Magnetorheological grease composition; U.S. Pat. No. 6,611,185, Aug. 26, 2003, Magnetorheological fluid based joint; D473,950, Apr. 29, 2003, Combined container and field responsive material; U.S. Pat. No. 6,695,105, Feb. 24, 2004, Magnetorheological twin-tube damping device; and EP 1,196,929 B1, Feb. 25, 2004, Stable Magnetorheological Fluids, each of which is expressly incorporated herein by reference, in its entirety.

Both thermal (see U.S. Pat. Nos. 5,681,024; 5,659,171; 5,344,117; 5,182,910; and 5,069,419, expressly incorporated herein by reference) and piezoelectric (see U.S. Pat. No. 5,445,185, expressly incorporated herein by reference) microvalves are known, with other physical effects, such as magnetic, electrostatic (see, U.S. Pat. Nos. 5,441,597; 5,417,235; 5,244,537; 5,216,273; 5,180,623; 5,178,190; 5,082,242; and 5,054,522, expressly incorporated herein by reference), electrochemical (see, U.S. Pat. No. 5,671,905, expressly incorporated herein by reference) and pure mechanical devices also possible. See, U.S. Pat. Nos. 5,647,574; 5,640,995; 5,593,134; 5,566,703; 5,544,276; 5,429,713; 5,400,824; 5,333,831; 5,323,999; 5,310,111; 5,271,431; 5,238,223; 5,161,774; 5,142,781, expressly incorporated herein by reference.

Shape Memory Alloy (SMA) valves are also known. See U.S. Pat. Nos. 5,659,171; 5,619,177; 5,410,290; 5,335,498; 5,325,880; 5,309,717; 5,226,619; 5,211,371; 5,172,551; 5,127,228; 5,092,901; 5,061,914; 4,932,210; 4,864,824; 4,736,587; 4,716,731; 4,553,393; 4,551,974; 3,974,844, expressly incorporated herein by reference. See "Tini Alloy Company Home Page", www.sma-mems.com/nistpapr.htm; "Thin-film TI—NI Alloy Powers Silicon Microvalve", Design News, Jul. 19, 1993, pp. 67–68; see also "Micromechanical Investigations of silicon and Ni—Ti—Cu Thin Films", Ph. D. Thesis by Peter Allen Krulevitch, University of California at Berkley (1994); MicroFlow, Inc. (California) PV-100 Series Silicon Micromachined Proportional Valve.

SUMMARY AND OBJECTS OF THE INVENTION

The present invention provides an adaptive footwear device, which may be tuned to the wearer, and independently controls an energy absorption and energy recovery characteristic of the footwear, e.g., separate control over a cushioning phase and a rebound phase of the footwear.

It is noted that the cushioning an rebound characteristics are a compromise between energy efficiency, relief of impact stress on joints, strain on tendons and ligaments, stability, etc. Likewise, the optimal characteristics in one portion of the footwear may differ from that in other portions. The present invention involves a set of technologies which are adapted or intended for use in footwear, which may be combined together in combination and subcombination, along with other known technologies. The present invention also involves footwear systems, including known and/or new technologies, in particular embodiments.

In typical footwear, the sole provides cushioning, especially of transient forces generated during activity, in which a portion of the energy represented by transient forces is dissipated, and a portion recovered by elastic rebound. In this traditional design, there is no asymmetric control over the time domain characteristic of the cushioning or recovery phases. It is possible to control a cushioning of footwear by bleeding a pneumatic bladder or hydraulic chamber. While this provides a degree of control over the cushioning characteristic, unless the reservoir into which the working fluid is specially designed to return some of the energy.

One embodiment of the present invention focuses on absorption of transient forces, and control over efficient energy recovery. Thus, the present invention provides a reversible energy absorption element which has a controlled release of energy. Control is preferably exercised to define a time characteristic of the release, which typically differs from a corresponding uncontrolled system using a passive cushioning element, in which substantial portions of any stored energy is released based on a relatively simple differential equation, with relatively short timeconstants.

A particular advantage accrues from control over energy release. In a traditional design, in order to provide a sufficiently damped response to avoid ringing and instability, a relatively high degree of energy dissipation was required. This is because a traditional design does not provide asymmetry in energy absorption and release, thus requiring a compromise, since release of the absorbed energy shortly after its absorption would be undesirable. The design of Demon, U.S. Pat. No. 5,813,412, on the other hand, provides controlled asymmetry, but in a purely dissipative manner, thereby precluding efficient energy recovery. On the other hand, according to an embodiment of the present invention, instead of dissipating the principal cushioning energy, it is stored for later release. Thus, a desired damping profile may be achieved, without necessarily dissipating the energy as would be required in a time invariant system, or in a system which lacks a special energy absorption element.

The present invention may also provide control over a dynamic characteristic of the footwear. This characteristic is, for example, a resonant frequency and/or damping of the footwear to increase comfort, reduce joint stress, or improve performance. Typically, when one analyzes the dynamic response of a system, the ability of the system to store and subsequently release energy, that is, to provide an element which absorbs and releases potential energy, is an important factor. A cushioning effect which is purely dissipative, such as a flow through a restrictive orifice or a frictional loss, is quite distinct from one which provides a rebound. However, uncontrolled energy storage and release can lead to instability, stress and strain, injury and inefficiency.

If one simply dissipates the cushioning energy, the heel is compressed at the end of the cycle, and thus the wearer must lift the foot during walking or running by the compression amount to compensate. Over long distances, this energy dissipation may be significant. On the other hand, if energy is recovered and released at the end of the cycle, the foot will be higher at the end of the cycle than at its nadir. Thus, the required lift amount will be less in an energy recovery cushioning system than in a purely dissipative cushioning system, for any amount of stress reduction. This equates to an improvement in efficiency.

During running, heelstrikes are avoided, and therefore the transient occurs at the toe or midsole. In this case, the cushioning energy is absorbed in both compression and flexion of the sole.

Because the sole flexes, it must be relatively thin, and therefore compression is limited. However, the force transmission can be effectively damped by altering the stiffness of the sole against flexure.

As discussed below, a common mechanism may be provided for both heel compression and sole flexural damping. The control system may accommodate the difference in optimal damping and recovery profiles.

When considering cushioning magnitude, to achieve a corresponding amount of cushioning while recovering energy will generally require a greater volume for the energy storage element than in a system which eliminates or avoids this element. The technology employed for the energy storage element therefore may be a significant factor in the design of the footwear. The present invention therefore proposes a number of designs to address this technological hurdle.

One known footwear system employs springs or elastic tubes to support the heel. With each step, the springs or tubes are compressed, and rebound. These known systems, however, lack controllability. If the damping constant is too high, there will be inefficiency; if it is too low, the system will be too stiff and provide insufficient cushioning. If the resonant frequency is not optimal, the result may be gait instability, perceptible oscillation or overshoot, inefficiency, or a poor feel. In fact, because wearers differ, in their weight, gait and activity patterns, and preferences, there may be no single optimal values of the resonant frequency (or longest significant mechanical timeconstant) or damping coefficient (loss of energy). Thus, the present invention may provide a control for modifying one or both of these characteristics.

In an embodiment of the invention, a working fluid is provided which is compressed by the wearer during activity. The fluid passes from a compression chamber through an orifice to a storage chamber, also referred to herein as a dynamic response chamber, because the characteristics of the chamber have a material effect on the dynamic response, i.e., related the a first or higher derivative of distance with respect to time. By controlling the orifice, the rate and/or time profile of fluid flow to the storage chamber can be controlled. The storage chamber is compliant and has an elastic wall, and thus the entry of fluid imparts potential energy to the chamber, which can be released back into the fluid.

One way to modify the characteristic of the chamber, is to alter the operating point. For example, by changing the starting volume in the chamber, the compliance to further fluid entry will also change. For example, the energy stored in the chamber or its surrounding structures increases with increasing volume, typically in an exponential manner, i.e., P proportional to $V^n$, n>1.

Alternately, a separate element, such as a non-linear spring, acting on the chamber, may be prestressed. Thus, by providing a reservoir of fluid, which feeds or bleeds fluid into the system comprising the compression chamber, orifice and storage chamber, the characteristics of the system may be controlled, since the response is non-linear. The result is slightly different if the working fluid is a liquid or gas, or as discussed below, a phase change material, which advantageously also serves as a refrigerant. However, the result is that two parameters of the system may be simultaneously and independently controlled, for example to alter a static . parameter, such as a damping coefficient, and a dynamic characteristic, such as a resonant frequency. These characteristics are controlled, for example, by two separately controlled valves, or aspects of a valve structure.

In order to provide a timeconstant sufficiently long to allow the rebound to coincide with a gait cycle, for example in the tens or hundreds of milliseconds, it is useful to provide a time asymmetry. Thus, for example, during the initial transient absorption phase of the gait cycle, immediately following heel strike against the ground, the system is controlled to compress by an amount up to the maximum available or permitted, but no more. That is, the system does not "bottom out" or unduly stress the musculoskeletal system, e.g., the Achilles tendon. Likewise, the impedance of the system is set so that the undesired transient forces transmitted to the wearer are minimized, at least within a particular timeframe and frequency band. During a later gait phase, the energy recovery is provided to assist the wearer lift the shoe or propel, without causing undue strain on the wearer. In fact, there can be a delay between the first and second phases, or they can overlap.

In a simplified control system, a pilot valve is used to trigger energy release. This system is simplified, in that the release of energy, once triggered, is mostly uncontrolled. The control signal for the energy release can be established based on a predicted timing, or based on a sensing of an appropriate phase for release. For example, a pilot valve may be triggered based on a release of weight on the heel, or passing of peak flexure of the sole. An electronic control system can be used to provide adaptive predictive capability, without requiring a sensing of a change in phase of the wearer's activity.

The control system does not require real-time electronic control; that is, predefined mechanical or hydraulic elements define a state which is optimal for a predicted need. An electronic control system, if present, acts to change the operating point, for example between steps, but over the course of a step.

In order to control the system, two strategies are generally available. First, a sensor or sensor array can measure the forces or pressures within the footwear, with an algorithm executed based on these measured forces. Second, critical operating parameters of the footwear can be detected, for example critical damping, which allows inference of the parametric relationships. In many instances, the desired control will have a desired relationship with the critical damping condition, therefore it is possible to test the footwear in various states to search for criticality, and then modify the configuration based on the knowledge of the critical damping state parameters.

In order to determine the damping amplitude, the system can use a successive approximation algorithm to reach a target. Thus, when the compression chamber reaches its limit, either the flow rate through the orifice is too great, or the compliance of the storage chamber too high. In order to distinguish these possibilities, one may analyze a pressure waveform. The goal of the cushioning is to damp the forces that would be transmitted to the leg, and up to the knee. As discussed above, there is an optimum damping, since sub-optimal values may lead to inefficiency and/or instability. If the initial damping is too low, there will be a ringing. The damping may thus be adjusted to provide a desired operating point with respect to a ringing characteristic: for example, fully damped, with no ringing or overshoot; critically damped; minimum settling time; or underdamped.

According to one embodiment, the second derivative of the compression displacement curve approaches its first zero (or a desired non-zero value, or later zero, if appropriate) at the maximum applied force to the shoe. If the resonant frequency is too high, the shoe will overshoot, and the first zero will appear prior to maximum force. If the resonant frequency is too low, the shoe will undershoot. Likewise, assuming the timeconstant is optimal, the damping will scale the cushioning, so that a desired nadir may be adjusted.

The issue arises that neither the orifice restriction nor volume of the chambers independently correspond to the damping coefficient, or the resonant frequency. Likewise, there may be higher order effects and non-linearities. Therefore, the system must generally calculate these as interactive parameters. Since the characteristics of the footwear will change with temperature, age, altitude, etc., a sensor feedback control is preferred.

In an embodiment with a reservoir, in order to efficiently transfer fluid from the reservoir to the other chambers, a pair of orifices, one or both of which is modulated (valved) is provided: one for feeding the system, which has a small chamber which is pressurized by the sole or heel, and ported to the storage chamber while the sole or heel is pressurized. (This feed can also be controlled by a sole-flexion operated pump). A bleed valve allows release of fluid from the storage chamber to the reservoir when the reservoir is pressurized. The bleed valve may be constantly operative and fixed, so that only the feed valve is controlled to establish a setpoint for the system. Due to the wide range of pressures seen in the various chambers, the fluid redistribution may be passively driven without additional external power.

It is noted that by altering the initial compliance of the storage chamber, the range of cushioning available is also altered. Thus, the maximum compliance of the shoe corresponds to the maximum compliance of the fluid, which is controlled by the pre-stress.

It is also possible to alter the compliance curve of the storage chamber in other ways. For example, if the storage chamber is split between a high compliance and low compliance component, and the ratio of flow into each chamber controlled, then one can then control the effective compliance between the two extremes, at least for small volume flows. In more exotic embodiments, the wall includes a magnetodynamic or electrodynamic material, which are altered, respectively, by magnetic or electrical fields.

The control system selectively controls damping and recovery of pedal energy. Thus, under some circumstances, a large degree of energy recovery is desired. For example, during normal walking, energy recovery from the footwear would be advantageous. On the other hand, during athletic maneuvers, the wearer expects a high degree of damping from the footwear, and the absence of this damping might result in instability. The instability might manifest itself as bouncing, ankle and knee stresses or injuries, difficulty stopping or turning, or the like. Therefore, a higher degree of damping would be desired. This adjustment is not possible in passive footwear.

Likewise, it might be advantageous to control a resonant frequency or timeconstant of the lowest frequency substantial vibrational mode of the footwear. In this case, the issues are somewhat more subtle. As should be clear, the footwear itself is typically operated in a discrete time environment, in which the gait cycle is far longer than any material mechanical timeconstant of a normal shoe. Therefore, in order to take advantage of the stored energy, the shoe must have a special mechanical energy (or transduced mechanical energy) storage system, as well as a control for selectively releasing this energy at an appropriate time in an appropriate manner.

It is apparent that at least three distinct issues are discussed above: cushioning, that is, the damping of energy within a particular range of frequencies; energy recovery controlled independently from absorption; and resonance. Each of these issues generally involves different problems to be solved, and technologies for implementation, although some consolidation may be provided.

Typically, in performance footwear, the core function of the footwear will take precedence over other functions; thus, system will seek to provide optimal cushioning, while selectively absorbing energy from the transient forces for other purposes as appropriate. The control system therefore determines a portion of the energy which is directly transmitted between the ground the foot, and a portion which is dissipated or stored for later release. This control therefore alters the transient response and coupling between ground and shoe, and shoe and wearer, as the footwear contacts the ground and is subsequently lifted. The shoe presents a complex impedance to the force; ideally, the impedance of the shoe is appropriate to absorb a portion of the transient force which would be injurious or uncomfortable to the wearer or would otherwise reduce performance, while generally transmitting the useful forces without substantial phase delay. In fact, under appropriate circumstances, stored energy release can lead supplied energy, to constructively assist the wearer.

Most walking or athletic surfaces are hard and non-compliant, and might appropriately be modeled as infinitely stiff. On the other hand, some surfaces, such as polymeric running track materials, Astroturf® (synthetic grass), grass, dirt, padded gymnasiums, and the like, have significant compliance, and whose properties will significantly affect the performance of the athlete and the optimal response of the footwear.

By adaptively tuning the shoe, absorption (blocking of transmission to the foot) of high frequency transient force components may be maximized, while transmission of a static and generally useful forces generally unimpeded. By tuning the cutoff frequency between the static forces and high frequency force components, the footwear will balance cushioning of the user and the ability to aggressively transmit useful forces without perceptible delay, and without undesired resonance or overshoot. Of course, some degree of resonance or overshoot may be desired, for example to achieve minimum settling time, and this may be accommodated by the control. It is important that the cushioning not be so great that the wearer cannot quickly and accurately provide corrections to foot alignment, since this could lead to poor performance and/or possibility of injury.

Thus, the control may selectively provide differential action with respect to coronal and sagittal plane forces. Thus, in one embodiment, a plurality of actuators are separately controlled with respect to sagittal and coronal impedance. The control can be programmed for normal or pathological patterns, for example to correct gait defects and minimize a likelihood of injury. In this case, for example, a set of four actuators at the front-left, front-right, rear-left and rear-right of each heel are provided to adjust a base configuration, and complex impedance, and/or a delayed energy recovery pattern for each. Thus, in addition to control over the forces in the vertical axis, the present invention may also provide horizontal (axial) control, typically to balance agility, stability, and injury risk.

The footwear is thus not necessarily characterized by a single axis response; the characteristics of the upper, sole and heel will vary over their entire surface. In addition to the vertical axis response of the sole, which, for example, is important for knee and hip force transmission, it may be useful to provide control over a rotational axis aligned with the major axis of the sole (pronation and supination), especially at the heel, for preventing ankle injury and facilitating lateral movements.

While control may be independently exerted over damping and resonant frequency parameters of a mechanical system modeled as second order, these parameters need not be independently or separately controlled, and indeed, there is no need to model the shoe as a second order system, and higher order control algorithms or those not simply modeled as differential equations of arbitrary order, may advantageously be employed.

Since footwear is limited in its size and weight, which should typically be minimized, a highly complex control system is not necessarily desirable. Rather, for cost, size, weight, and reliability considerations, the control system should generally be relatively simple and efficient, with fail-safe operation. Likewise, passively controlled elements are generally more desirable than actively controlled elements, due to power, complexity, and cost concerns.

While electronic systems provide the ability to implement arbitrary control algorithms, and thus are quite effective in situations where the algorithm changes frequently or without notice, in many instances, this may not be required. Thus, for example, a control system based on, for example, fluid pressures, bleed rates, and displacement or volume amplitudes may be sufficient provide control over the major parameters in an appropriate manner.

The present invention therefore preferably provides a footwear system in which at least a portion of the energy from an initial mechanical input is stored and selectively released based on a control input at a later time. The damping energy may also be recovered for use in operating the control system. Advantageously, there is differential control over a transient absorption phase, for example during the first 100 mS after foot contact with the ground, and the rebound phase of the cycle. A resonant frequency or other higher order (i.e., rate dependent) parameter of the footwear is selectively altered by a control. Typically, at least two elements of the footwear are separately controlled, e.g., distinctly controlled or independently controlled or simultaneously but not identically controlled, for example heel rebound (i.e., vertical axis) and heel pronation/supination (rotational axis along major axis of foot). A system in which a plurality of parameters are interactively controlled based on alteration of a single parameter is therefore not preferred.

According to one embodiment, the maximum amount of mechanical energy stored in a shoe is between 10 kg×g×1 mm and 500 kg×g×10 mm, depending on the weight of the wearer, activity type, and shoe design. In the extreme maximum case, the energy stored corresponds to three to five times the weight of the wearer (which may be available if the wearer lands after jumping), over a distance of 10 mm compression, or about 50 Joules. Since this case will be relatively rare, a more modest energy storage capacity may be acceptable. For example, an energy storage element capable of storing at least 1 Joule, and for example 5 or 10 Joules of energy, may be provided.

The preferred embodiment may also provide an adaptive fit for the footwear upper. Since the upper and sole are interactive, these functions are advantageously combined. For example, pronation/supination forces are is transmitted to the foot, both through the sole plate, as well as through the upper. Control may be exerted both by controlling forces beneath the foot and from above.

One embodiment of the present invention seeks to selectively recover energy from the cushioning, rather than simply dissipating or damping energy components which are in excess of those desired, using absorbed energy, if it exists, simple to return the system to its starting state after the shoe is lifted from the ground. Thus, the embodiment seeks to store energy, typically as a compressed gas in a chamber or bladder, or in a deformed solid, such as a stress or strain in a spring or shell, which can then be selectively released where and when desired. Advantageously, the energy release delay may coincide with an appropriate portion of the gait cycle, even if significantly delayed from the corresponding energy absorption. Likewise, the energy release may be displaced from the site of absorption.

While there is always some dissipation of energy in footwear, and one would typically not seek to design footwear without such losses, it is less than ideal to provide a dissipative control as the only tuning parameter, since this will necessarily be a compromise between cushioning and efficiency. In fact, according to the present invention, an increase in efficiency, at least on a theoretical basis, is possible, since cushioning energy can be recovered for constructive use assisting the user in his or her principal activity.

Control may be independently and simultaneously exerted over at least two parameters, thus requiring at least two control outputs (which may be multiplexed). In some instances, a single control signal may be used. Thus, for example, the control may modify a rate-dependent variable only.

Preferably, the footwear includes an energy storage element, such as a compressed gas bladder, flexible or compressive spring, or elastic element. A control signal is provided to modulate the energy absorption and/or release from the energy storage element. In the case of a flowing gas or liquid, a valve may be provided as the control element. In the case of a spring, a mechanism may be provided as a ratchet or clutch, or other element to selectively control stored mechanical potential energy release, such as a valve in a linked piston-cylinder system.

One embodiment employs a set of springs, such as a coiled metal wire or polymer cylinders or tubes, situated beneath the heel of the wearer, for example, near the four corners. The compression of each spring is controlled by a flow of a fluid though a tube; if the flow is unimpeded, the dominant force is the recoil force of the spring; if the flow is impeded, the dominant force is the fluid compressibility or fluidic system compliance. While any suitable valve may be employed, a particularly preferred type comprises a tube is filled with a magnetorheological fluid, i.e., a fluid whose viscosity is sensitive to a magnetic field. The magnetic field may be modulated, in turn, by a permanent magnet or electromagnet, or a combination. Advantageously, relatively slow modulation is effected, at least in part, by a displacement of a permanent magnet in accordance with a gait or activity pattern of the user. This can be affected without electrical power, and therefore driven by a parasitic mechanical power loss from the footwear. High speed modulation will generally require an electromagnet, driven by a microcontroller. Power for this microcontroller and electromagnet can also be derived parasitically from gait (for example, stored on a capacitor or rechargeable battery), or from a primary battery, or a combination of these.

The amount of magnetorheological fluid required may be relatively small, for example less than about 5 cc per actuator. This fluid may be, for example Rheonetic™ fluid from Lord Corp., Cary N.C. The magnets are typically rare earth magnets (NdFeB), for example having a volume of less than 1.5 cc. The entire control system may therefore be relatively low weight and volume.

Alternately, a more traditional valve or controlled obstruction of a hydraulic fluid system may be provided.

In terms of the energy release pattern, there are two preferred alternatives. The simplest system involves releasing the mechanical energy through the same actuator as it is absorbed. Thus, for example, the energy is absorbed on initial heel strike, and released to assist heel lift, for example using a pilot valve to trigger a power assist phase.

Another system releases the energy in a manner that assists in gait, for example by straightening the sole of the footwear from a flexed conformation during toe-off. In this system, during heelstrike, energy is absorbed in an elastic member, and a hydraulic fluid enters a chamber and is pressurized. During a normal gait cycle, the weight of the wearer shifts from heel to toe, and the sole of the shoe flexes near the ball of the foot. After this dorsiflexion, the weight is released from the foot and the toes straighten. According to the present embodiment, as the weight is being released, and the toes straighten, the fluid in the pressurized chamber is ported to pressurize a flexible tube or tube array, having a low compliance wall, located in the sole, around the ball of the foot. The pressure will tend to straighten the tube or tube array, thus assisting in locomotion or other activity. Therefore, the wearer is given a gait assist. During running, there will be no heelstrikes. However, the forced flexion of the tube or tubular array will also tend to pressurize the chamber, and therefore the same release mechanism may be employed as discussed above. Thus, a common design may be compatible with various different gait styles.

By sensing a change in a phase of gait, a pilot valve may trigger release of a fluid to recoup the energy absorbed during cushioning. In a mechanical system, a self-adjusting over-center toggle joint mechanism or clutch may be used to control energy release. A position of a magnet may be used to control a magnetic valve or magnetic fluid, e.g., a magnetorheological fluid.

As an alternate to the pressurized tube actuator, it is also possible to employ other types. For example, a curved shaft may be provided in the sole. In one configuration, the curvature of the sole (when flexed) corresponds to the curvature of the shaft, and the curvature plane vertically aligned. In another configuration, the shaft is rotated so that the sole is straight, and the shaft curvature plane horizontally aligned. In this case, the stored mechanical energy acts to rotate the, shaft to straighten the sole. While a hydraulic motor may be used to effect this rotation, it may be more efficient to provide a gear or mechanical linkage between a spring and the shaft, with a ratchet or clutch retaining the spring compressed until release is desired.

In another embodiment, a plunger is displaced along the axis of the foot, e.g., in one position, e.g., a retracted (toward the heel) position, allowing free flexion of the sole, and in another position, e.g., the extended (toward the toe) position, forcing it to be straight, while applying a straightening force during transition from retracted to extended. As with the pressurized tubes, the plunger may be actuated hydraulically or mechanically.

A further embodiment provides a cable-type linkage between the heel and toe portions of the sole. When a tension is applied to the cable, the shoe is straightened, while when no tension is applied, the shoe is free to flex. The mechanism therefore controls the release of potential energy to apply a tension on the cable. Advantageously, the cable system may be provided with some intrinsic elasticity, so the shoe has a springy feel, even if the cable is fully taut. This elasticity may be provided within the cable or its mounting. Preferably, the cable is mechanically linked to a spring element in the heel, with a direct relation between the compression of the spring and the tension on the cable. The release of energy may be controlled by a hydraulic valve mechanism, which advantageously may also be used to provide a controlled damping (energy dissipation function). The cable itself may be a metal braided cable, a strap, or other tensile structure.

A somewhat different embodiment avoids sole plate actuators, and instead redistributes forces at the heel. In a normal walking gait pattern, the rear of the heel strikes the ground first, then the shoe flattens and the weight is principally distributed over the center of the foot. As the cycle progresses, the center of gravity is brought further forward, and the heel is unloaded as the foot dorsiflexes. As discussed above, energy can be readily captured as the weight of the wearer is brought down on the heel. On the other hand, the release of the energy to lift the foot of the wearer as the heel is unloaded may be advantageous. In this case, since there is a rolling motion of the foot, it is somewhat inefficient to release the energy at the location absorbed. Rather, it is more efficient to transfer energy from the rear of the heel to the front of the heel. Thus, for example, the elastic members at the rear compress a working fluid, which is then transferred to the elastic members at the front for release. When the footwear is completely unloaded, then the fluid chambers may redistribute the working fluid so that they are prepared for the next cycle. In this case, the energy absorbed at the front of the heel may be released at the same location, while the energy absorbed at the rear is pooled with the energy absorbed at the front. This arrangement allows a single chamber and release valve to be employed. Since the energy release is timed to commence when the shoe is under high load, and since the actual amount of energy is relatively small as compared with the energy of the overall gait cycle, the release of the energy need not be modulated to avoid an impulse, although this may be desirable to improve the perception of the system.

The footwear system according to the present invention may also advantageously provide cooling and/or heating functions for the foot. Typically, the cooling and/or heating will be powered by parasitic draw of energy from the locomotion, and indeed, may be the principal sink for stored energy. Advantageously, in a cooling footwear design, the working fluid is a liquid-gas phase change refrigerant, compressed by the heelstrike and/or sole flexion. As stated, while the cooling system may draw most or all of the energy captured by the system, advantageously, the compressor is controlled or modulated to provide an appropriate level of cushioning.

The refrigeration system preferably operates from stored energy rather than act directly as the energy sink because using stored energy, it can be more efficiently transduced, and because the energy absorption mechanism can be more readily optimized for comfortable absorption of energy from gait than a simple refrigeration compressor. For example, if one seeks to directly compress a refrigerant using a heelstrike, then a high compression ratio, low volume compression chamber is required. Cushioning will be exponential, and relatively abrupt at the compression limit. Such a system would have to be optimized for each wearer since the weight and activity pattern of each wearer differs. On the other hand, if the absorbed energy were released to operate a secondary compressor, the decoupling would allow more efficient use of energy and a more optimal energy absorption profile.

It is thus preferred that the refrigerant compressor be decoupled from the cushioning system. That is, the cushioning system operates optimally to capture energy according to a desired damping profile, which is then dissipated in part and stored in part. The stored energy can then be transferred to the heat pump system on an optimal fashion. For example, the stored energy in a storage chamber is fed through a small turbine or gear pump, which in turn actuates a compressor. The refrigerant compressor may be magnetically coupled to the turbine, and form separate fluid paths. Alternately, the refrigerant can be the working fluid for the energy absorption system, with a condenser pressurized by a peak pressure from the gait transient. In this case, the system is designed to "bottom out", and a relief valve will open after the compression chamber reaches a threshold pressure to transfer refrigerant to the condenser.

In the case of a heated system, gas compression, friction, heat pumping, or another exothermic effect may be used to provide the desired temperature increase.

If the design calls for a gas or liquid to be contained within a low compliance chamber, a high tensile flexible strength polymer film is preferably employed in fabricating bladder structures. These films, which are, for example, polyester (Polyethylene Phthalate polymer), although other films may be employed. The preferred polyester films have a modulus per ASTM D882 of about 550 kpsi, making them relatively stiff. Typically, all structures within the footwear will have approximately elastic properties, that is, there will generally be no structure which displays plastic deformation during the normal lifetime of the footwear. One possible exception is a phase change material or so-called memory metal structures, which may be temporarily plastically deformed until reset.

The films may be of any type having the necessary characteristics. The film must have sufficient strength to produce a usable device both for its abstract function of providing cooling and optionally pressure, and also be suitable for application to the human body. Preferred materials include polyester films, including but not limited to Mylar® (du Pont), HostaPhan® (Hoechst-Celanese), Lumirror® (Toray), Melinex® (ICI) and film packaging available from 3M. These films may each be formed of multiple layers, to provide the desired qualities. These films may also be metalized, which may be useful in reducing film permeability and increasing insulation value.

When heat sealed to form a bladder structure or fluid (gas or liquid) flow path, the walls of the bladder are relatively non-compliant, even with relatively thin films, for example 50 gauge. Thus structure, when filled with a has or a fluid with a gas-fluid interface, will generally have pressure-volume properties defined by the gas component, since fluids are generally incompressible, and the container has a low compliance (i.e., change in dimension associated with a change in force). The selected film thickness will depend on the desired mechanical properties and vapor diffusion limits.

The control system for the shoe, as stated above, may encompass both the sole and upper. Advantageously, the control over the upper is effected by a set of bladders located beneath a protective layer, the exterior visible upper, forming an inflatable lining. The exterior portion of the upper provides a support for the bladders, and thus a change in the fill of the bladder will generally directly correspond to a change in pressure applied to an underlying portion of the foot. In contrast to prior designs which employ polyurethane or poly vinyl chloride films to form bladder structures, the preferred polyester films according to the present invention may be pressurized to relatively higher levels to allow a finer degree of control over the fit contour of the shoe. Of course, if the bladder pressure is relatively high, padding should be separately provided. This high pressure containment capability also allows the bladder structure to withstand greater transient pressures without failure or requiring a relief valve, even where inflated or pressurized to a lower pressure. Suitable films are readily heat sealed, to withstand a force expressed as, for example, greater than 400 g/in. Thus, the bladder structures need not be molded into the shoe, and therefore may be provided as a separately manufactured subassembly. On the other hand, the chamber may be molded into the heel, structure, using relatively thick walled structures.

The control system may require special sensors or sensor arrays, to properly sense the environment and/or infer the intent of the wearer. A sensor array may have outputs each representing a particular actuator zone, i.e., a pressure or displacement sensor associated with each actuator, or a separate array of sensors disposed around the foot independent of the actuator locations. Advantageously, the user interface for the control can include a wrist-worn transmitter, allowing the user to input a command which us transmitted to the footwear. Alternately or in addition, an input may be provided directly on the footwear.

In footwear, the upper and sole present different problems. The upper is typically designed as a thin, relatively low compliance shell, which form-fits the foot. The sole, on the other hand, preferably provides cushioning, traction (see, U.S. Pat. No. 5,471,768) and stability. Since the sole is subject to relatively high static pressures, i.e., potentially over 300 psi, and is non-porous, the ergonomic factors differ markedly from the upper, which is typically porous and thus allows evaporation of water vapor, and is subject to much lower static forces, and typically lower dynamic forces as well, depending on shoe construction. Therefore, solutions designed to improve the ergonomics of shoes will also propose different solutions for the upper and the sole. Thus, low pressure air (e.g., less than about 3 psi unloaded) in the sole will feel "squishy" and potentially result in instability. The dynamic range of pressures will also pose materials issues for the bladder construction, of the air pressure is to dominate the effect. Therefore, sole constructions typically employ higher pressure gas or gels, in addition to bladder wall films, polymers, and polymer foams. In classic footwear construction, the sole may also be leather with organic material padding.

The upper is typically leather, nylon, canvas, or other low compliance sheet. The upper has an opening for the foot, which is closed after foot insertion by laces, Velcro straps, buckles, or the like. Known systems for improving fit include pumpable air bladders, which may be in the tongue, ankle collar, or other areas.

The present invention provides improvements over known designs in a number of areas. An intelligent adaptive conformation system may be provided to provide a good static fit. This may be established by equalizing static pressure on significant contact areas, e.g., in the sole of footwear over the entire sole of foot, or separately the heel, toe area, instep, lateral edge of foot, upper, etc., or in the upper over the whole foot or selected regions, the toe, medial aspect, lateral aspect, Achilles tendon region, ankle, etc. In this way, a single passive valve may be provided to redistribute and equalize pressure over the region. After the static pressure is equalized, it is maintained until reset.

However, greater control is provided by having a compressor with a selectively operable valve for each region, allowing direct control over the shoe conformation. With such a system, if the foot changes size or shape, as may happen during protracted exercise, the system may properly adapt. Further, the optimal applied pressure may differ for different regions of the foot, and may change over time, making passive control difficult. In the upper, the fit is preferably adjusted by air bladders having a relatively low void volume. In the sole, as discussed above, a high pressure pneumatic or hydraulic system may be provided. Since these have different operational characteristics, it may be preferable to separate these functions.

Since fit is typically achievable without automated control, this aspect of the adaptive footwear design may, in many instances be avoided. Cases where fit control may be important include rigid boots, such as ski and skating (ice, roller blade, etc.). The energy source for active fit control may be a compressed gas cylinder, spring or other mechanical energy storage component, electric motor or other actuator, combustor, compressor based on foot activity, or other type.

In many types of footwear, active fit control is not necessary, such as a properly fitted sneaker. In this case, modulation over dynamic aspects of the system may be more important. These dynamic aspects include, for example, transient response, resonant frequency(ies), compliance, damping, and energy recovery. The compliance of various controlled elements may be controlled by adjusting a gas void volume upon which a force acts, the greater the gas volume, the greater the compliance. Polymer walls also have compliant properties. The compliance of an actuator segment may therefore be adjusted by varying a fluid/gas ratio within a fixed volume, or by expanding an available gas space available for a force. Typically, the compliance of a region will not be adjusted rapidly. The control may be, therefore, a microvalve associated with a tube selectively extending to a gas space. The microvalve may be provided in an array, thereby allowing consolidated control over all zones. In order to control damping, an energy loss element is provided. This energy loss element acts directly or indirectly on forces within the shoe. For example, in some circumstances, efficient energy recovery from locomotive forces is desirable, and the damping should be low. On the other hand, often, a motion is not repetitive, and therefore rebound will lead to instability and excess force transmission to the joints. Therefore, control over damping is desirable. Similar considerations apply to automobiles, and therefore similar, though larger, systems are found in that field. In order to control damping, a fluid is passed between two chambers, with a restriction therebetween, energy is lost as the fluid passes the restriction. The restriction may be asymmetric, providing a different degree of restriction as the fluid passes in either direction. Control over the damping is exerted by controlling the degree of restriction. As with a controllable damping system, the damping may be controlled with a microvalve, more particularly a proportionally controllable valve. Such proportional control may be provided by a single valve structure with partial response, a valve structure capable of pulse modulating the flow, or a set of microvalves which in combination set the flow restriction. In fact, the compliance and damping may be integrally controlled, or controlled through a single array or microvalves.

As stated above, in a preferred embodiment, at least a portion of the cushioning energy is recovered, with the release thereof controlled by a control system. Thus, while the footwear system may employ dissipative damping, preferably a portion of the energy is captured and employed in operating the footwear system(s) and/or assisting the wearer in activities.

In order to control the microvalves, a microprocessor is provided. The microprocessor is powered by an electrical source, for example a primary or rechargeable battery, super-capacitor (e.g., Ultracapacitor PC223 or PC5 by Maxwell Energy Products, San Diego, Calif.), or generator. Preferably, an electrical generator activated by locomotion charges a super-capacitor, which powers the microprocessor and microvalves. See, U.S. Pat. No. 5,167,082, expressly incorporated herein by reference. The electrical generator preferably is activated by sole dorsiflexion, asymmetrically on flexion. This arrangement allows energy capture during running or walking, and therefore assures a reliable energy supply during use.

Where a reliable hydraulic compressor is required (that is, one which is reliably activated under various gait patterns), it preferably is actuated by sole flexion, for example by the elongation of the sole during dorsiflexion of the foot. Where a pneumatic compressor or walking activity dependent compressor is required, it preferably is actuated by a bladder near the heel. Preferably, such compressors are themselves controlled in terms of release of compressed air or fluid, to control the compliance and damping of the shoe. A running activity dependent compressor may be run off a toe region bladder or a dorsiflexsion compressor.

In further refining shoes for comfort and ergonomic factors, temperature control is important. Known systems provide a flow of air through the shoe to facilitate perspiration evaporation. However, these systems generate "squish", and may be subject to clogging, etc. According to one embodiment of the present invention, a facilitated heat transport or active refrigeration system is provided, especially under non-porous surfaces, such as bladders and below the foot.

The first step in providing an adaptive control system is to provide appropriate sensors to detect the status of the condition to be sensed. There are typically two control strategies; first, actuators and sensors are paired, with the sensor measuring very nearly the variable altered by the actuator, allowing simplified closed loop control over the operation of each actuator, and a distributed sensor network with no one-to-one relationship with the actuators. According to the present invention, both strategies may be employed, in various portions of the system. In most cases, the operation of the system is predictive; that is, the system defines its mode of operation prior to actually being subject to the usage condition. This adaptivity can be on a step-by-step basis. The control bases its prediction on an express user input or an algorithm that allows it to predict the user's intent, without the direct input. The user may also provide a feedback signal to correct the operation of the system, or to tune the predictive algorithm. The controller itself is preferably a low power microcontroller of known type with integrated peripherals. A fail-safe circuit may be provided as a part or extrinsic to the microcontroller to assure that under typical failure conditions, the footwear is usable in an appropriate manner. Thus, a completely uncontrolled mode of operation, such as in the event of microcontroller failure or power supply exhaustion, should be available in which the footwear is usable.

In order to sense the plantar surface of the foot, pressure sensing matrix may be provided within or adjacent to the padding within the shoe. This may be a pressure sensitive resistor, a pressure responsive capacitor array, a Hall effect sensor, a permanent magnet and coil, a piezoelectric transducer, or the like. In the upper, on the other hand, the sensor array may provide a sensor associated with each actuator zone. Preferable, the actuators in the upper are relatively orthogonal (one actuator principally controls a state within an associated zone, regardless of the states of other actuators), while in the sole it is likely that adjustments will be interactive.

In order to sense gait cycle, one or more sensors may be placed in the heel and sole to sense the pressure distribution.

A microprocessor with an integral analog data acquisition system is, for example, provided within the structure of the sole. This microprocessor may have both volatile and non-volatile memory, and an interface for controlling the various actuators. A lithium battery, for example, provides a continuous or backup power source, while a "generator" within the shoe provides power during vigorous use, for example to drive the actuators. Typically, the microcontroller provides a control signal to the actuators, which are themselves directly powered by the user.

While the device is active, a compressor network driven off use of the shoe is the motive force for altering the fit; the microprocessor merely controls a set of valves and regulators, rather than the compressor itself.

An adaptive fit embodiment preferably provides two distinct systems for adjusting the fit of the shoe. First, a hydraulic system is used to fill bladders for contour and piston actuators for tensioning. Second, a pneumatic system is used to fill bladders and reactive energy chambers within the sole for control over dynamic properties and pressure around the foot. The hydraulic pump is a piston structure driven off flexion of the sole. As the toes flex upwards (dorsiflexes), a strap in the sole acts to cause a cylinder to pressurize a working fluid in the mid-sole of the shoe. The natural recoil of the shoe (and/or assisted by a spring) extends the cylinder for a subsequent operation. With respect to the pneumatic compressor, a pancake shaped bladder is formed near the heel of the shoe. As weight is applied to the heel, the bladder pressurizes. A set of check valves controls flow direction. Rebound of the pump bladder is by way of a proximate gas pressurized toroidal ring.

The hydraulic system is capable of operating at up to 300 psi operating pressure at the pump, while the pneumatic system has a typical peak operating pressure of 15–25 psi. Transient pressure peaks due to activity may exceed 1000 psi in both instances.

In one embodiment, the sole of the shoe, below the pressure sensing pad, includes a set of hydraulic bladders, For example, four anatomical zones are defined, each having a bladder space. A set of pneumatic structures is also provided within the sole; however, these are preferably static, as is conventional. If desired, one or two pneumatic structures within the sole may be dynamically controlled during use, for example to balance energy recovery and stability. The upper preferably has a set of hydraulic actuators which tension the upper material to assist in achieving a desired fit. Each tensioner is preferably associated with a sensor, which may be a mechanical sensor near the points of action or a hydraulic pressure sensor at any location within the hydraulic circuit to that tensioner. For example, three to six tensioners may be provided on the upper.

The upper may also include static or dynamic air bladder structures. Each air bladder structure in the upper is associated with a respective relief valve. These relief valves may be automatically or manually set. Preferably, these relief valves include a dynamic suppression so that transient pressure increases do not deflate the bladder. The bladders may therefore be filled to relief pressure by compression of the pneumatic compressor and thus maintained in a desired state.

The preferred control for both hydraulic and pneumatic systems is a piezoelectric valve system, similar to that employed in an ink jet printer. See U.S. Pat. Nos. 5,767,878; 5,767,877; and 4,536,097, expressly incorporated herein by reference. In order to generate drive voltages, a piezoelectric element, e.g., PVDF or ceramic, may be excited by movement of the shoe.

In order to provide individual control over the various actuators and bladders, a rotary valve system may be provided in the mid-sole area. See, e.g., U.S. Pat. No. 5,345,968. Flexion of the sole not only pressurizes the hydraulic fluid, it may also be employed to generate an electric current and changes the position of the rotary valve. Alternately, the rotary valve may be electrically controlled, separate from the flexion. Thus, each step allows a different zone of the shoe to be adjusted. Since the hydraulic and pneumatic systems are separate, each position of the rotary valve allows separate actuation of a respective hydraulic and pneumatic zone.

Since the hydraulic pump and pneumatic compressor are not subject to direct control, the microprocessor provides a regulator function to control a zone pressure and a controllable check valve function to maintain a desired pressure.

Certain zones may be interactive, i.e., the controlled parameter is sensitive to a plurality of actuators (bladders, pistons, etc.), and each actuator will have effects outside its local context. Therefore, in order to achieve a desired conformation, the actuators must be controlled in synchrony. While it may be possible to sequentially adjust each actuator without a priori determining the interaction, this may result in oscillation and prolonged settling time, discomfort, and waste of energy. Therefore, the microcontroller executes an algorithm which estimates the interaction, and precompensates all affected actuators essentially simultaneously. As discussed herein, a preferred embodiment employs a sequential multiplexed valve and compressor structure. Therefore, as each valve position is sequentially achieved, an appropriate compensation applied. The predictive algorithm need not be perfect, as the effect of each compensation step may be measured using the sensor array, and thus the actuator controls may be successively refined to achieve an optimal configuration.

In a first order approximation, at least, the effects of actuators will be superposable. Further, each actuator will typically have a control function which approximates the function $f(x)=\cos(\omega x)e^{-bx}$, where x is the absolute distance from the actuator center, ω is a periodic spatial constant and b is a decay constant. The resulting function therefore provides a long range effect of each actuator, which is periodic over distance. The interactivity of actuators may be analyzed using a Fourier type analysis or wavelet analysis.

The actuators are intentionally made interactive; if there were no interactivity, there would necessarily be a sharp cutoff between actuator zones, which would likely cause discomfort and shifting of the foot, or the zones would be spaced too far apart to exert continuous control. By spatially blending the actuator effects, spatially smooth control is possible.

In one embodiment, the pneumatic compressor system is also employed to cool the foot. This cooling may be effected directly by air flow, or by developing a refrigeration cycle, using heat exchangers within the shoe and external to it.

Under some circumstances, it may be advantageous to employ a refrigerant gas, such as a hydrofluorocarbon (HFC), within the pneumatic chambers, pressurized such that under load, the gas enters a nonlinear range. Thus, in this nonlinear range, the properties of the refrigerant do not approximate the ideal gas law, providing a cushioning option not directly available with air or gels.

One type of generator which can be provided within the shoe comprises a magnet which spins in response to a flexion of the sole. In one embodiment, a gear arrangement is provided with a unidirectional clutch, allowing the magnet to retain its inertia over a series of actuations. The magnet interacts with a coil or set of coils, the output of which is rectified and the electrical energy stored in a high capacity, low voltage capacitor (e.g., a so-called supercapacitor or ultracapacitor) or an electrochemical battery. Alternately, a linearly moving magnet generates a varying magnetic field within a coil. Piezoelectric transducers may also be used to extract electrical power from gait.

A rotary valve, if provided, may be actuated mechanically by the flexion of the sole. Alternately, a "pancake" stepping motor or shape memory allow actuator (see, U.S. Pat. Nos. 5,127,228 and 4,965,545, expressly incorporated herein by reference) may also be employed to rotate the valve body, potentially allowing random access to any desired zone. The stepping motor is actuated and controlled by the microcontroller.

As an alternate to a rotary valve, an array of electromagnetic or micromachined valves may be provided, selectively controlling individual zones. Preferably, such valves have low static power dissipation.

Present micromachining and photolithographic fabrication techniques make possible miniature, low cost pneumatic and hydraulic control structures. Therefore, in accordance with one aspect of the present invention, micromachined structures are used to control flows. Some valve types are capable of both low leakage and wide dynamic range operation. Others suffer from either excessive leakage or non-linear response. Therefore, it is possible to employ two valve types in series, one to block leakage and the other to provide proportional control over flow. Further, micromachined valve structures typically are limited in maximum flow capacity and flow impedance. A preferred microvalve structure employs a nickel titanium alloy "shape memory alloy" ("SMA") actuator to control flows. Such a device is available from TiNi Alloy Co. (San Leandro, Calif.). In these systems, an electric current is controlled to selectively heat an actuator element, which non-linearly deforms as it passes through a critical temperature range, which is typically between 50–100 degrees C. Thus actuator unseats a valve body, controlling flow. The memory metal actuator is formed by a vapor phase deposition process and then etched to its desired conformation. The actuator has relatively low power requirements, e.g., 100 mW per element, and is capable of linear flow modulation. The response time is about 1 mS to heat, and 1–10 mS to cool, depending on the ambient temperature and heat capacity, e.g., whether the environment is liquid or gas. The system may be readily formed into microarrays. Importantly, the system readily operates at logic switching voltage levels, facilitating direct interface with electronic control circuitry.

Therefore, for example, if the microvalve array has an active duty cycle of 25%, with two elements active during each cycle, and the system has an operating voltage of 3V, the average current draw will be about 2×100 mW/4=50 mW, with less than 20 mA draw. A 1350 mAH rechargeable lithium battery will therefore have a life of about 70 hours. Of course, there may be other demands on the power supply, but there may also be a real-time recharger. Thus, the system is not untenable to operate from available power.

Depending on cost and other architecture factors, an array of selectively operable microvalves may be present in place of the rotary valve mentioned above. In this case, it is possible to have one or more microvalves open at any time. As discussed in more detail below, a second valve function controls the dynamic response of the system. In this case, the dynamic functions may be controlled by the same valve as the setpoint (static operating condition), or preferably by a second valve structure. This second valve structure facilitates separate control over the static and dynamic parameters of the system. By separately and simultaneously controlling a damping coefficient, and a resonant frequency of a footwear structure, the footwear can be tuned for different users and different conditions of use.

An array of microvalves may be provided in a single integrated structure. The microvalve structure may act alone or in concert with another valve structure, such as the aforementioned rotary valve.

The hydraulic system within the sneaker may also be operated by an electrical pump. Both traditional and subminiature designs may be employed. See, U.S. Pat. Nos. 5,362,213; and 4,938,742, expressly incorporated herein by reference. In this case, the system is capable of adjusting actuators even in the absence of foot movement. A preferred pump is a gear pump (or variant thereof, which provides a small number of moving parts, relative ease of hermetic sealing, no reciprocating movement, high pressure differential capability, and may be adapted to the torque/speed characteristics of an electrical motor. The preferred electrical motor is a brushless DC design, preferably with a moving magnet (rotor) integrated with the gear pump, allowing a hermetic seal. The coils (stator) are located outside the fluid space, and are controlled by the microprocessor. The position of the rotor may be sensed with a hall-effect transducer, optical sensor through a transparent wall of the pump, or other known means.

Where the pump is electrically driven, a generator within the shoe is advisable, in order to maintain operation over extended periods. If the pump is electrically driven, the generator system may then absorb all available energy from the shoe, i.e., from flexion of the sole and/or compression of the sole portions. The sole flexion comprises a reciprocating motion, and thus may be used to drive various types of electrical generation systems. On the other hand, the compression of the sole may also be directly used to derive energy. For example, piezoelectric or electret elements may be used to draw electrical power, although typically these types of elements generate high voltages. Many types of athletic footwear have air cushions in the sole. Often, these are employed to store and release energy, thus absorbing shocks while returning energy to the user. However, it is often useful to provide a degree of damping of these pneumatic elements, in order to increase stability and reduce overshoot. Therefore, an amount of air may be drawn from the pneumatic element and used to drive an electric generator, such as a gear pump or other device. Therefore, at least two distinct sources of electric power may be used. Preferably, the system employs synchronous rectification of AC signals, especially those induced in a coil by a cyclically varying magnetic field. While an intrinsic control system may be employed, the microcontroller may also be used to generate switching signals. The microcontroller derives the timing for the switching based, e.g., on sensing the voltages or pressure signals (from pressure sensors in the sole, etc.).

The high voltages generated by piezoelectric or electret elements may be used, for example, to drive high voltage devices, such as piezoelectric or electrostatic valve elements or actuators, electroluminescent devices, fluorescent devices, or the like.

Typically, during use, the adjustments made to hydraulic devices will be small, and changes acceptable if made over period on the order of minutes. Therefore, a microvalve structure may be useful without assistance under these circumstances. However, during startup, the compensation volumes will be larger and the acceptable timeframe for adjustment shorter. This suggests that a separate system be available for initial adjustment, with dynamic control maintained by the microvalves.

As stated above, in order to miniaturize the actuators, and provide tolerance for strenuous activity and sudden shocks, the working pressures of the hydraulic actuators may be, for example, 300 psi, with the operating pressure of the pump and proof pressure of the actuators significantly higher. However, materials are readily available which will support such stresses. It is important that the actuators have low leakage and sufficient lifetimes. This may be assured by using "exotic" materials, such as ceramics (e.g., silicon nitride, alumina, zirconia) and diamond-like coatings. However, these "exotic" materials are becoming more commonplace, and are used in relatively small amounts in a shoe, making their use commercially acceptable. Of course, known high performance polymers and materials formulated therefrom may provide acceptable performance without the use of exotics.

In principle, each actuator serves as a tensioner. In fact, the actuator may be mounted resiliently, increasing user comfort and reducing stresses on the device. By providing carefully controlled resiliency, which may be provided by a well defined spring, elastic element, pneumatic element, gel, and/or dashpot, the remaining elements may be relatively noncompliant, providing the designer with increased control over the dynamic response by adjusting the mounting system. Likewise, the actuator and mounting may also be non-compliant, with the dynamic response controlled through the hydraulic system, e.g., a compliant accumulator or variable rate leakage. Therefore, using microvalves, both the operating point and dynamic response of the system may be controlled. It is noted that, unless a pressure reservoir is maintained, typically the dynamic response is limited to a "leakage" of fluid from the hydraulic line. Since it is unlikely that the integral pump in the sole can maintain a supply of pressurized fluid sufficient for heavy activity, it is important that the shoe employ a dynamic energy recovery system so that after a transient, the system naturally returns to its setpoint without addition of energy to the system.

Because of the inherent compliance of gas, it is far more difficult to independently control the setpoint and dynamic response of an air-filled bladder. Thus, the control strategy for these elements is different than the hydraulic elements. Likewise, because of the incompliance of hydraulic elements, the dynamic response of the system incorporating these elements must be specifically addressed.

Air bladders are typically used to cushion and ensure fit. Because of the interactivity of the fit adjustment and cushioning, it is difficult to control both simultaneously, and further, once a decision is made to use air to control fit, it is difficult for a designer to specify and control the cushioning. On the other hand, despite these shortcomings, air bladders are accepted and are considered comfortable and useful. According to the present invention, the comfort achieved by using an air bladder may be maintained while adjusting fit, by controlling fit primarily with a separate actuator, rather than by the volume of air within the bladder. Therefore, in a shoe upper, an air bladder may be relatively fixed in volume, and therefore a pump, if present, may be used to adjust the pneumatic cushioning, independent of fit.

In various parts of the shoe, air bladders may be used to control fit. For example, in the Achilles tendon area, the use of fluid may incur significant weight, and the use of actuators might be cumbersome. Therefore, air bladders are an acceptable solution, According to one embodiment of the present invention, heat is drawn out of the shoe. A number of passive and active means are available for this purpose. Typically, the upper of a shoe is relatively efficient at shedding heat to the environment passively, although the presence of pneumatic bladders interferes with this function. On the other hand, the sole of the shoe is a good insulator, and thus can sustain a significant temperature differentials. Therefore, any cooling system typically addresses the sole.

Various known cooling systems for footwear typically provide a pump driven by user activity to generate air flow within the shoe. This, however, generates a perceptible to difficult to control squish, thus reducing the utility of a sneaker as a high performance athletic tool, and potentially introducing instability. The present invention provides an active or facilitated heat transport mechanism preferably employing liquids or phase change media. See, U.S. Pat. No. 5,658,324; 5,460,012; and 5,449,379, expressly incorporated herein by reference. For example, a refrigeration cycle may be established using a compressor within the sole of the shoe. See U.S. Pat. Nos. 5,375,430; 4,953,309; 4,823,482; and 4,736,530, expressly incorporated herein by reference. See also, U.S. Pat. Nos. 4,800,867; and 4,005,531, expressly incorporated herein by reference. Other cooling methods are also known, e.g., thermoelectric. See, U.S. Pat. Nos. 5,367,788 and 4,470,263. Since this compressor operates at relatively high pressure, squish will be less noticeable, and may provide an advantageous damping effect. Excess heat is shed in an external radiator, while heat is absorbed in a heat exchanger in the sole. Footwear heating devices are also known; see U.S. Pat. Nos. 5,722,185; 5,086,573; 5,075,983; 5,062,222; 4,823,482; 4,782,602; and 3,935,856.

In contrast, where air bladders are provided, the heat transfer is preferably passive facilitated, employing heat pipe structures, to circumvent the barrier provided by the air bladder.

Where both control over the shoe and control over temperature are exerted, a common control system is preferably employed, and preferably further structures are shared. For example, the working gaseous fluid may be a refrigerant, such that the refrigerant provides both cooling and compression. Therefore, a single compressor may be employed for both functions.

Advantageously, the air bladder in this case is formed as a three layer structure; a pair of layers proximate to the foot defining a serpentine flow passage, and an outer layer forming an overpocket with the middle layer. The overpocket preferably has a pressure relief valve to control the back pressure and allow continuous flow of gas.

The user interface for the adaptive footwear is preferably minimal, i.e., the user has basically no control over operational parameters. However, in some circumstances, it may be desirable to allow the user to control parameters. Preferably, the user interface in that case is hand-free, for example using a voice input device, such as available from Sensory, Inc., Sunnyvale, Calif.

An electronic pressure relief valve may employ, for example, a solenoid valve, thermally activated microvalve, piezoelectric valve, or the like, which is activated by a control, based on a pressure sensor. The pressure sensor need not be located at the relief valve location, thereby allowing the system to compensate for various intervening structures which might alter the pressure seen at the valve as compared to the pressure seen by the tissue. The tissue pressure is presumed to be the relevant factor, and thus a sensor may be provided immediately adjacent to the skin. The pressure sensor may be, for example, an air pressure sensor reading the pressure of a bulb, a force sensing resistor, a pressure responsive capacitive sensor, or other known type. A force sensing resistor may be constructed, for example by providing a compressible polymer loaded with tin oxide, available commercially from Interlink Electronics, Inc. A force sensing capacitor may be constructed by forming conductive electrodes on the surface of a compressible dielectric, for example a polyurethane foam. The electronic control may also be used to provide an alarm indication if the relief valve malfunctions, or if the tissue pressure is high despite a relief of pressure in the bladder. It is also noted that if a single electronic control may be used for the entire device, and therefore all aspects of the operation of the device may be integrated and controlled together.

It is noted that, in another configuration, the energy storage and recovery system may be employed to assist disabled persons with impaired gait. Thus, for example, the stored energy may be applied to a cable or strap mechanism to assist in lifting the off the ground during a toe-off phase of gait. By applying a torque to dorsiflex the foot, for example by applying a tensile force between a point above the ankle and the top of the toe, dragging of the toe and associated limping can be reduced. The trigger for applying this torque is, for example, a forward inclination of the shoe, a maximum bending of the sole, a slip of the toe against the ground, or a rapid release of pressure on the toe indicating a foot lift.

BRIEF DESCRIPTION OF THE DRAWINGS

The invention is shown by way of example in the drawings, in which.

DETAILED DESCRIPTION OF THE PREFERRED EMBODIMENTS

Example 1

Cooled Footwear

Figure 1:
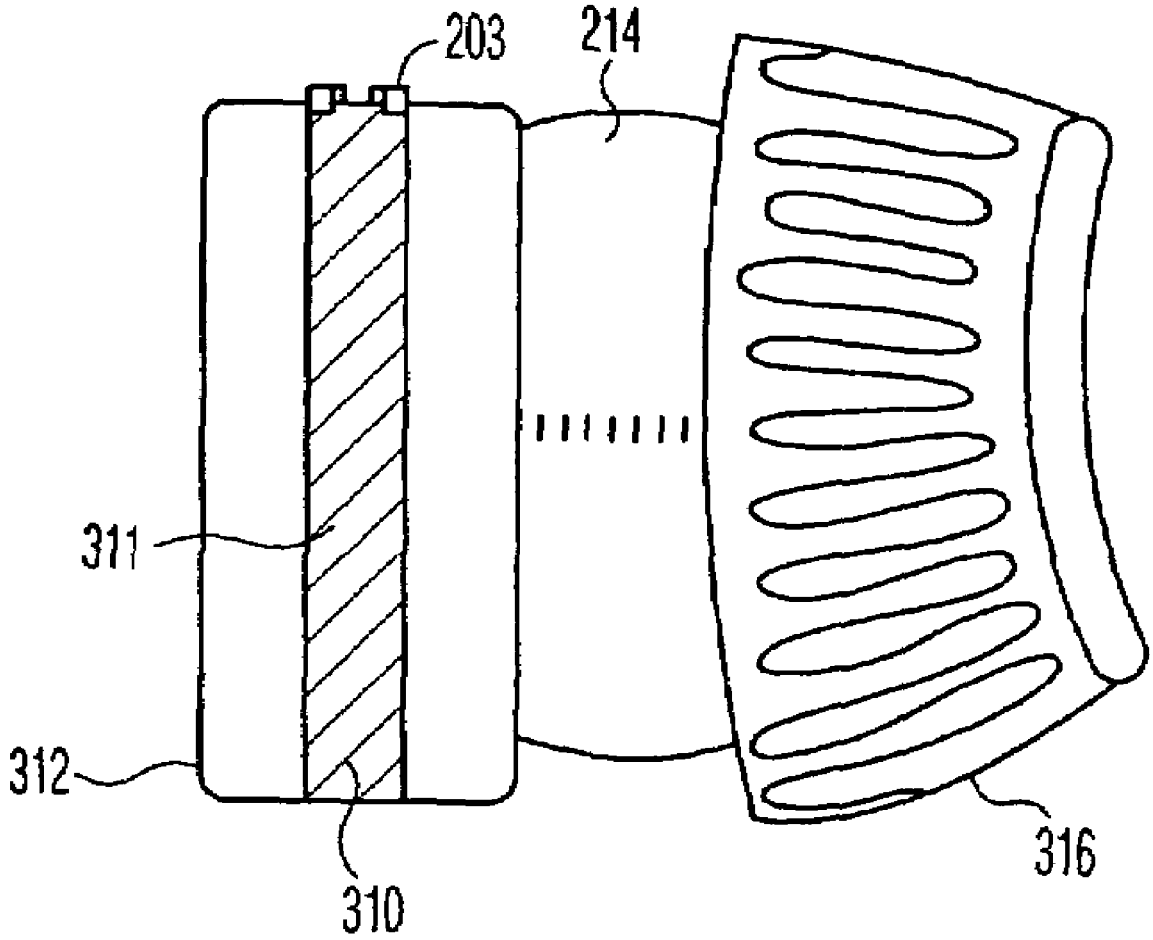
FIG. 1 is a rear view of a liquid to air intercooler according to one embodiment of the present invention, for use in cooling footwear.

In garments or footwear, the operating temperatures are generally about 30–45 degrees C. on the body side and about −20–+40 degrees C. on the external side. In general, cooling may be desired when the body temperature is above 37 degrees C. and the external temperature is above 10 degrees C. Below these temperatures, cooling by active or facilitated means may not be necessary or desirable.

It should also be noted that after a short period, footwear reaches a temperature steady state, with the metabolic heat from the foot transferred to the environment, so that the rate of production equals the rate of withdrawal. Therefore, in an active or facilitated heat removal system, the amount of heat to be radiated is of the same order of magnitude of heat shedding as a normal shoe. Thus, the radiator need not be very large in comparison to the shoe, nor operate at substantially elevated temperatures over that normally achieved in a shoe under normal circumstances.

Under circumstances where the environmental temperatures are very low, it may be desirable to provide heat to the body, instead of removing it. In such a case, many of the principles discussed herein may be used to provide active or facilitated heating, albeit with a modified arrangement. Thus, for example, heat may be supplied from the environment or from other body parts to a cold extremity through a heat exchanger. For example, a heat exchanger integrated in a sock may be used to draw heat to the foot.

In a preferred embodiment, a closed cycle refrigeration system is provided within a shoe, having a compressor, condenser, evaporator and metering valve, as more fully described below.

The present invention may also be implemented as an electrically operated pump, which serves to operate a heat pump. Refrigerant is compressed by an electrically operated pump, which heats the refrigerant. The pump may be a turbine or positive displacement type. Preferably, the electrical system is supplemented by mechanical energy from the use of the footwear, or the electrical power source is recharged by use of the footwear. In a turbine pump, the pumping element rotor may be magnetically coupled to the stator through a diaphragm. The rotor spins at high speed to compress the vaporized refrigerant. The hot compressed refrigerant flows through a radiator, which cools and condenses the refrigerant. The condensed refrigerant is stored in a reservoir, and released to a cooling matrix in proximity to the foot where it vaporizes and cools the foot. Vaporized refrigerant is returned to the pump. The pump may also be a positive displacement type, where a piston or variable volume chamber is provided which pressurizes the refrigerant. The piston and cylinder are preferably hard materials, such as metal, glass, ceramic or certain plastics. A variable volume chamber may be provided as a diaphragm pump.

An electrically powered embodiment according to the present invention is preferably powered by lithium ion rechargeable, lithium polymer, nickel metal hydride rechargeable or alkaline (disposable or rechargeable, available from Rayovac). Alternatively, zinc-air batteries may be employed, as either primary cells or as rechargeable cells.

Rechargeable batteries may be recharged by an inductive coupling charger, with appropriate circuitry embedded in the footwear, or by direct electrical contacts. For example, two AA size primary alkaline cells may be provided in the heel of the footwear, which are replaceable through the side or rear of the heel. An electronic controller may be provided to control or modulate the motor, based on an open loop or closed loop control program. In a closed loop program, a temperature or temperature differential may be maintained. In an open loop control, a constant or time varying activity of the motor may be provided.

As a further embodiment, an electrochemical cell or cells having an intrinsic Peltier thermoelectric junction may be employed. In such a system, the cell is activated, and allows a current to flow. This current cools one thermoelectric junction and heats another. Advantageously, these thermoelectric junctions are integral to the battery and form part of the electrochemical structure as well. Thus, a self-contained, high energy density unit may be provided for one time use.

It is also possible that such an integral thermoelectric-electrochemical cell may be rechargeable. The cooling cell, in this case, is likely formed as a heel insert. The high temperature junction dissipates heat preferably on the sides and rear of the footwear.

When a motor is provided, the external heat exchanger for shedding heat energy may be on an external portion of the footwear, or internal and provided with an air flow system. Thus, the external heat exchanger may be provided internally to the footwear, with a blower driven by the same motor as the pump. It is preferable that the air flow from front to rear of the footwear, so that normal movements of the wearer assist in heat removal. However, the air may move laterally, or be drawn from within the footwear, withdrawing additional heat. The blower may be a turbine or propeller type, having a large flow volume and lower pressure operating characteristic. The air flow may also be derived entirely from movements of the wearer, such as by providing a mechanically operated air pump driven by each footstep.

The independence from conditions of use is particularly important for footwear, which may be subjected to significant stresses or shocks. For example, the cooling matrix may be provided in or as a part of a cushion below the foot. In such instance, the external pressure on portions of the matrix may vary from zero to about 2000 psi in short periods, such as during sports use, e.g., walking, jogging, running, hiking, technical climbing, basketball, football, baseball, soccer, lacrosse, tennis, badminton, racquetball, squash, handball, field and track sports, aerobics, dance, weightlifting, cross training, cycling, equestrian sports, boxing, martial arts, golf, bowling, hockey, skiing, ice hockey, roller skates, in-line skates, bowling, boating and rowing. Business or occupational use will also subject the footwear to pressure transients, such use including industrial use, carrying, lifting, office use and the like.

It is understood that footwear is available in various sizes, and that the cooling requirements may vary for shoes of differing sizes and for differing purposes. It is also possible to determine for each individual an optimized flow path and/or flow characteristics, by using a sensor to determine the shape, perfusion and heat transfer characteristics of the foot, and creating a flow path in the footwear, i.e., in the sole portion, or the upper portion, or both, corresponding to the cooling requirements. Thus, the footwear may be custom designed for the wearer. Advantageously, the customization occurs by way of a module which is selected or fabricated for the wearer, which is inserted into footwear of the correct size and style.

In a one embodiment of the invention, a closed cycle refrigeration system is provided for the footwear, which may be recharged from an external reservoir of refrigerant, in the case of leakage. Various types of footwear may be cooled, including athletic and vocational footwear, as well as casual and formal shoes. The cooling system, or portions thereof, may also be provided extending to up the ankle, for example in socks, shin guards, leg splints, casts, bandages, innersoles, knee pads, and "leg warmers".

The external reservoir preferably has a valve, to selectively allow release of contents, which will be pressurized at normal environmental temperatures due to the vapor pressure of the refrigerant. The refrigerant is, for example, 1,1,1,3,3,3,-hexafluoropropane [R-236fa; [$CF_3$—$CH_2$—$CF_3$; C.A.S. No. 690-9-1] or octafluorotetrahydrofuran [c-$(CF_2)_4O$; C.A.S. No. 773-14-8], each of which has a boiling point around 0 to −1 degrees C.

Figure 2:
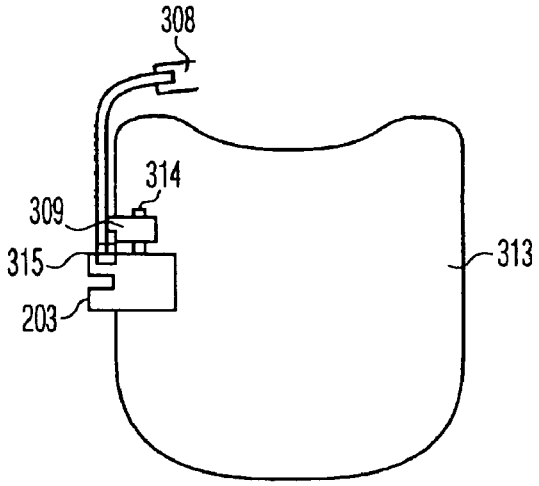
FIGS. 2 and 3 are top schematic views of local reservoirs for refrigerant according to the present invention.

As shown in FIG. 2, an internal reservoir 313 within a heel structure of footwear is provided, for example located and constructed to be insulated from undue effects of the mass of the wearer and various activities, such as walking, jumping and running and other activities as known in the art. A pressure relief valve 309 may also be set at a relatively high pressure, above that which would be seen under such conditions, or provide dynamic suppression so that an high pressure impulse duration would be required for relief. The reservoir is preferably located in the heel 312 of the footwear 204 shown in FIG. 1, so that the characteristics of the footwear 204, other than a weight change, should not be substantially altered when the reservoir is in various states of fill. Thus, a relatively stiff wall structure is preferred, with the mechanical properties determined primarily by other structures and elements of the shoe. Alternatively, the reservoir may be located in proximity to the upper portion of the footwear, e.g., a canister located behind the heel of the footwear or in the ankle padding.

The internal reservoir 313 of the footwear 204 preferably has one or more outlets 314, which are controlled by a primary flow control system 315. This system may optionally block flow when there is no foot in the footwear 204 by detecting whether the footwear 204 is being worn. If there is no foot in the footwear 204, release of refrigerant 208 from the internal reservoir 313 is blocked. A manual override may also be provided. Thus, if the internal reservoir 313 contains compressed refrigerant, an immediate precool will result from putting on the footwear.

The flow of refrigerant from the internal reservoir 313 is caused by a pressure gradient, which is induced by a pump and vapor pressure of liquid refrigerant. The pump compresses refrigerant vapors above a critical point, heating and pressurizing the refrigerant. A condenser structure is provided, which sheds heat to the environment, leaving a pressurized, cooled refrigerant liquid. A heat exchanger 316 may act as the condenser, and is preferably provided distal from the foot and the cooling matrix so that the heat released by compression and/or condensation does not counteract the cooling function of the system. For example, the heat exchanger may be provided behind the heel or on top of the foot above an insulating layer.

The pump generates a pressure of at least 50–85 psig. Thus, a 150 pound person would exert 150 pounds static over a one square inch compressor "piston". Dynamic pressure during activity will be higher, e.g., over 300 psi, but of shorter duration. The optimal location for the pump is near the ball of the foot, behind the big toe. Using the aforementioned preferred refrigerants, the volume, at standard temperature and pressure, of gaseous refrigerant to be processed is about 15 ml/min per Watt heat energy to be transferred. Thus, each shoe, assuming 30 compression cycles per minute, would have to compress 0.5 ml per compression cycle per Watt, or about 2.5 ml per compression cycle for 5 Watts cooling capacity. This 2.5 ml capacity is achieved, for example, with a compressor having a diameter of about 2.5 cm and a stroke of about 0.5 cm. These parameters are within an achievable range.

Figure 3:
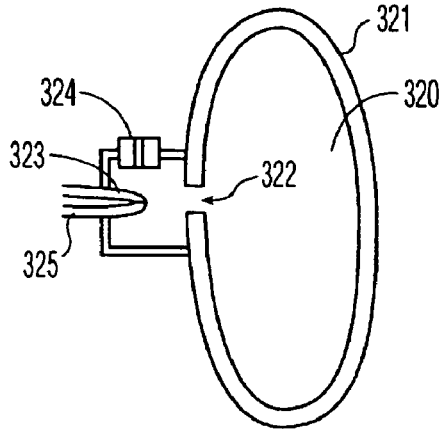

A reservoir may be formed in the heel portion of footwear, especially athletic footwear, in the form of a balloon or bubble. This reservoir may be formed in four different ways:

According to one embodiment, shown in FIG. 3, the reservoir is an ellipsoidal chamber 320, formed of a high tensile strength polymer, which may be polyurethane, polyvinyl chloride, PET, polystyrene, nylon, or other known polymers. Further, the wall 321 of the ellipsoidal chamber 320 may be reinforced with fibrous material, such as Kevlar®, nylon, fiberglass, ceramic fiber, glass fiber, carbon fiber, steel wire, stainless steel or other metallic (ferrous or non-ferrous) or other known high tensile strength material fibers. In a preferred embodiment, the chamber is preformed with an aperture 322, which may include a valve structure 323, flow restrictor 324 and coupling 325. The ellipsoidal chamber 320 chamber is placed in a heel portion 312 of the footwear 214 at a central portion thereof, with a surrounding structure which has a high stiffness and low compliance. This surrounding structure preferably provides a mechanical support for the wall of the ellipsoidal chamber, preventing activity induced crushing of the chamber and equalizing the tension on portions of the wall 321. Forces are transmitted through the surrounding structure, bypassing the ellipsoidal chamber 320. Of course, the ellipsoidal chamber 320 may be employed to absorb certain shocks, so long as these so not exceed a rated (or derated) pressure or shock capacity of the ellipsoidal chamber 320.

Figure 4:
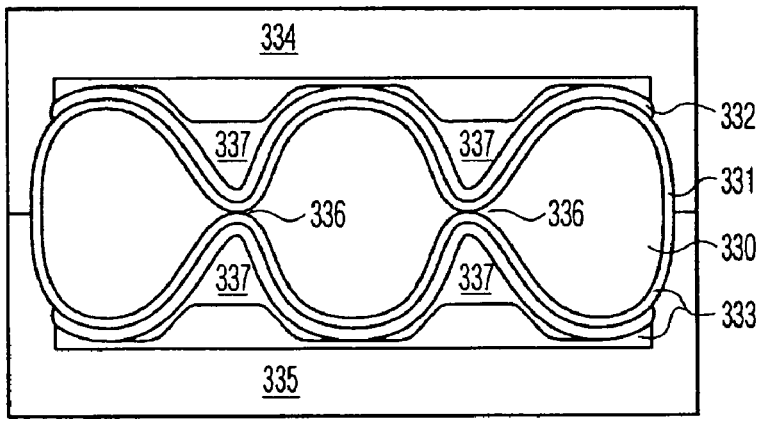
FIGS. 4 and 5 are, respectively cross section and top views of a local reservoir for refrigerant according to the present invention.
Figure 5:
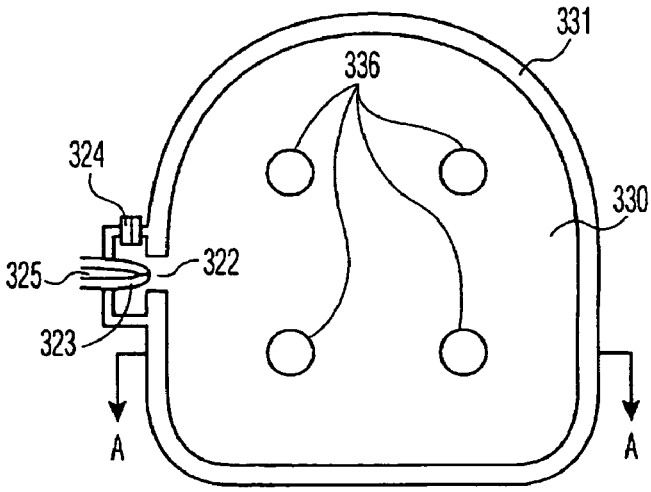

According an embodiment, shown in FIGS. 4 and 5, the flattened ellipsoidal chamber 330 is sandwiched between an upper 334 and lower 335 portions of the heel 312 of the footwear 214. These upper 334 and lower 335 portions include supports 336, which extend inward toward the flattened ellipsoidal chamber. During assembly, a support 336 extending from the upper 334 portion, a first optional layer 332, the flattened ellipsoidal chamber 330, a second optional layer 333, and a support 336 extending from the lower 335 portion are sealed together. The walls 331 of the flattened ellipsoidal chamber 330 corresponding to the supports 336 of the upper 334 and lower 335 portions of the heel 312 are sealed together, so that the resulting structure includes solid supports 336 which transmit forces through the heel 312, bypassing the flattened ellipsoidal chamber void space. These supports should provide stiffness along a vertical axis, although they may physically be oriented at an angle to provide lateral stability to the footwear. The optional layers 332, 333 may be heat sealed to form a four layer structure, which is not heat sealed at the supports to the upper 334 and lower 335 portions of the heel 312. The supports 336 in the upper 334 and lower 335 portions of the heel 312 may include a gas-filled space 337, filled with, e.g., air or nitrogen, to absorb shocks. These supports 336 allow externally applied forces and shocks to bypass the flattened ellipsoidal chamber 330; however, as noted below, the flattened ellipsoidal chamber 330 may also be involved in shock absorption to a limited extent. The upper 334 and lower 335 heel portions are formed to surround the flattened ellipsoidal chamber 330 with a high stiffness and low compliance frame, to provide a mechanical support for the wall 331 of the flattened ellipsoidal chamber 330, preventing activity induced crushing and equalizing the tension on portions of the wall 33 1, while directing forces through the surrounding structure. Of course, the flattened ellipsoidal chamber 330 may be employed to absorb certain shocks, so long as these so not exceed a rated (or derated) pressure or shock capacity of the system. The optional sheets 332, 333 may be of a reinforced material, preferably a heat sealable polymer, which conforms to the upper and lower surfaces of the chamber, providing support to the wall 331.

Figure 6:
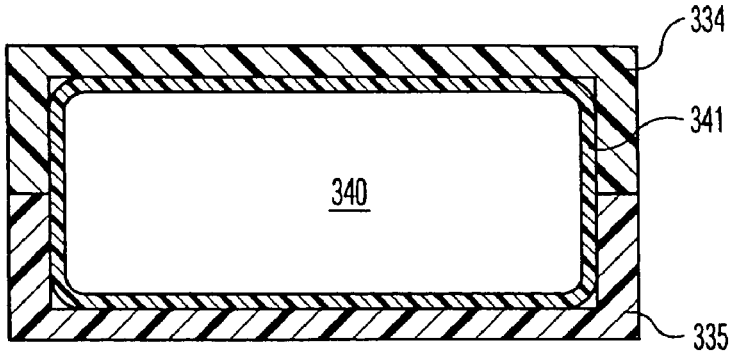
FIG. 6 is a cross section view of a local reservoir for refrigerant according to the present invention.

According an embodiment, as shown in FIG. 6, the reservoir 340 is formed as a space in a heel 312 structure of footwear 214, optionally with a sealing liner 341. The space may further contain or be filled with a supporting structure, which may be vertical or tilted supports or an open cell foam. The heel 312 may be formed by molding, lamination, heat sealing, adhesives, or other known methods. The space preferably has a wall which is smooth, without gaps where layers are joined. The heel structure is preferably formed of polyurethane, optionally with fillers and layers to provide additional strength. Thus, a chamber which is capable of withstanding high pressures is integrally formed in the heel. Known materials for providing high tensile strength walls include various reinforcing fibrous materials, such as Kevlar®, nylon, fiberglass, ceramic fiber, and steel mesh.

In the case where a sealing liner 341 is placed within the integral chamber, the sealing liner 341 preferably opens into a valve structure which includes a filling valve 323, an outward flow restricter 324 and optionally a pressure relief valve 309.

When no sealing liner 341 is present, the outward flow restrictor 324 may be separate from the fill valve 323 and optional pressure relief valve 309. Therefore, a small aperture, which may be a molded, machined or formed tube or passage, is provided extending through a wall of the chamber, which allows a controlled flow or refrigerant out of the chamber. Of course, an integral multifunction valve may also be provided which includes a filling valve 323, an optional pressure relief valve 309 as well as a controlled flow system to bleed refrigerant to the cooling matrix.

Figure 14:
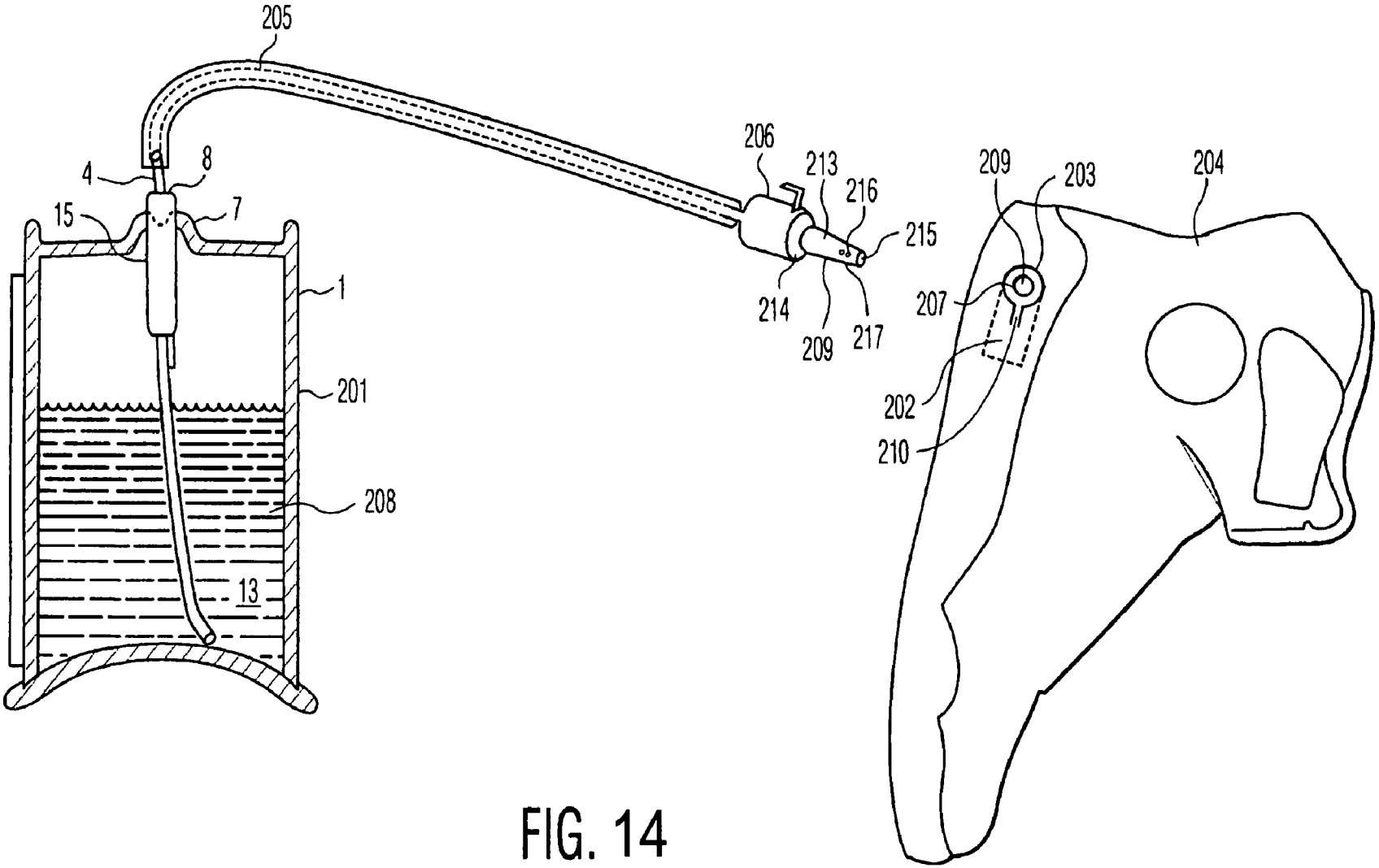
FIG. 14 is a schematic view of a footwear cooling system according to the present invention.

As shown in FIG. 14, a canister 1, holding refrigerant 208, is connected through valve 15 through conduit 205 to cannula 206. The cannula 206 is adapted to selectively transfer refrigerant from the canister 1 to the internal reservoir 202 of the footwear 204, without leakage, through valve structure 203.

In one embodiment, the chamber is formed between an upper and lower portion of the heel of the footwear. These upper and lower portions include supports, which extend inward toward the chamber, and may be vertical or inclined in order to provide stability, in the manner according to FIGS. 4 and 5. For example, when inclined laterally, these supports may provide desired lateral stability. During assembly, the upper 334 portion and the lower 335 portion are sealed together, preferably by RF heat sealing. A valve structure is also sealed in place near the instep region, which communicates with the space of the chamber. The upper 334 and lower 335 portions of the heel 312 may each be composite structures, to provide desired mechanical and sealing properties.

Figure 7:
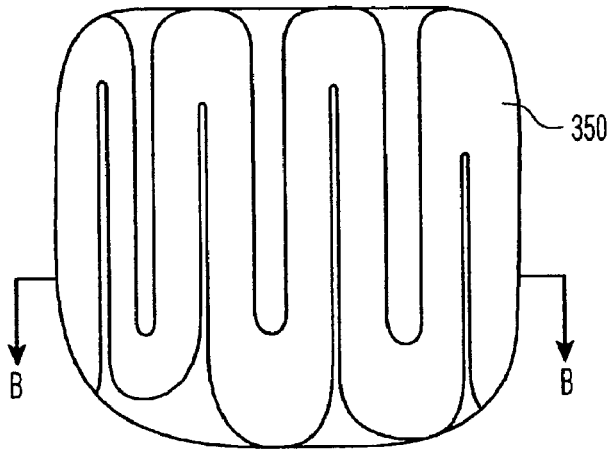
FIGS. 7 and 8 are, respectively, top and cross section views of a local reservoir according to the present invention.
Figure 8:
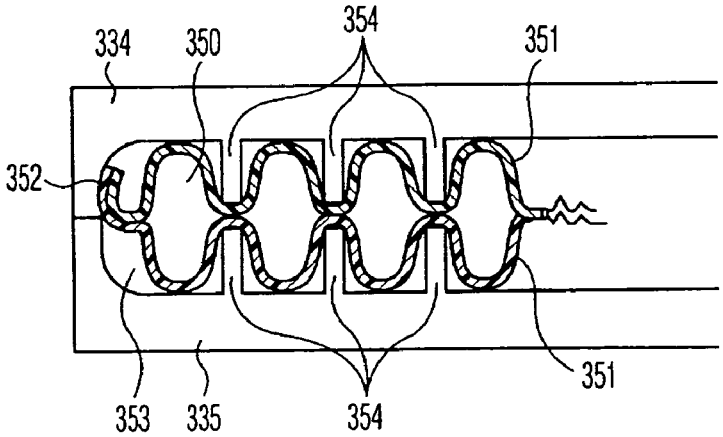

According an embodiment, as shown in FIGS. 7 and 8, the reservoir is a chamber 350 formed from two sheets 351 of flexible heat sealable polymer, preferably polyurethane. The sheets are preferably RF heat sealed together. A potential space exists between the two layers 351, which may be pretested for leaks. The sheets forming the chamber 350 may be reinforced with fibrous material, such as Kevlar®, nylon, fiberglass, ceramic fiber, or other known high tensile strength fibrous materials. In a preferred embodiment, the sealed chamber 350 is preformed with an aperture, which may include a valve structure 323, flow restrictor 324 and coupling 325.

The chamber 350 is placed during assembly of the heel structure of the footwear between upper 334 and lower 335 portions of the heel 312. The outwardly extending heat-sealed seam 352 of the sealed chamber is flexed and pressed against the wall 351 of the sealed chamber, which in turn is supported by a recess 353 formed between the upper 334 and lower 335 portion of the heel 312. Thus, when the sealed chamber is pressurized, the forces on the wall are transmitted to the heel structure, strengthening the sealed chamber 350.

These upper 334 and lower 335 portions may include supports 354, which extend inward toward the chamber, in like manner to FIGS. 4 and 5. These supports 354 may be mechanically linked to the chamber during assembly to provide additional strength and support. Further, conforming layers may be affixed adjacent to the walls of the sealed chamber to provide additional support 354. The sealed chamber 350 is supported be the outer walls formed by the upper 334 and lower 335 portions of the heel 312. Further, internal supports 354 may be formed which maintain the patency of the space. These supports 354 may be pressed against the sealed chamber, or may be sealed through the walls of the sealed chamber to form a solid support. By sealing these supports, internal pressure in the sealed chamber does not cause a spreading of the upper 334 and lower 335 portions of the heel 312. Forces applied to the heel 312 therefore bypass the sealed chamber 350. These supports 354 should provide stiffness along a vertical axis, although they may physically be oriented at an angle to provide lateral stability to the footwear. The conforming layers may be heat sealed to form a six (or more) layer structure. The supports 354 in the upper 334 and lower 335 portions of the heel 312 may include a gas-filled space, filled with, e.g., air or nitrogen, to absorb shocks.

A valve system may be provided in the footwear, preferably a three port device, having the following functions:

1. Provides a pressure relief function to vent refrigerant to the atmosphere in case of overpressure (optional).
2. Allows the footwear to be recharged with refrigerant from an external source.
3. Allows a controlled flow of refrigerant to flow from the internal reservoir at a high pressure to the cooling matrix at a lower pressure.

Figure 9:
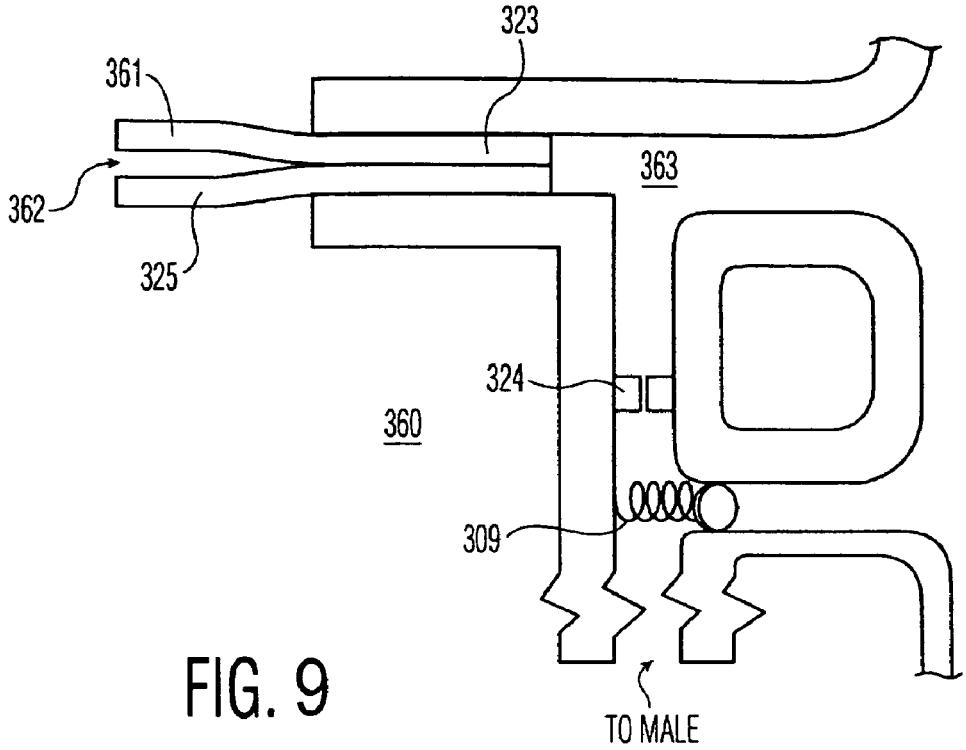
FIG. 9 is a schematic cross section of a valve system according to the present invention.

The valve structure 360, as shown in FIG. 9, preferably is encased in a material which is compatible with the refrigerant, and which may be sealed to prevent unwanted leakage of refrigerant. For example, the valve structure 360 may placed in a tube be formed of polyurethane, or may be inserted and sealed in a portion of a preformed chamber or chamber liner.

The external container fill port is preferably a resilient tube 361, in which the lumen is collapsed distally 323, preventing flow in either direction. A stiff cannula, attached to the external container, passes through the lumen 362 to a space 363. A bleed valve 324 normally provides a limited flow from the space 363. This resilient tube 361 may also include an integral pressure relief function 309, so that when the pressure in the space beyond the lumen is above a threshold, which may be predetermined or dynamically alterable, refrigerant will vent from the reservoir. In either case, the refrigerant is injected into the footwear cooling matrix through conduit 308.

Figure 10:
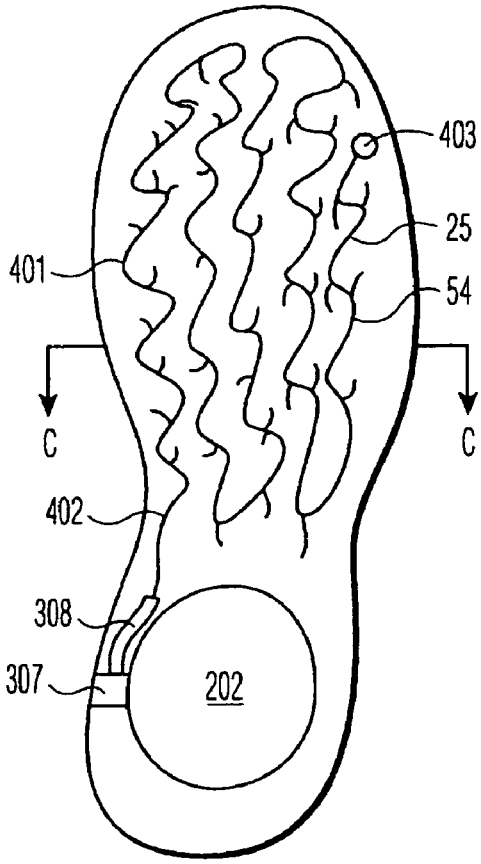
FIGS. 10 and 11 are top and cross section views, respectively, of a footwear embodiment cooling matrix according to the present invention.

A separate controlled flow path is provided from the internal reservoir 202 to the space beyond the member. This flow path has a flow restrictor, e.g., bleed valve 324, having small aperture, and is designed to be the limiting factor in the flow of refrigerant from the internal reservoir 202 to the conduit 308 leading to the serpentine path 401 of the cooling matrix, as shown in FIG. 10. This aperture may be formed of a tube of any type, for example a ceramic, glass or metal tube which is approximately 1 to 10 mm in length and has an internal diameter of between about 0.002 and 0.008 inches. This tube diameter is selected to provide an unrestricted flow rate of between about 2 to 10 ml per minute of refrigerant, which allows extended and controlled cooling of the footwear 214.

A further control may be provided which is manually or automatically adjusted to limit the refrigerant flow rate. Thus, a thermostat may be included which allows or increases flow of refrigerant when the footwear temperature is above a certain level, and blocks or restricts flow when the temperature is below a certain level. The thermostatic control may also be responsive to a relative temperature rather than absolute. A sensing element, which may be, e.g., a bimetallic element, senses the temperature of the cooling matrix at a portion of the refrigerant flow path near the proximal portion and distal to a constriction. For example, a bimetallic element flexes in one direction when heated and in the other when cooled. The bimetallic element rests against a needle valve, at a proximal portion of the controlled flow path. The activation temperature may be preset or adjusted by a helically threaded screw.

The temperature sensitive flow control element may optionally be integral with or separate from the primary flow control system. Further, this flow control element may be provided as a single control or a series of parallel control elements for a plurality of flow paths in the cooling matrix, to control the temperature of the heat transfer system. The temperature achieved at the body, in the case of footwear being the foot, is preferably above 2 degrees C. in order to prevent tissue freezing, and more preferably above 4 degrees C. to provide extended comfort and prolong the life of the reservoir. A temperature drop of at least 5 degrees C., e.g., to a temperature between about 15–30 degrees C., is preferred.

An example thermostatic element is a bimetallic element which selectively obscures an orifice. A more complex arrangement includes a proportionally controlled thermosensitive valve structure, which may be provided by a valve having a variable effective aperture due to a pressure exerted on a ball in a valve seat, or a deformation with concomitant variable occlusion of a flow tube. A stepwise continuous control valve may also be provided by multiple occlusion events. In a thermostatic embodiment, it is generally preferred that the thermostatic element measure a critical temperature in the cooling matrix, i.e., a lowest temperature in proximity to tissue, rather than a temperature in proximity to the thermostatic regulator itself. Therefore, the thermostatic element may require a linkage between the temperature measurement site and flow regulation site. In the case of a bimetallic strip, this linkage may be inherent in the design. Otherwise, a mechanical, hydraulic or pneumatic link may be provided.

An electronically controlled embodiment may include a solenoid, piezoelectric or micromachined valve which may be proportionally acting or pulse modulated, by width, frequency and/or amplitude, to establish the steady state conditions. This pulsatile flow may be purely time based, or may be regulated by a sensor to assist in temperature regulation in the maze. Such a temperature regulated device provides a temperature sensor near the proximal portion of the cooling matrix, which is presumed to the coldest portion. The coldest portion of the cooling matrix preferably remains at or above 2 degrees C.

In another embodiment, a safety device is provided by a water-filled valve which freezes and shuts off flow when the temperature falls below 0 degrees C. Such a safety device is located between the internal reservoir and the cooling matrix and is configured to be approximately 2–5 degrees C. below the coolest portion of the cooling maze, with a faster thermal response time. Thus, if the flow is too great, the water freezes, stopping refrigerant flow due to expansion, and preventing tissue freezing. Such a device may be located distal to a significant pressure drop, so that the temperature drop due to refrigerant expansion is maximized.

The thermostatic control is provided to regulate temperature in the cooling matrix. The thermostat preferably controls flow from the internal reservoir distal to the flow control element to the cooling matrix, based on an average temperature from one or more critical areas. It is also possible to have a number of individually thermostatically controlled paths, although a single flow path is preferred. The thermostat may have a fixed or variable setpoint, and where a plurality of thermostatic control points are provided, each may be set at a different temperature or have other differing characteristics. Where a plurality thermostatic elements are provided, the temperature setpoints are preferably set by design and not individually adjustable; however an external adjustment may be provided to influence these elements together. The thermostatic element may be mechanical, hydraulic or electronic in nature.

If a plurality of flow paths are provided in the cooling matrix, each flow path may be individually temperature or flow regulated at a proximal flow portion thereof by self regulating elements. These self regulating elements may control absolute flow through each path or a relative distribution of flow as compared to the other flow paths.

As shown in FIG. 10, the cooling matrix comprises one serpentine path 401 or a plurality of parallel flow paths. These paths are provided such that the refrigerant vaporization extends through the entirety of the path, in order to avoid cold spots due to pooled liquid refrigerant vaporization. This vaporization causes a liquid to gas volume increase which causes a net flow from proximal to distal portion of the matrix, the distal portion being lower in pressure and closer to atmospheric pressure than the distal portion. Thus, gas vaporization, and hence cooling, is spread over essentially the entirety of the cooling matrix.

The flow rate through the cooling matrix should be low enough that no liquid refrigerant is present at the exit portion, yet the cooling function is effective throughout the cooling matrix. One exception to this design parameter is if a recycling system is provided, which would allow liquid refrigerant to be reinfused into the cooling matrix. In such a system, a high temperature boiling component of the refrigerant may advantageously be provided to act as a heat transfer agent, which may be provided in excess quantities. This agent may accumulate at various portions of the flow circuit, and will generally not interfere with effective cooling and the maintenance of a steady state condition. The volume of this component, if liquid, must be accounted for in the operation of the compressor.

The cooling matrix preferably is provided with catch-pockets 402, i.e., blind paths, in order to prevent gravitational flow of the liquid refrigerant from proximal to distal portions of the cooling matrix. Further, the configuration of the catch-pockets 402, in conjunction with surface irregularities, should be such as to create turbulence in the flow of refrigerant to assist in nucleation for evaporation of refrigerant. The cross sectional area of each flow path preferably increases with increasing distance from the reservoir, to control the increase in velocity of the contents, which would otherwise tend to expel liquid refrigerant from the end of the maze. On the other hand, a portion of the refrigerant should remain as a liquid near the end of the maze in order to provide effective cooling in this area. The terminus of the flow path preferably has a larger cross sectional area than the proximal portion, to further reduce the velocity and allow any remaining refrigerant to vaporize. High surface area elements, e.g., boiling rocks made of marble, may also be provided in the cooling matrix is assist in vaporization at spots where turbulence alone is insufficient to assure complete vaporization. If is preferred, however, that flow turbulence be controlled in order to control vaporization. Turbulence in the maze may be controlled by the placement of members into the flow path, by angulations of the flow path, and by focused restrictions in the flow path.

The cooling matrix may be formed by providing stiff flow paths embedded in the insole, which is flexible and compliant, which are supported against collapse from pressure in the surrounding material. Flow paths may also be provided in the footwear upper. The flow paths may be hot pressed, molded, machined or heat, adhesive, or RF-sealed in place.

Figure 12:
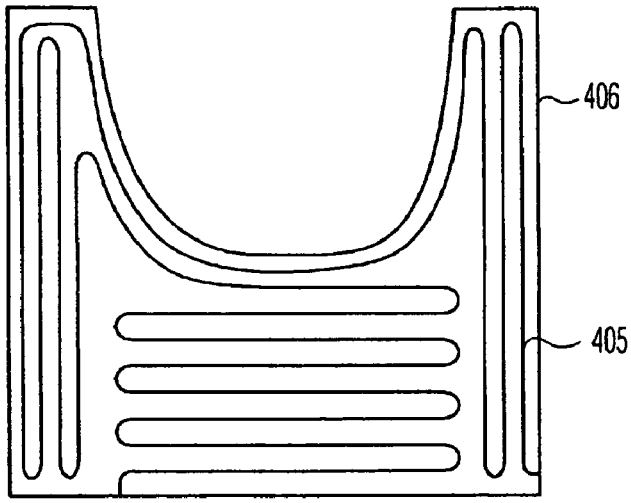
FIG. 12 is an unfolded view of a footwear upper cooling matrix according to the present invention.

The sole structure may be a two layer structure, with the flow path formed integrally between two layers, or a multilayer structure in which the flow path is formed as a separate structure and assembled within the sole. For example, a preformed cooling matrix having a maze design may be formed from two polyurethane sheets which are heat sealed together in a maze pattern. This cooling matrix may be sandwiched between an upper and lower laminate of a sole, having recesses adapted for receiving the cooling matrix, or placed above the sole and under an insole pad, formed of, e.g., Sorbothane®. FIG. 12 shows a refrigerant flow path 405 in an unfolded footwear upper 406.

Figure 13:
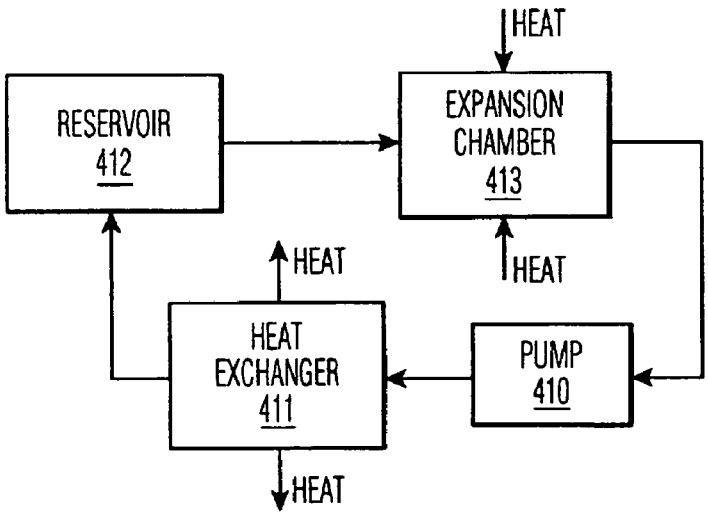
FIG. 13 is a block diagram of a closed circuit cooling system according to the present invention.

Footwear in active use is subject to large pressures and pressure gradients. Therefore, it is possible in certain circumstances to reliquify at least a portion of the gaseous refrigerant for reuse. In such a case, a compression chamber or pump with significant associated external heat exchange area is provided in the heel and/or ball of the foot. When the wearer steps or jumps, the contents of the chamber will be pressurized. This pressurization will cause an increase in temperature. Depending on design, the compressor structure may be distributed, having multiple segments, each having a pair of check valves, which will allow the system to operate even if the wearers gait is abnormal or the activity nonstandard. The increased temperature will result in a localized temperature gradient, allowing heat to be lost to the environment by means of a radiator system, and the refrigerant will be reliquified. This reliquified refrigerant may be returned to the internal reservoir. A separate channel may also be provided for this reliquified refrigerant. The radiator element is provided on the outside of the footwear. A closed circuit system is shown in block format in FIG. 13, in which refrigerant is compressed in a pump 410, where the compression causes a heating of the refrigerant. The hot refrigerant loses excess heat to the environment in a heat exchanger 411. The cooled refrigerant is stored in a reservoir 412, from which it is released into an expansion chamber 413, which corresponds to the present cooling matrix. Vaporized refrigerant is the drawn into the pump 410 where it is repressurized.

The compression chamber may also be used to provide a pressure source for the reservoir, as stated above. In one embodiment, in order to avoid the effects of the large dynamic variations in pressure, the entire cooling matrix operates as a closed cycle system at a pressure equalized with or above the average pressure exerted by the wearer on the matrix.

Figure 11:
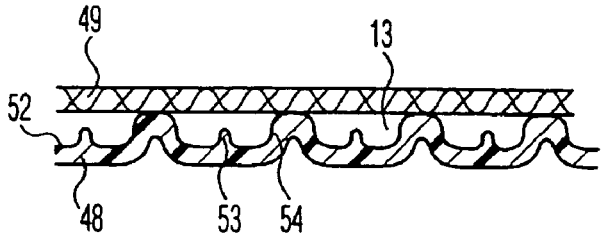

In yet another embodiment, a cooling matrix is provided primarily in the shoe upper rather than sole, as shown in FIG. 12. In principal, the operation is similar to that described above; however, the shoe upper 406 will generally not be subject to forces of the same magnitude as the sole, so that the refrigerant vaporization channels may be flexible, laminated sheets. The present cooling system may also be included in footwear which has inflatable bladders according to the prior art. As shown in FIG. 10, the cooling maze may have a regular pattern, or be somewhat more randomly organized. As shown in FIG. 11, the sheets which make up the shoe upper may be RF heat sealed together, possibly in multiple operations. Further, the vaporized refrigerant may be used to inflate bladders in the shoe upper or insole. When applied to the footwear upper, cooling may also be applied to the ankle and Achilles' tendon area, especially in high top sneakers or boots.

The cooling matrix system in the footwear upper is preferably formed of sealed layers of urethane having a potential space formed therebetween. The urethane may be coated with a nylon cloth. The cooling matrix is formed into a maze, having a plurality of blind pockets that form traps of varying orientation, by the use of radio frequency sealing, into specific patterns that allow for contour placement of the cooling effect device around the foot. The Nylon cloth reinforcement, if provided, is preferably between 100–1000 denier. The nylon is most preferably 200 denier, with a water repellent outer finish. The refrigerant paths are preferably separated by spaces, which are perforated to allow air flow and moisture evaporation.

The radio-frequency sealing process joins two or more sheets in parallel planes by passing a radio-frequency or microwave signal through the layers, causing localized heating in the layers in a pattern conforming to the antenna-applicators. If materials other than urethane are used, then other known sealing or fusing the layers may be applicable. These methods include heat sealing, adhesives, pressure sealing, sewing and the like. This localized, patterned heating from an RF sealing process causes the polyurethane coating of the nylon mesh to fuse with adjacent layers. On cooling, the fused portions form a hermetic-type seal, which is adequate to contain the refrigerant as a liquid and as a pressurized gas. The polyurethane coated nylon material has a low compliance, so that once the device is filled with refrigerant, further input of refrigerant will expel substantially the same amount of refrigerant from the exit port of the cooling matrix. The exit port may be connected to a bladder, which provides improved fit and support to the foot.

The refrigerant may also be used to indirectly cool the foot of the wearer through a heat exchange system. In this system, the refrigerant is used to cool a heat exchange liquid, which may be water, polyethylene glycol solution, glycerol, mineral oil, or another liquid. A thixotrophic composition may also be used to provide both cooling and shock absorbing properties. Advantageously, if water is used, it will self regulate to a temperature above 0 degrees C. (thereby allowing flow) and prevent freezing of the foot in case of misregulation.

In a heat exchanger system, the refrigerant is released from the reservoir to cool a heat exchange fluid contained in a pressurized channel. The fluid in the channel is induced to flow in one of three ways. First, the refrigerant volatilization may be used to run a miniature turbine, gear pump or peristaltic pump; second, a small electric motor may run a pump; and third, movements by the wearer may be used to propel the fluid. Of course, other circulating systems are known. The flow rate of fluid in the channel should be rapid, in order to provide even temperature distribution. In the area of the heat exchanger, refrigerant contacts the outside of the fluid flow tube, and cools the liquid therein. Since the heat exchange fluid is contained in a closed system, high pressures and transients will have little effect on it. Since the heat exchanger is not subjected to large pressure changes, the system may be optimized to operate under ambient environmental conditions. Further, a single fluid flow path and cooling regulating system may be provided. This heat exchanger is preferably provided behind the heel of the wearer or in the shoe sole or heel in a protected area.

In a facilitated cooling arrangement, a refrigerant is used in a heat pipe arrangement. Fluid near the heat source vaporizes, absorbing heat. The increase in volume causes a convective flow through a conduit to a radiator, where the vaporized refrigerant is condensed, giving off heat to the environment. The refrigerant thus circulates, siphoning off heat to the environment. This system may also include an active pump to assist in fluid circulation, as well as a compressor, to facilitate condensation of the refrigerant. This system has a constant volume, and will be above atmospheric pressure during use. This pressure will be such that a steady state is maintained in the system. For example, if R-123 refrigerant is employed, the portion of the system in contact with the body will be about 32–36 degrees C., while the external cooling radiator will be several degrees cooler. The pressure will rise, from a room temperature condition, so that the boiling point will be somewhat elevated from 28 degrees C., and therefore the existing temperature gradients will drive the system. This facilitated heat transport system will not operate if the ambient temperature is above the body temperature. Of course, other refrigerant systems may be used to provide different boiling points or characteristics. The radiator preferably has a high surface area, and may be moistened, to allow evaporative heat loss. or withdrawal.

Under high ambient temperature conditions, it may be necessary to cool the body below ambient temperatures. In this instance, an active refrigeration or evaporation system must be employed. Such a system may employ an open circuit refrigeration system, a closed circuit refrigeration system with an active energy source, e.g. a foot operated pump, or a water source for evaporative cooling. These systems are generally described above.

Example 2

Adaptive Fit Footwear, Pressurized Bladders in Upper

According to another embodiment of the invention, a set of inflatable bladders are formed in the footwear upper. These bladders may be inflated with air, refrigerant, or liquid. The bladders are formed of two layers of a high modulus polymer film, for example polyester film (e.g., Mylar®) with conduits formed integral to the heat sealing pattern to a control system, which is, for example, embedded in the sole. Advantageously, a cooling system is provided which removes heat from below the bladder system. Thus, according to one embodiment, a volatile refrigerant flows through a maze pattern segment formed between a first and second layer of heat-sealed film. The terminus of the maze pattern segment is an aperture formed through one of the film layers, leading to a bladder segment formed between a second and third layer of heat sealed film.

The bladder segment has a conduit formed by an elongated potential space between the second and third layers to a controllable pressure relief valve system, for example in the sole. Since the pressure resulting from volatilization of refrigerant is relatively high, individual bladder segments may be selective pressurized from 0 psig to 50 psig.

It is noted that, while the layers are planar, they may be overlaid, and indeed the pressure fluid need not be the same in each bladder. Thus, low pressure, refrigerant filled cushioning bladders may overlie high pressure liquid filled contour control bladders, to provide both comfort and fit.

Figure 31:
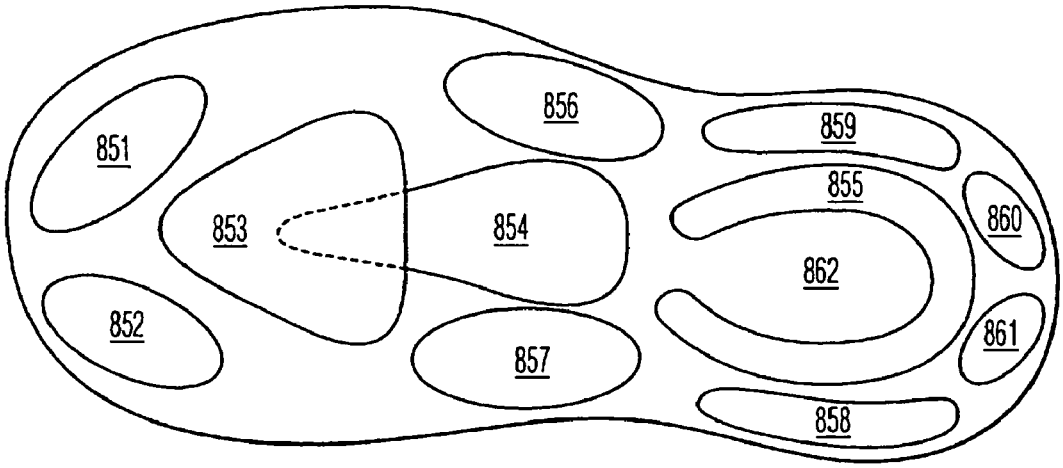
FIGS. 31 and 32 show a bladder zone layout and semischematic diagram of a footwear upper control system.

As shown in FIG. 31, the upper 850, shown in a top view, with ankle region 862, may be divided into a plurality of segments, including hallucis 852, toes 851, central 853, tongue 854, lateral 856, medial 857, ankle 855, rear lateral 859, rear medial 858, and Achilles 860, 861.

Figure 16:
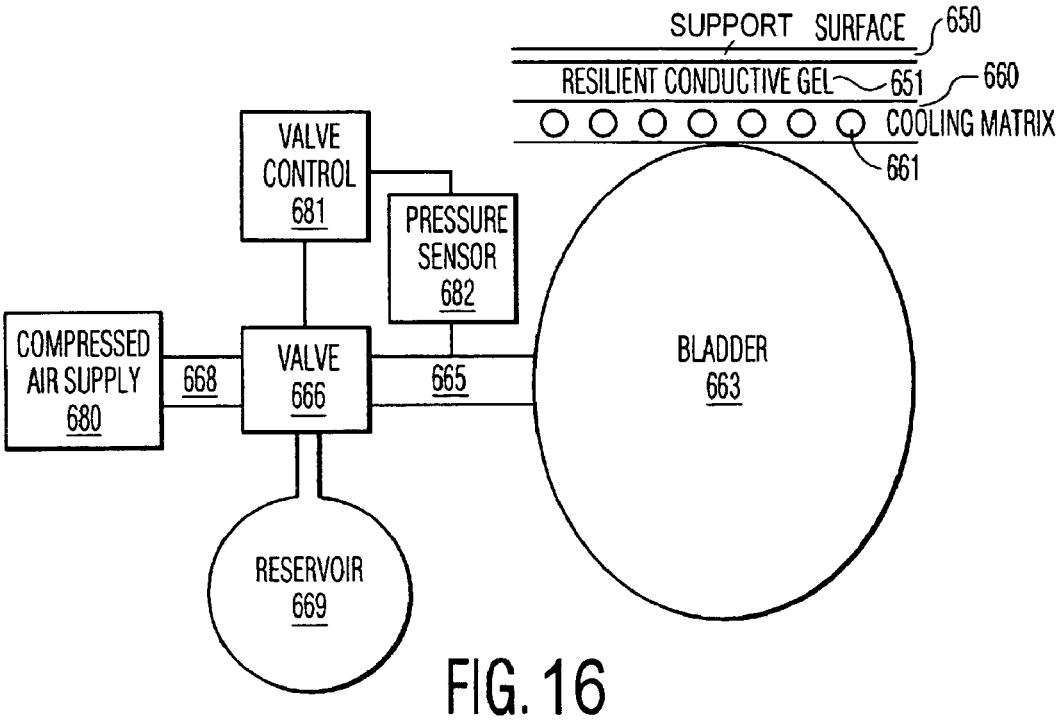

As represented in FIG. 16, a set of fluid actuators 663 are provided, each within a specified region of the footwear upper. A compressor or compressed air supply 680, for example operating at 0.5–5 psi, supplies a separate valve 666 for each actuator 663, which is, for example, a bladder. The valve 666 may be, for example, a micromachined valve or miniature electromagnetic valve. The footwear upper is, for example, leather or fabric. The leather or fabric is stiff, and non-compliant; therefore, the effective compliance observed by the foot will be controlled by the bladder 663 inside this shell.

The valve 666 has two distinct functions; it controls the volume of air or gas in the bladder 663, from compressor 680 through pneumatic feed line 668, and separately controls the restriction of gas flow between the bladder 663 and a reservoir bladder 669 which serves to control dynamic response of the system. As the restriction imposed by the valve 666 decreases, the effective compliance of the bladder 663 increases, asymptotically reaching the compliance of the combined bladder 663 and the reservoir bladder 669. When the valve 666 effectively blocks gas flow between the reservoir bladder 669 and the bladder 663, the bladder 663 is relatively incompliant, and further is more elastic. The valve 666 equalized the pressure between the bladder 663 and the reservoir bladder 669, with a lengthy time constant. A pressure sensor 682 may be provided in the bladder 663 or in the pneumatic line 665 feeding the bladder 663, to measure the pressure within the bladder 663. A valve control 681 is provided to control the valve, and, as shown in FIG. 16, may be used to effect a closed loop control over the pressure within the bladder 663.

Figure 32:
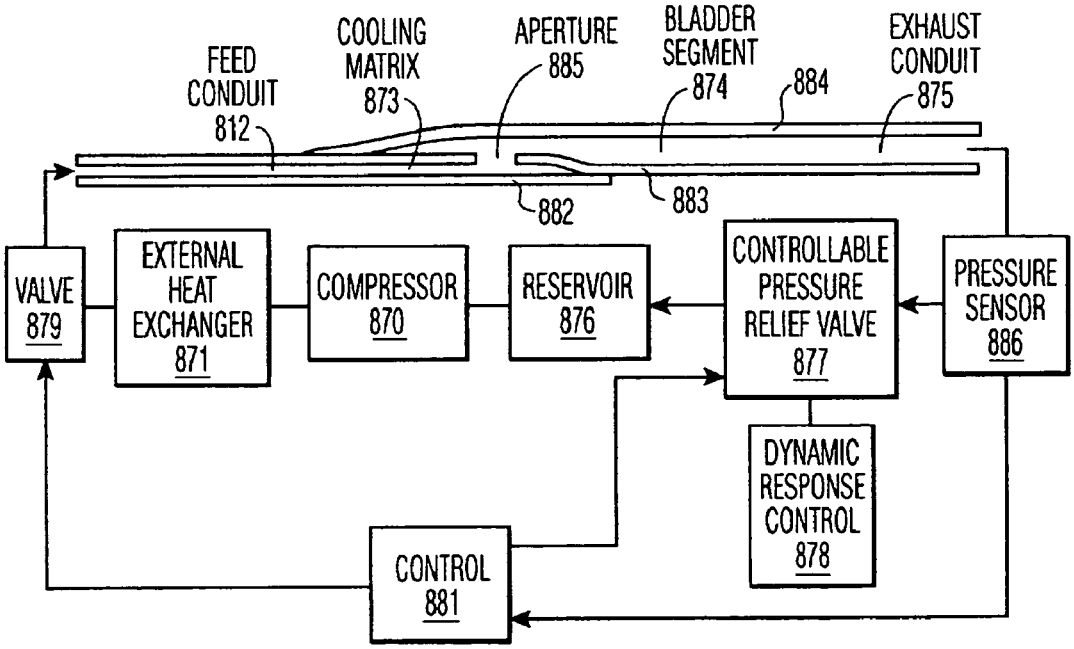

As shown in FIG. 32, a three layer structure is formed of layers 882, 883 and 884. Layers 882 and 883 form a conduit 872 from a control valve 879, leading to a cooling matrix 873. The cooling matrix 873 terminates in an aperture 885 leading to a bladder segment 874. The bladder segment 874, in turn, leads through an exhaust conduit region 875 to a pressure sensor 880 and a controllable pressure relief valve system 877. The pressure relief valve system 877 leads to a compliant reservoir 876, which feeds a compressor 870. The compressor 870 empties into an external heat exchanger 871, which may also be formed of heat sealed films, to form an elongated flow path adjacent to the air external to the footwear. The external heat exchanger 871 leads to the control valve 879, which leads to the feed conduit 872. The controllable pressure relief valve 877 and control valve 879 are each controlled by a control 881, which may either operate in open loop mode or receive and process the input from pressure sensor 880. The control 881 may also provide active damping, in conjunction with the controllable pressure relief valve system 877 and the dynamic response control chamber 878, which is preferably embedded within the sole.

The system therefore integrates both cooling and adaptive fit. The compressor 870 is preferably driven by gait induced pressure variations in the sole. The control is preferably a microprocessor, although a simple mechanical device may be sufficient. By employing high modulus polymer film, a large transient dynamic pressure range is supported, facilitating high performance footwear design without sacrificing comfort.

Figure 15:
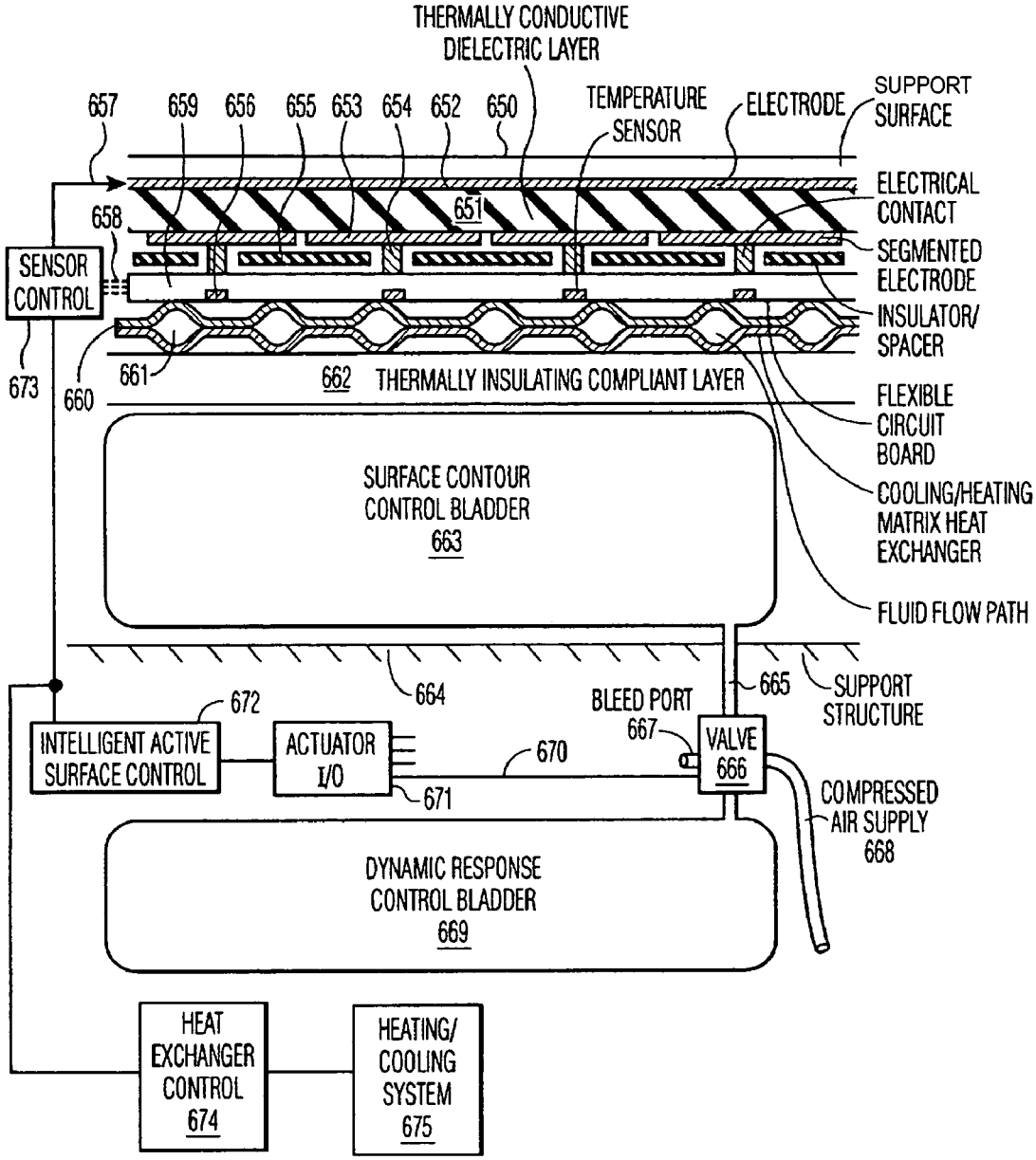
FIGS. 15, 16 and 17 are a cross sectional view of ergonomic footwear, and schematics of a control system therefore, respectively.
Figure 17:
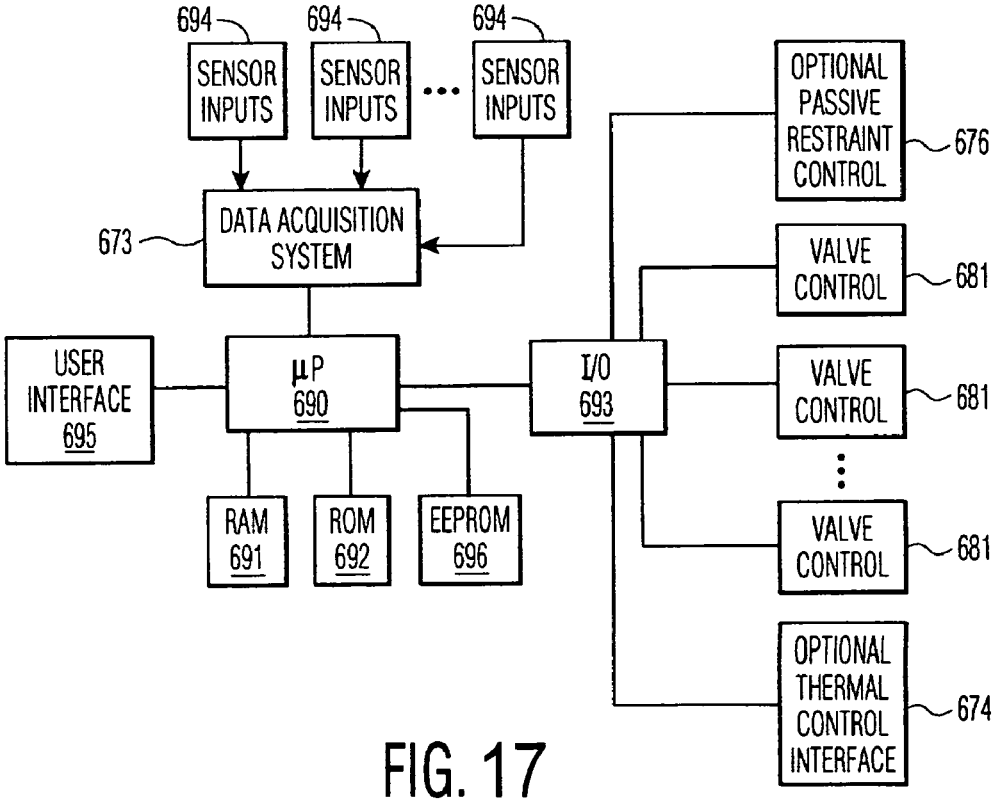
Figure 18:
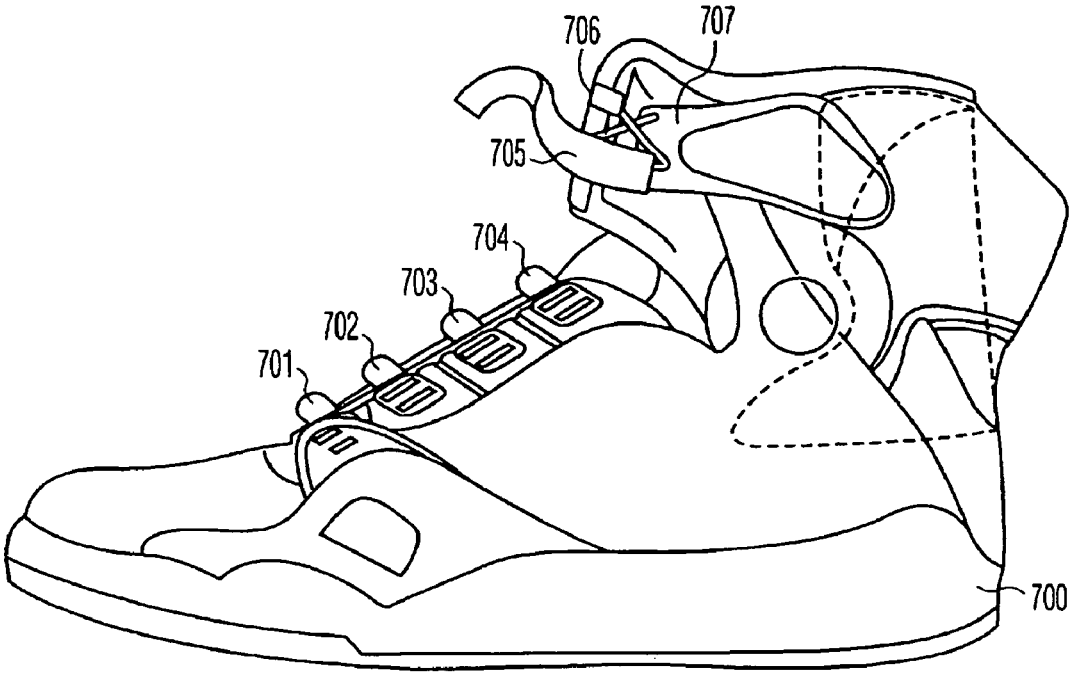
FIGS. 18 and 19 show a side and top view, respectively of an ergonomic footwear system having actuators to control fit.
Figure 19:
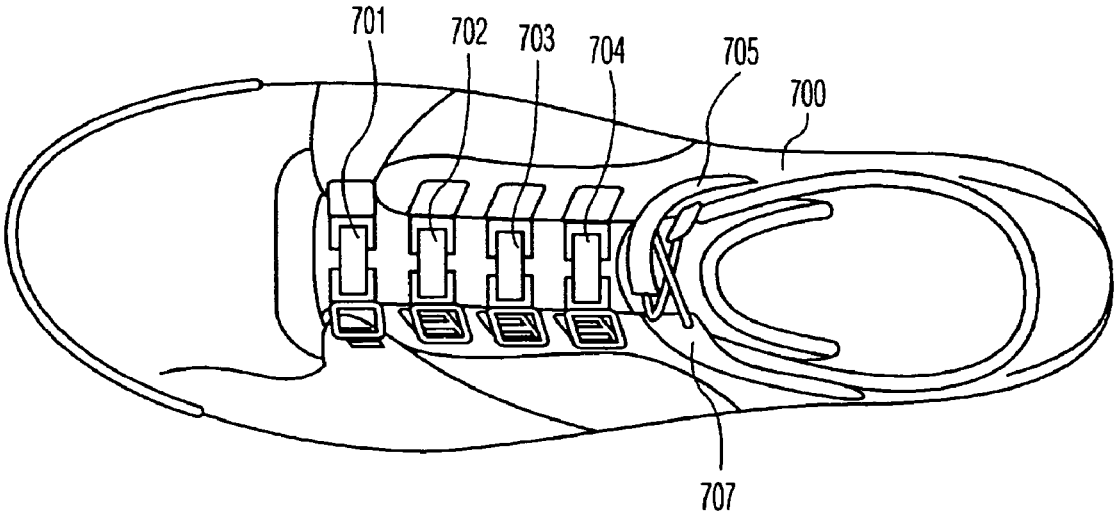
Figure 20:
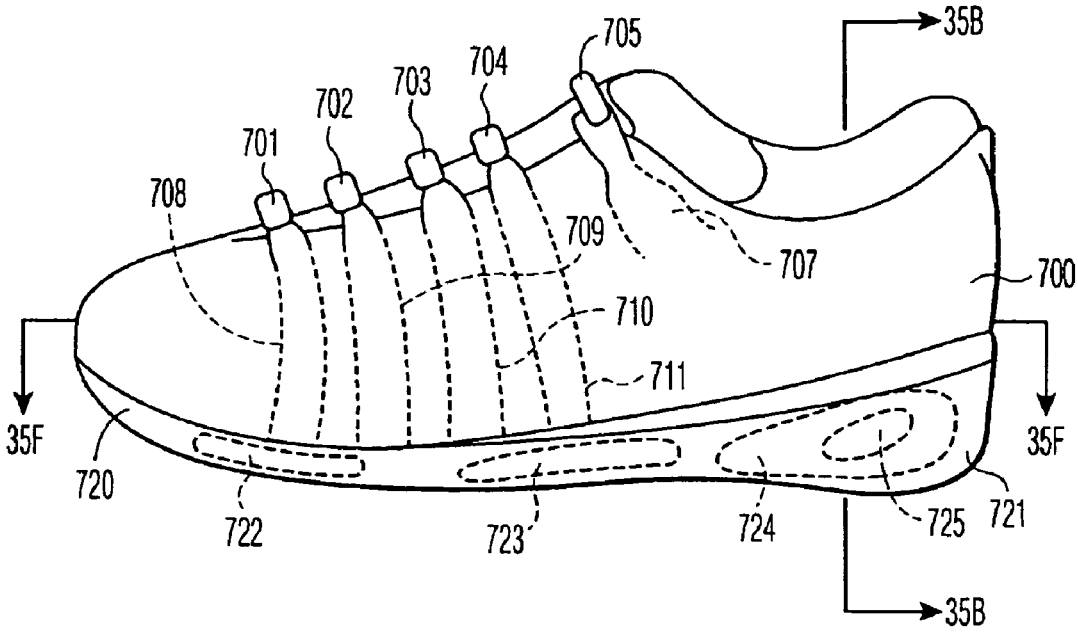
FIGS. 20, 21, 22, 23, 24 and 25 show a perspective view, and cross section of ergonomic footwear, sole actuator zone layout, sole sensor zone layout, schematic and cross section of an ergonomic footwear embodiment.
Figure 21:
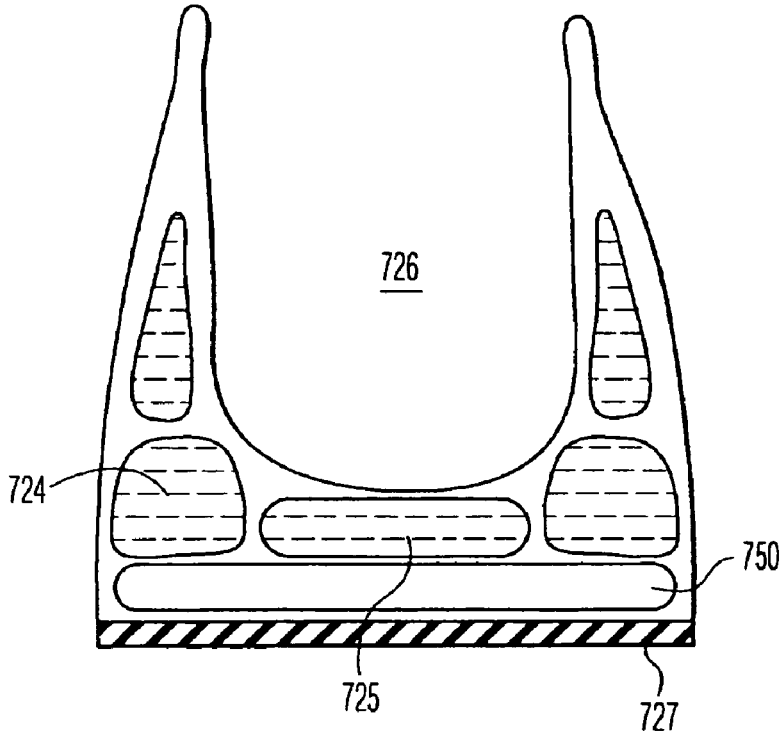
Figure 22:
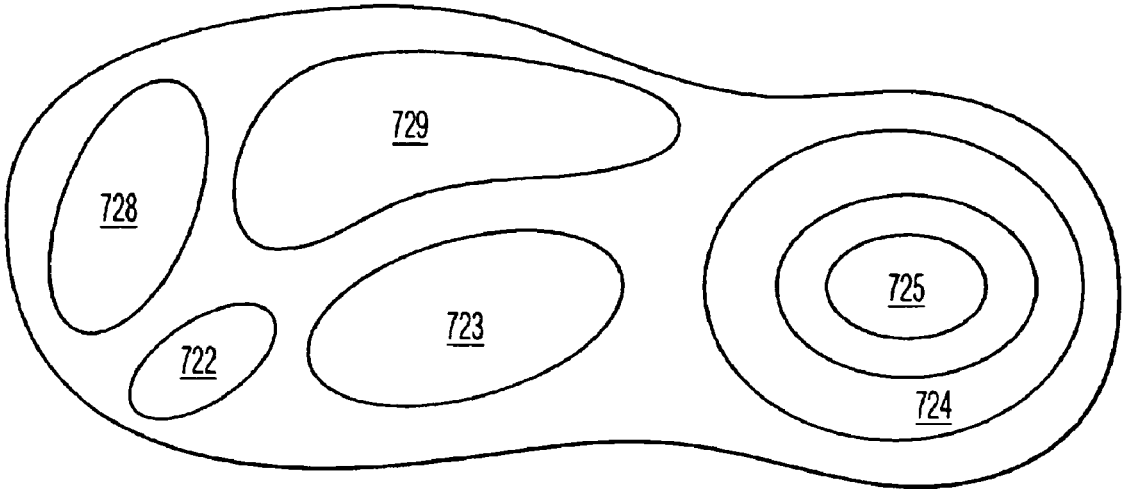

As shown in FIGS. 15 and 17, a distributed control system may be implemented, having a central processor 690, interfacing with valve controls 681. Alternately, a central control may be implemented. The central processor 690 receives inputs from sensor inputs 694, which include pressure sensors 682 or force sensor 651, and optionally other types of sensors, such as temperature sensors 656. A data acquisition system, sensor control 673, receives input from the sensor inputs 694 and interfaces with the central processor 690. The central processor 690, which is, for example, an Intel 80C51 derivative, MIPS derivative, ARM processor, PowerPC processor, Microchip PIC series, or other processor type, interfaces with random access memory (RAM) 691 for storing process variables and other data, and read only memory (ROM) 692 which stores program information. Nonvolatile data storage memory, for example electrically erasable programmable read only memory 696 (EEPROM) or flash memory, may be used to persistently store data, for example user preferences, environmental characteristics, and adaptive parameters.

As shown in the embodiment of FIG. 32B, a force sensor 651 is provided for measuring the pressure exerted by the foot. This sensor provides a polyurethane layer, which is metalized 652 on one side, preferably the upper side, and formed as an array of separate conductive zones 653 on the other side. The polyurethane may be, for example, a Sorbothane type mechanical shock absorbing polymer. The separately conducting zones 653 are used, with the polyurethane layer 651 and metalized 652 side as a capacitive sensor, responsive to an applied pressure. In place of the polyurethane layer, other specially thermally conductive dielectric layers, such as Raychem HeatPath thermally conductive gel CTQ 3000 may be used. The conductive zones are each contacted by a conductive pad 654, through an apertured insulator sheet 655, to a planar flexible circuit 659. The planar flexible circuit 659 may have thermal sensors, for example thermistors or semiconductor junction sensors. The planar flexible circuit 659 interfaces through cable 658 to a sensor control 673, whose primary function is to control the data acquisition from the multiple force sensor zones.

Beneath the planar flexible circuit 659 is an optional heat exchanger 660, which has an integral fluid flow path 661, which is suitable, for example, for circulating an antifreeze solution, oil or a volatile refrigerant. The heat exchanger 660 system is controlled by a heat exchanger control 674, which in turn controls a heating/cooling system 675. The heat exchanger control 674 receives input from the temperature sensors 654. The control system for fit, cushioning, and temperature may be consolidated.

Below the heat exchanger 660 is a thermally insulating compliant layer 662, which rests on of a surface contour control bladder 663. The bladder 663 communicates, through line 665, to a valve 666, which receives compressed air through compressed air supply line 668. A bleed port 667 allows the valve 666 to deflate the bladder 663. The valve 666 also serves to selectively and proportionally provide a path to a dynamic response control bladder 669, to effectively control an air volume within the bladder 663 system, and to control damping of transient forces. The valve 666 is controlled through a cable 670 from an actuator input/output interface 671, to the intelligent active surface control 672.

The intelligent active surface control 672 seeks to adjust the pressures within the various bladders 663 to achieve a comfortable pressure profile, although a cycling of pressures or other asymmetry may also be provided.

An adaptive intelligent surface need not be limited to the control of surface contour. Thus, the surface contour, local compliance and local damping may all be controlled. Thus, for example, the dynamic aspects of the control may all be subject to closed loop electronic control.

Example 3

Adaptive Fit Footwear, Adjustable Tensioners

As shown in FIGS. 18–30, footwear is provided with an upper fit controlled by a set of hydraulic actuators 701–705. These actuators 701–705 control the tension on a set of straps 707–711 on the upper, which assure a proper fit. The pressure in each actuator 701–705 is measured by a pressure sensor 767. A set of strain gages (not shown) integrated into the upper or straps 707–711 may also be used to determine the fit of the shoe 700.

The actuators 701–705 receive pressurized fluid from a hydraulic compressor 755, which selectively communicates to each actuator 701–705 through check valve 759, line 760 and rotary valve 761. The rotary valve 761 is driven by an electrical actuator, for example a shape memory actuator, controlled by the control module 754. A reservoir 756 is provided for hydraulic fluid, which is, for example, an ethylene glycol antifreeze or mineral oil. The strap 764, is noncompliant, and driven by the stretch of the lower surface of the sole during dorsiflexion to power the hydraulic compressor 755.

Optionally, each actuator may be associated with a dynamic response chamber, allowing control over damping and dynamic response. This dynamic response is, in turn, controlled by a microvalve array, which employs a set of proportional shape memory alloy valve elements.

The control module 754 is powered by a rechargeable lithium battery 753 within the sole, and further by an electrical generator 763 driven off sole dorsiflexion, through strap 764, to move magnet 780 with respect to coil 781.

The sole shoe 700 has integrated in it an adaptive fit system, including fluid filled chambers 722, 723, 724, 725, 728 and 729. These chambers are disposed to control the fit with respect to particular anatomical regions, i.e., chamber 722 hallucis, chamber 728 metatarsals, chamber 723 instep, chamber 729 lateral aspect of foot, and chambers 724 and 725, heel. The heel is provided with a concentric toroidal set of chambers to assist in obtaining dynamic stability.

Figure 23:
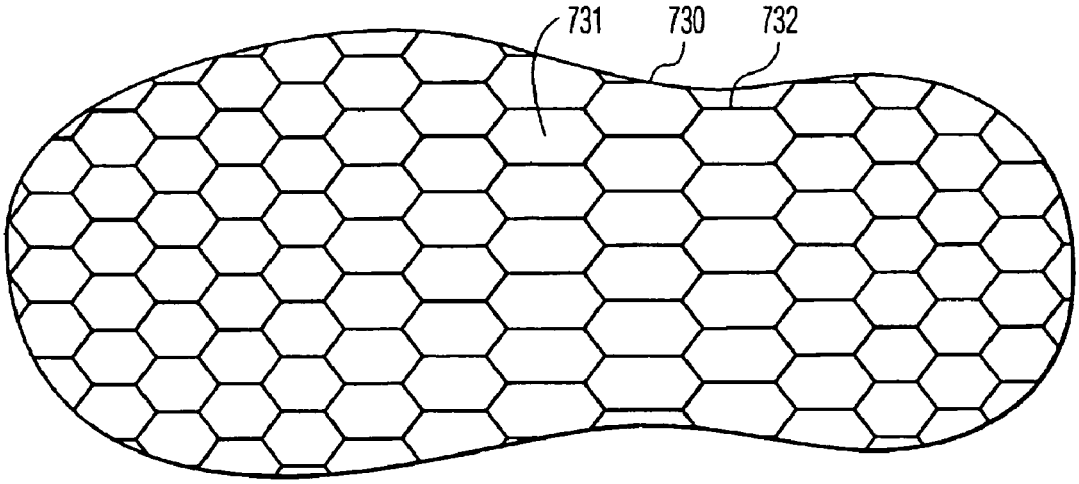
Figure 24:
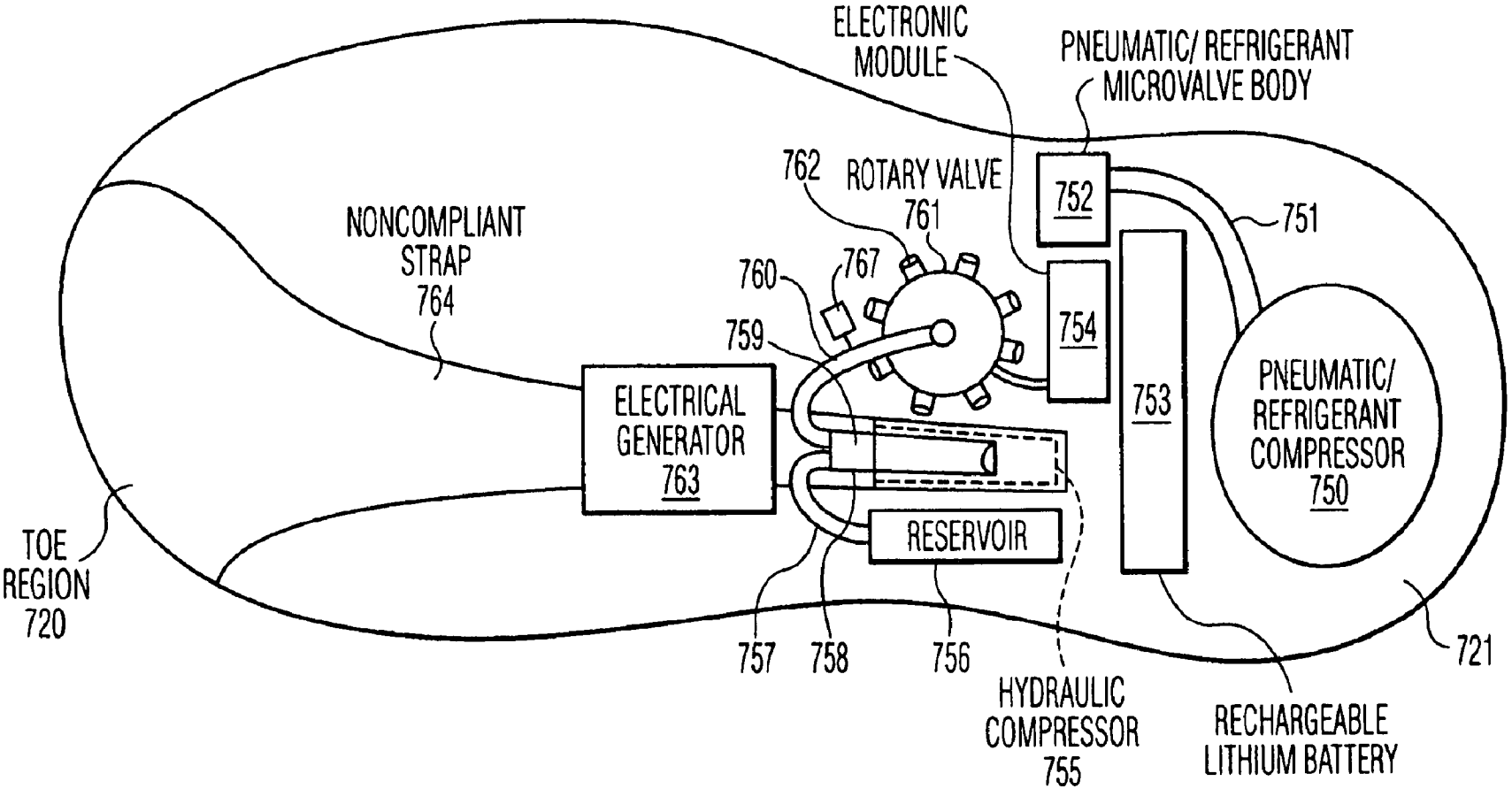
Figure 25:
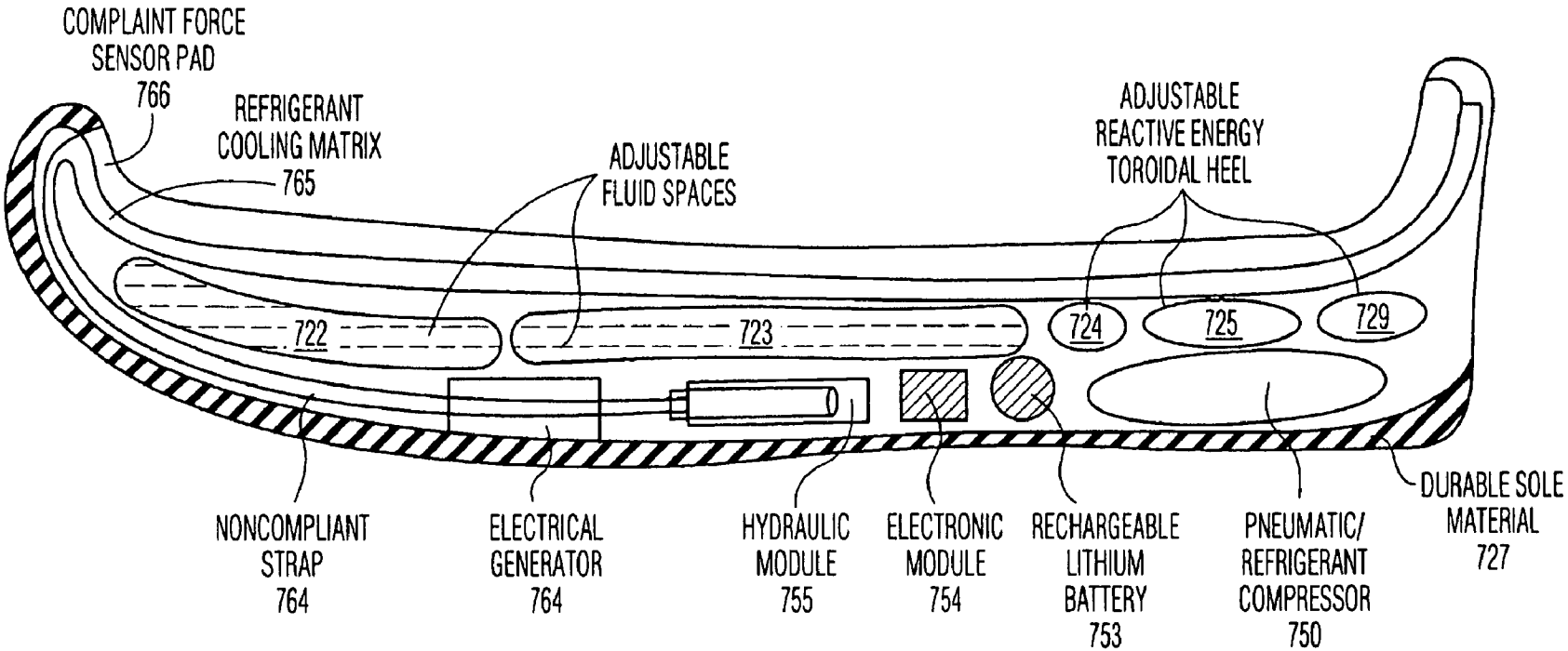

FIG. 23 shows a hexagonal tiled array of a sole pressure sensor, for determining forces applied on the foot. Each hexagonal tile forms a capacitive sensor segment, read by the electronic module 754. Preferably, the sensor segments 731 are addressable by respective ground plane, reducing the number of interface lines necessary. The dielectric layer of the force sensor 730 is preferably Sorbothane®, thus allowing the pressure sensor to effectively function to absorb shock.

Beneath the force sensor 730 and above the adaptive fit system lies a refrigerant cooling matrix 765. This refrigerant cooling matrix 765 receives a compressed and cooled refrigerant from compressor 822, through external heat exchanger 825 and flow restriction orifice 826. A refrigerant reservoir 823 receives warmed refrigerant for recycling. The compressor 822, which corresponds to the pneumatic refrigerant compressor 750, is situated under the heel and is operated under the forces exerted during locomotion. The compressor 750, through line 752, leads to pneumatic refrigerant microvalve body 752, which is employed to control the static and dynamic properties according to the present invention, in pneumatic bladders of the footwear, which are similar to those conventional in the art, although filled with refrigerant instead of air in a closed system and further optionally provided with dynamic response control chambers, which are, for example, in the sole. Thus, microvalve 810 controls the fluid amount in actuator expansion space 814 from the pressurized hydraulic fluid source 812, provided by the hydraulic compressor 829, and also the dynamic flow of fluid between the actuator expansion space 814 and the pressure equalized damping space 813, under the control of control 811.

The electronic module 754 may include a user input, such as speech recognition, e.g., using a device available from Sensory Inc. For example, this user input allows the user to instruct the footwear to anticipate a particular condition, in advance, so that the operational characteristics conform to the environmental conditions. Thus, for example, before a sporting event, a user may override an adaptive algorithm with a voice command in anticipation of a new set of conditions. These conditions may be, for example, the start of an event, turns, jumps, stairs, slippery conditions, or the like. The electronic module 754 receives the voice command through a microphone, and processes the command to provide a defined or changed set of operational parameters, stored in memory. Of course, other user inputs may be employed, for example radio frequency, infrared or ultrasonic communications from a remote control, for example in a wristwatch or bracelet, or even a miniature keypad.

Figure 30:
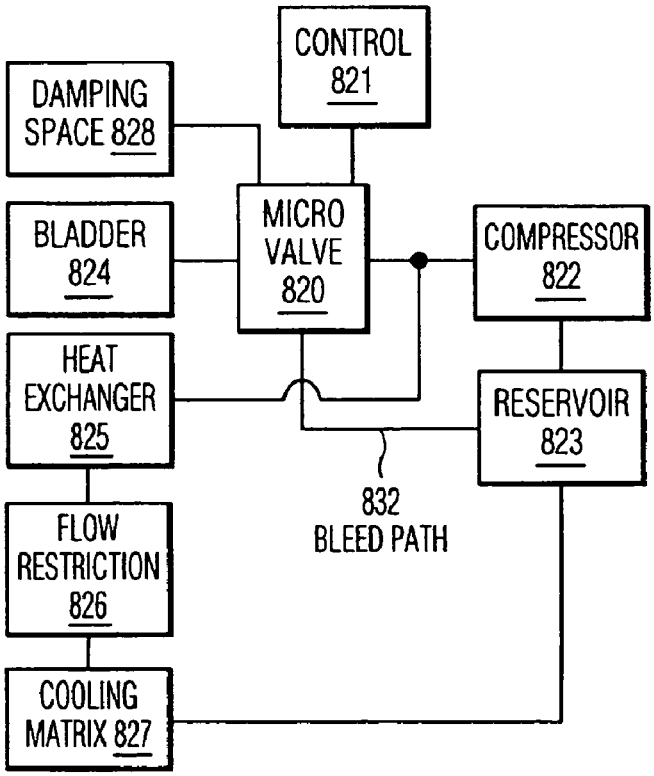

As shown in FIG. 30, the pneumatic system is dual function, having a refrigeration function, as discussed above, and a dynamic response function, by selectively controlling flow between each bladder 824 and a respective damping space 828.

In order to bleed a respective bladder or actuator, the microvalve 810, 820 provides a bleed path 831, 832 to a respective hydraulic 830 or pneumatic 823 reservoir, The bottom of the sole is laminated with a durable sole material 727. Other features conventional in footwear may be used in conjunction with the present embodiment.

Figure 26:
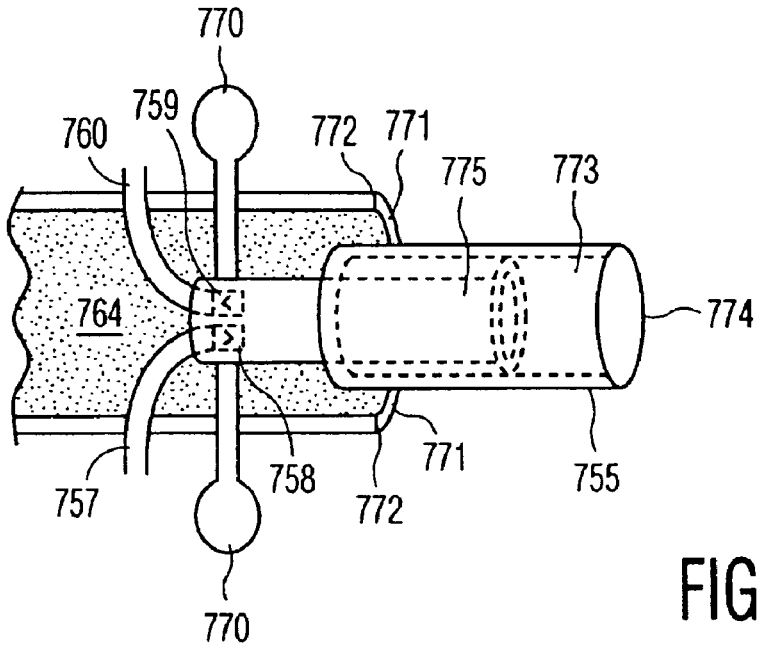
FIGS. 26, 27 and 28 are details of a compressor, electrical generator and actuator, respectively.
Figure 27:
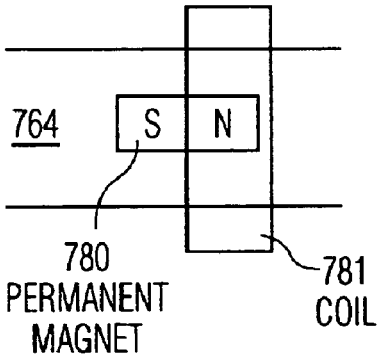

FIG. 26 shows a detail of the hydraulic compressor 755. The strap 764 provides tension on connection rings 771, adhered with adhesive 772 to the outer shell 774 of the cylinder 773. Within the cylinder 773 rides a hollow piston 775, which is closed on the end opposite the cylinder 773. The space inside cylinder 773 and hollow piston 775 is filled with a hydraulic fluid, which is an ethylene glycol antifreeze or mineral oil. Two check valves are provided, one 758 to draw fluid from reservoir 756 through line 757, and one 759 to expel compressed hydraulic fluid to rotary valve 761. Arms 770 hold the hollow piston in fixed position with respect to the moving strap 764 and cylinder 773.

Figure 28:
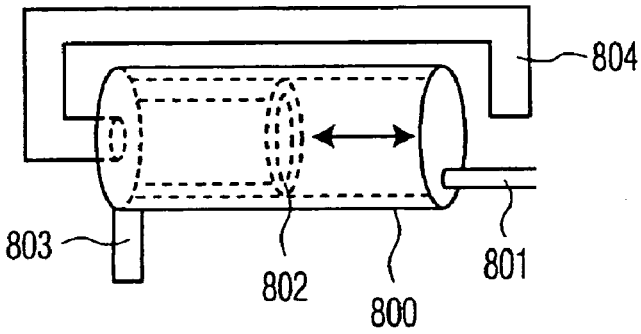
Figure 29:
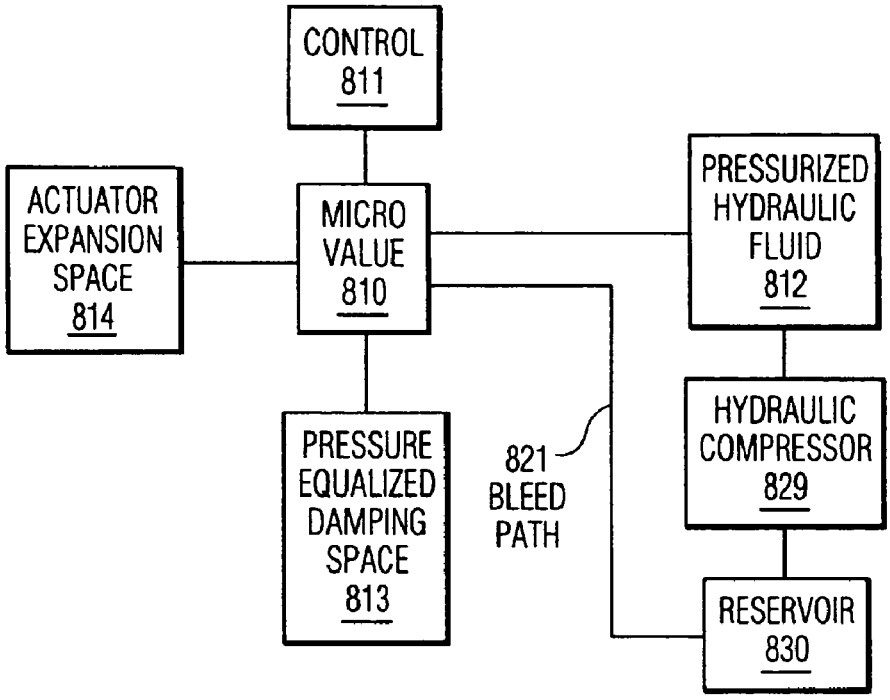
FIGS. 29 and 30 show schematic diagrams of an ergonomic damped footwear system, and an ergonomic cooled and damped footwear system embodiment, respectively.

FIG. 28 shows a detail of each actuator 701–705 which control fit in the upper. A cylinder 802 is displaceable within cylinder 800. Hydraulic fluid, through line 801, enters the cylinder and displaces the piston 802, causing arm 803 and 804 to move with respect to each other. The arrangement allows increasing pressure within the cylinder 800 to tighten respective straps 707–711.

Example 4

Controlled Energy Recovery Footwear

According to the present embodiment, energy absorbed by the footwear to damp the downward force is recovered and used to provide benefit to the user, either through assistance in locomotion or to provide power for other purposes.

In performance footwear, it is important that the damping characteristics be optimized, and therefore control over the quality of the damping function may be more important than energy capture efficiency. On the other hand, beyond a minimum damping, further parasitic power draw may be conducted.

One available from the use of the footwear is the downward transient force generated during locomotion or jumping. While other forces may be available, their capture might be considered purely parasitic, and therefore lacking special advantage. Many advanced footwear designs incorporate elastic, pneumatic, or spring elements to cushion the transient; however, these designs are limited in their damping of the transient, and have no significant means for delaying release of significant amounts of energy.

Figure 33:
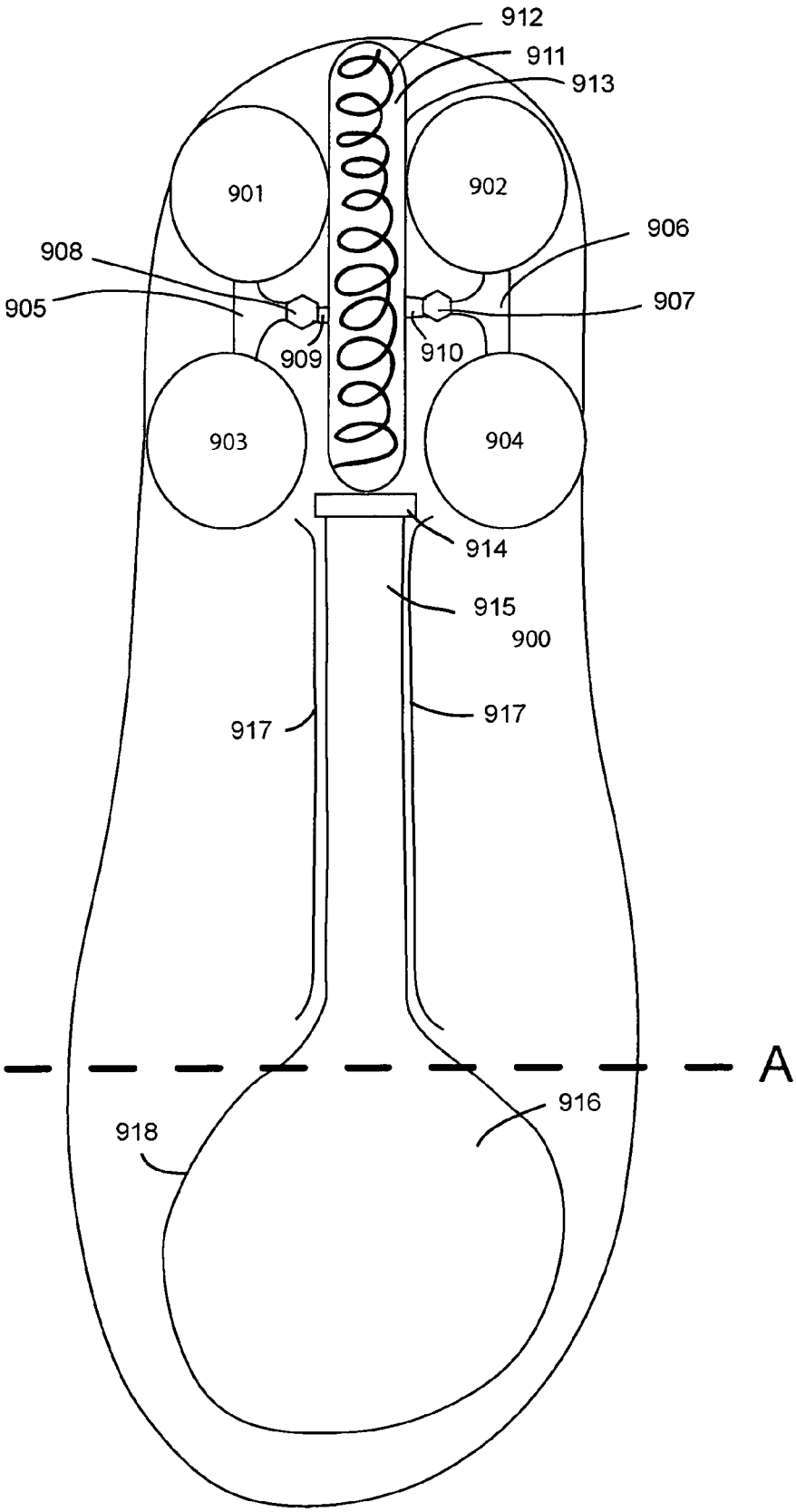
FIG. 33 shows a semischematic bottom view of an energy storage system within the sole of footwear.

As shown in FIG. 33, according to this embodiment, a set of tubular chambers 901, 902, 903, 904 are provided at the heel of the footwear 900. Each chamber is filled with an incompressible fluid or gel. With each heelstrike, the chamber is compressed. The chambers are ported through a conduit 905, 906, 909, 910 through a controlled valve 907, 908 or checkvalve to transfer a portion of its contents to a storage chamber 911. The storage chamber is then pressurized, and expands. Either as an intrinsic property of the storage chamber wall 913, or as a result of an internal or external elastic or spring member 912, the change in volume corresponds with a stored energy. The valve 907, 908 is controlled to capture the energy, and not return at least a portion of the fluid to the heel chambers 901, 902, 903, 904 until a later portion of the cycle.

It is noted that, if a simple checkvalve structure is employed, this energy capture is passive (i.e., not controlled by an intelligent process), and does not require any additional control structures or power. Likewise, a valve may be driven automatically through simple mechanical and/or hydraulic means, to capture and hold the transferred fluid.

When it is time for the energy to be released, the fluid is transferred back to the heel chambers 901, 902, 903, 904. Typically, this will occur at a time when the heel chambers 901, 902, 903, 904 are unloaded, and therefore no pressure will be required to transfer the fluid. In fact, there will typically be a relative vacuum in the heel chambers 901, 902, 903, 904, thus providing a motive force for fluid return. Advantageously, the change in force applied to the heel chambers 901, 902, 903, 904, expressed as a change in pressure therewithin, may be used as a control signal.

The captured energy stored in chamber 911 is therefore available for other purposes. For example, the energy is employed to assist in locomotion. Therefore, as the fluid is released, it acts to plantarflex (straighten) the sole 900 during a toe-off phase of the gait cycle. Typically, the sole 900 will be dorsiflexed after the heel is unloaded, so that the net effect will be to act constructively with the gait cycle, assisting the wearer. Alternately, the energy is employed to retract the toe portion of the sole toward the rear. These two effects are somewhat similar, the difference being the relative displacement degrees of freedom and the affixation of the actuator.

The actuator 915 is preferably a flat strap having a high tensile strength and low compliance (i.e., elongation per unit force). This strap 915 preferably is present in a channel 917 in the sole 900, so that over a portion of its path it can slide independently of the surrounding conduit walls. The strap 915 is attached to the toe of the shoe, for example by sewing 918, adhesive, or other process. As the sole 900 is dorsiflexed, i.e., bent upward, typically along an axis A by the ball of the foot, the strap 915 is displaced forward, i.e., toward the toe. Likewise, as the strap 915 is drawn rearward, it applies a force tending to plantarflex (straighten) the bent sole.

The storage chamber 911 is linked to the strap 915, such that when the chamber 911 is pressurized, the strap 915 is loose, and the sole 900 is freely dorsiflexed, and when the chamber 915 is in its unpressurized state, the strap 915 is taught (under tension), and applies a tensile force, pulling the toe toward the heel, to straighten the sole 900 along axis A. This arrangement is possible, for example, if the mounting point of the strap 915 to storage chamber 911 elongates toward the toe when pressurized, and retracts toward the heel when relaxed.

During running, heelstrikes do not reliably occur, but the strap 915 is displaced by the wearers activity dorsiflexing the sole 900, and compresses the storage chamber 911 directly. The fluid is drawn by the vacuum or partial vacuum from the heel chambers 901, 902, 903, 904, and thus the effect is quite similar. Because the fluid reciprocates between the heel chambers 901, 902, 903, 904 and storage chamber 911, valves 907, 908 remain available for control.

The control, not shown in FIG. 33, therefore triggers release of energy from the storage chamber 911 by permitting flow through the valves 907, 908, which causes the retraction of the strap 915, relaxation of the chamber 911, and return of the fluid to the heel chambers 901, 902, 903, 904, as an integral step.

Advantageously, the control acts to selectively restrict fluid flow from the storage chamber 911 to the heel chambers 901, 902, 903, 904, which can be effected through the same flow path as the initial energy absorption (bidirectional flow), or through a separate path (unidirectional flow). A number of valve types are available for this purpose, for example pinch valve (occlusion of the lumen of a tube by external pressure), rotary valves, piston valves, micromachined valves, magnetic valves (control over the position of a ferromagnetic body by an external magnetic force), etc.

Two types of valves are preferred. In each case, the flow of working fluid is modulated by a magnetic force through a continuous sealed wall, alleviating the need for valve seals bearings.

First, in a unidirectional flow system, a bolus of magnetorheological fluid (MRF) is provided which passes a flow restriction or unidirectional flow restriction. MRF is relatively expensive and heavy, so the quantity employed is generally minimized. A permanent magnet is positioned to prevent flow of the MRF unless displaced from the restriction. The control signal therefore displaces the magnet, allowing the bolus to reposition itself, thereby relieving the pressure in the storage chamber. The permanent magnet may also be replaced with an electromagnet, however, this electromagnet would be required to be active in the off state, thus dissipating power. Alternately, both a permanent magnet and electromagnet are present, with the electromagnet negating the permanent magnet field at the restriction when pressure release is desired.

Second, in a unidirectional or bidirectional flow system, a magnetic valve is provided, in which a ferromagnetic or magnetic body, such as a ball or plunger is seated or unseated magnetically, or a valve disk or plunger is displaced magnetically. The control magnet may be a permanent magnet or electromagnet. In this case, the quiescent state may require no external power, with power required only for state transition (in a latching valve type) or to hold the active state.

In fact, the entire control system may be passive, that is, not requiring electrical power for the control or actuation. For example, the unloading of pressure on the heel may draw a vacuum, which in turn causes a displacement of a magnet. Alternately, the magnet may be repositioned based on a flexion of the sole, displacement of the strap, or pressure applied to the midsole.

Thus, a completely mechanical or hydraulically activated system is possible, without any electronics. Of course, such a non-electronic system is difficult to adaptively tune, and may produce undesired responses during non-gait activity, such as basketball playing, hurdling, or other sports. On the other hand, an electronic control system can also be used to modulate the control magnetic field, either directly by modulating the current in a coil, or indirectly by modulating the location of a control magnet. Thus, a proportional control may be effected to vary the cushioning and damping effects, both in amount and timing, as well as on the release cycle. Likewise, a variety of activities may be optimized, so that the device functions appropriately under most circumstances.

The system preferably provides for fail-safe operation. Therefore, in the event of a mechanical or electrical failure, the device operates to damp downward forces at a desired level, while returning to a ready state before the next compression of the heel. The failure event in a mechanical design is characterized as a stuck open or stuck closed condition. In the stuck open condition, the heel chamber and storage reservoir are in constant communication, and thus there will be an immediate rebound, rather than energy storage. In this case, the heel chambers and storage chamber should communicate and interact to provide an acceptable resonant frequency and damping. Thus, the various spring and elasticity constants, fluid flow impedance, and other aspects of the system should be established to permit reasonable operation under this condition. In fact, in the event that the user does not desire the energy storage function, this open state may be made available as a user-selectable option, and thus may be optimized for a particular activity, such as running.

In the stuck closed condition, the heel chamber and storage chamber do not communicate. A relief valve may be provided to automatically release the restriction, independent of the control structure, if the shoe is lifted completely from the ground, or has clearly passed the normal trigger condition for release of stored energy. For example, a small control bladder in the toe may be used to control this relief valve. The logic provided is: if the toe bladder is unpressurized and the heel chambers are unpressurized then release energy from storage chamber by allowing fluid to flow from storage chamber to heel chambers.

Thus, there are preferable dual triggers for release of the stored energy, one which corresponds to a normal activity cycle, and a reset in case of bypass of the normal trigger.

It is noted that, instead of or in addition to using the stored energy for locomotion or other user activity, the stored energy may be used to power other systems, in particular an electrical energy generator and/or a refrigeration system.

An electronic control may also be used to dynamically balance forces between a plurality of heel chambers. Thus, in order to correct for pronation/supination aberrations, the flow restriction profile for left and right hand chambers, or indeed each chamber individually, may be controlled. Likewise, the transient response and rebound may also be controlled. Thus, lateral stability is improved.

Example 5

Control of Parameters of Second Order System

Elements of the cushioning in footwear can be reasonably modeled by a second order differential equation. By designing the footwear to have a cushioning which follows second order dynamics, a relatively control algorithm may be implemented to tune the footwear for optimum performance. In fact, the footwear can be modeled and controlled using this paradigm at a component level, to some advantage, even if this means providing multiple controls, dedicated to respective components, which are then coordinated at a higher level.

Motion equations for constant mass systems are based on Newton's $2^{nd}$ law, F=m×a, which can be expressed in terms of a second order equation.

$$\text{Acceleration } a = \frac{d^2x}{dt^2} = \ddot{x}$$

$$\text{Velocity } v = \frac{dx}{dt} = \dot{x}$$

the damped oscillator has forces:

$$F_{spring} = -kx \quad F_{damping} = -c\dot{x}$$

A driven oscillator has an equation which can be expressed as:

$$\frac{d^2x}{dt^2} + a_1\frac{dx}{dt} + a_0x = f(t), \quad x(0) = x_0, \ \frac{dx}{dt}(0) = \dot{x}_0$$

The general solution to this equation is:

$$x(t) = x_h(t) + x_p(t)$$

$x_h$=complementary (homogeneous) solution, i.e. the solution of the homogeneous equation (forcing term f=0):

$$\frac{d^2x}{dt^2} + a_1\frac{dx}{dt} + a_0x = 0$$

$x_p$=particular solution, the part that is determined by the forcing term f.

Homogeneous Solution: Trial solution $$x(t) = Ke^{st}$$

Differentiate and plug into homogeneous equation gives the characteristic equation $$s^2 + a_1s + a_0 = 0$$

Two solutions $$s_{1,2} = \frac{-a_1 \pm \sqrt{a_1^2 - 4a_0}}{2}$$

So homogeneous solution:

$$x_h(t) = K_1e^{s_1t} + K_2e^{s_2t}$$

Re-write characteristic equation $$s^2 + 2\zeta\omega_0s + \omega_0^2 = 0$$

$$\zeta = \frac{a_1}{\sqrt[2]{a_0}} = \text{damping ratio}$$

$\omega_0 = +\sqrt{a_0}$ = unforced natural frequency

The following expression is useful: $s=\sigma+j\omega$

Three cases:

Overdamped $\zeta>1$

Two distinct real roots $s_1=\sigma_1,\ s_2=\sigma_2$

Homogeneous solution $\chi_{ni}(t)=K_1e^{\sigma_1 t}+K_2e^{\sigma_2 t}$

Critical damping $\zeta=1$

Two equal real roots $s_1,\ s_2=\sigma$

Homogeneous solution $\chi_h(t)=K_1e^{\sigma t}+K_2te^{\sigma t}$

Underdamped $\zeta=1$

Two distinct complex roots $s_1=\sigma+j\omega,\ s_2=\sigma-j\omega$

Homogeneous solution $\chi_{ni}(t)=K_1e^{\sigma t}\cos(\omega t)+K_2e^{\sigma t}\sin(\omega t)$ Particular Solution: The trial form of the particular solution $x_p(t)$ depends on the forcing function f(t).

If f(t)=F a constant for all t, then try $x_p(t)=A$ another constant.

If $f(t)=A_f\cos(\omega t+\phi_f)$ is sinusoidal, try $\chi_p(t)=A\cos(\omega t)+B\sin(\omega t)$ General Solution: the sum of the homogeneous and the particular solutions $x(t)=x_h(t)+x_p(t)=K_1e^{s_1 t}+K_2e^{s_2 t}+x_p(t)$ If a damped oscillator is driven by an external force, the solution to the motion equation has two parts, a transient and a steady-state part, which must be used together to fit the physical boundary conditions of the problem. If, for example, the driving force is a sinusoidal waveform, then the underdamped solution takes the form:

$X(t)=A_he^{-\nu t}\sin(\omega t+\phi_h)+\cos(\omega t-\phi)$

The actual driving force is dependent on a number of circumstantial factors, and thus the system is ripe for tuning in accordance with the present invention. The tuning can be adaptive, that is, dependent on a measure circumstance of operation, and may be varied between footsteps. As discussed above, one way to tune the system is to adapt the parameters until critical damping is achieved, thus determining the system parameters at criticality. The desired damping parameter may be initially estimated based on a desired maximum displacement in response to a step (e.g., a heelstrike), with the resonant frequency adjusted until the critical point can be estimated or a desired system response achieved. The system may then be shifted from this operating point as desired. On the other hand, a sensor may be provided to measure the actual excitation force, eliminating the need to search for the critical damping value.

The footwear can be tuned by altering the damping of the sole, for example by controlling a piezoelectric damping element, fluid or gas damping element, or altering a ratio of elastic and inelastic element effects on the gait process. The footwear can also be tuned by altering the unforced natural frequency (or resonant frequency), for example by altering an operating point of a critical energy absorption element, for example, a spring, elastic bladder wall, an effective distance, or a number of other techniques.

In the foregoing, all language which defines mandatory characteristics refer solely to the embodiment referenced, and are not generally intended to limit the scope of all embodiments of the invention, nor need all inventive aspects be employed together in a single system. The above description is intended to provide a written description of a series of related conceptions, some of which may be mutually inconsistent or partially overlapping.

It should be understood that the preferred embodiments and examples described herein are for illustrative purposes only and are not to be construed as limiting the scope of the present invention, which is properly delineated only in the appended claims.

What is claimed is:

1. An article of footwear, comprising:

(a) an energy absorbing structure, for cushioning the wearer from a transient force generated during use of the footwear at a first time;

(b) an energy storage structure, for storing potential energy absorbed by said energy absorbing structure; and (c) a control, for selectively controlling a release of energy from said energy storage structure at a second time, delayed from said first time, said second time being independent of an uncontrolled natural response of said energy absorbing structure, said control receiving an input estimating an amount of energy stored in said energy storage structure.

2. The article of footwear according to claim 1, wherein said control controls a release of energy from said energy storage structure to assist in the user's gait.

3. The article of footwear according to claim 1, wherein said energy absorbing structure comprises a fluid-filled chamber.

4. The article of footwear according to claim 1, wherein said energy storage structure comprises a compliant fluidic chamber, wherein an increase in volume corresponds to an increase in energy storage.

5. The article of footwear according to claim 1, wherein said control modulates a magnetic field to control release of energy from said energy storage chamber.

6. The article of footwear according to claim 1, further comprising a fail safe release to release energy stored in said energy storage chamber independent of said control, prior to a recurrence of said transient force.

7. The article of footwear according to claim 1, wherein said control comprises a mechanical sequence generator.

8. The article of footwear according to claim 1, wherein said control comprises an electronic sequence generator.

9. The article of footwear according to claim 1, wherein said control comprises a hydraulic sequence generator.

10. The article of footwear according to claim 1, further comprising a heat pump, drawing energy from said energy absorbing structure, for altering a temperature of said footwear.

11. The article of footwear according to claim 10, wherein heat pump cools said footwear.

12. The article of footwear according to claim 10, wherein heat pump heats said footwear.

13. The article of footwear according to claim 10, wherein said energy absorbing structure compresses a gas-liquid phase change refrigerant.

14. The article of footwear according to claim 10, wherein said energy storage structure releases a compressed working fluid.

15. The article of footwear according to claim 1, wherein said energy absorbing structure comprises at least two structures, each structure having a separately controlled energy absorption profile to provide differential control over cushioning for different parts of the foot the wearer.

16. The article of footwear according to claim 1, wherein a transient response of said footwear is selectively controlled during said first time.

17. The article of footwear according to claim 1, wherein said control comprises an electrically controllable valve.

18. The article of footwear according to claim 1, wherein said control comprises a sensor for sensing a compression of said energy absorbing structure.

19. The article of footwear according to claim 1, wherein said control estimates a gait cycle phase.

20. The article of footwear according to claim 1, wherein said control comprises a memory for storing at least one representation of a condition of operation, and is adaptive over time to changing conditions of operation with respect to the at least one condition of operation represented in the memory.

21. The article of footwear according to claim 1, wherein said control draws operational energy from said energy absorbing structure.

22. The article of footwear according to claim 1, further comprising a footwear fit adjustment element, wherein the control is adapted to tighten a static fit of the footwear with increased levels of user activity.

23. The article of footwear according to claim 1, wherein the control releases energy such that a lateral stability of the footwear is dynamically controlled.

24. A method for controlling footwear, comprising the steps of:

(a) cushioning a transient force during use of the footwear at a first period of a gait cycle;

(b) storing energy from said cushioning; and (c) releasing the stored energy during use of the footwear at a second period of the gait cycle, and after said transient force has subsided, at least one of said storing and releasing steps being dependent on an estimated state of an energy storage element.

25. The method according to claim 24, further comprising the step of releasing the energy to assist in the gait cycle.

26. The method according to claim 24, wherein said releasing step delays a timing of said releasing in a manner adaptive to a use of the footwear.

27. The method according to claim 24, wherein said releasing is further dependent on a sensed phase of a user's gait cycle.

28. The method according to claim 24, further comprising the step of adapting said cushioning based on a use of the footwear.

29. An article of footwear, comprising:

(a) an energy absorbing structure, for cushioning the wearer from a transient force generated during use of the footwear at a first time;

(b) an energy storage structure, for storing at least a portion of an energy associated with said transient force absorbed by said energy absorbing structure and controllably exerting a force on the wearer at a time delayed from said transient force; and (c) an adaptive programmable control, for dynamically controlling a release of energy from said energy storage structure at a second time, delayed from said first time, back through the energy absorbing structure to the wearer, said second time being controlled separately from a natural response of said energy absorbing structure, whereby the footwear provides an adaptively controlled rebound.

30. An article of footwear, comprising:

(a) an energy absorbing structure, for cushioning the wearer from a transient force generated during use of the footwear;

(b) an energy storage structure, for storing potential energy absorbed by said energy absorbing structure; and (c) a control, for selectively controlling, over time, at least a release of energy from said energy storage structure after the transient force, independently of a natural response of said energy absorbing structure, wherein the release of energy dynamically controls a lateral stability of the footwear.

31. An article of footwear, comprising:

(a) an energy absorbing structure, for cushioning the wearer from a transient force generated during use of the footwear at a first time;

(b) an energy storage structure, for storing potential energy absorbed by said energy absorbing structure;

(c) a gait cycle phase sensor; and (c) a control, for selectively controlling release of energy from said energy storage structure at a second time, delayed from said first time, said release being controlled at least in part based on the sensed gait cycle phase.

32. The article of footwear according to claim 31, wherein said control controls a delay between said first time and said second time based at least in part on a gait cycle phase of the wearer.

33. The article of footwear according to claim 31, wherein said sensor senses a compression of said energy absorbing structure.

34. An article of footwear, comprising:

(a) an energy absorbing structure, for cushioning the wearer from a transient force generated during use of the footwear at a first time;

(b) an energy storage structure, for storing potential energy absorbed by said energy absorbing structure;

(c) a footwear fit adjustment element; and (c) a control, for selectively releasing energy from said energy storage structure at a second time, delayed from said first time, said second time being controlled independently of a natural response of said energy absorbing structure, wherein the control alters the footwear fit adjustment element to adjust a static fit of the footwear with varying levels of user activity.

* * * * *